US011181305B2

(12) United States Patent
Satou et al.

(10) Patent No.: US 11,181,305 B2
(45) Date of Patent: Nov. 23, 2021

(54) HEAT EXCHANGER OR REFRIGERATION APPARATUS INCLUDING HEAT EXCHANGER

(71) Applicant: DAIKIN INDUSTRIES, LTD., Osaka (JP)

(72) Inventors: Ken Satou, Osaka (JP); Masanori Jindou, Osaka (JP); Kouju Yamada, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 16/966,558

(22) PCT Filed: Dec. 25, 2018

(86) PCT No.: PCT/JP2018/047529
§ 371 (c)(1),
(2) Date: Jul. 31, 2020

(87) PCT Pub. No.: WO2019/150851
PCT Pub. Date: Aug. 8, 2019

(65) Prior Publication Data

US 2020/0363107 A1 Nov. 19, 2020

(30) Foreign Application Priority Data

Jan. 31, 2018 (JP) ..... JP2018-015305

(51) Int. Cl.
*F28F 9/22* (2006.01)
*F25B 39/02* (2006.01)
(Continued)

(52) U.S. Cl.
CPC ..... *F25B 39/02* (2013.01); *F25B 13/00* (2013.01); *F28F 9/027* (2013.01); *F25B 39/028* (2013.01);
(Continued)

(58) Field of Classification Search
CPC ..... F25B 39/02; F25B 39/028; F25B 13/00; F25B 2313/02741; F28F 9/027;
(Continued)

(56) References Cited

U.S. PATENT DOCUMENTS

2015/0059401 A1 3/2015 Matsuda et al.
2015/0101363 A1* 4/2015 Matsuda ..... F28F 9/0202 62/525
(Continued)

FOREIGN PATENT DOCUMENTS

CN 105593628 A 5/2016
CN 105683701 A 6/2016
(Continued)

OTHER PUBLICATIONS

Translation of foreign reference JP 2017053515 is attached pdf file (Year: 2017).*
(Continued)

*Primary Examiner* — Henry T Crenshaw
*Assistant Examiner* — Kamran Tavakoldavani
(74) *Attorney, Agent, or Firm* — Osha Bergman Watanabe & Burton LLP

(57) ABSTRACT

A heat exchanger includes: a heat exchanging part that includes flat tubes aligned vertically when the heat exchanger is installed; a first flow divider that includes a first pipe through which a refrigerant enters or exits from the first flow divider, second pipes that provide refrigerant flow paths between the heat exchanging part and the first pipe, and a main body that internally has a first space; and second flow dividers that each internally include one of second spaces that provide refrigerant flow paths between the heat exchanging part and the first flow divider. The first space communicates with a first end of the first pipe and a first end of each of the second pipes and causes the refrigerant to flow
(Continued)

from the first pipe into the second pipes or from the second pipes into the first pipe.

8 Claims, 32 Drawing Sheets

(51) Int. Cl.

| | |
|---|---|
| ***F25B 13/00*** | (2006.01) |
| ***F28F 9/02*** | (2006.01) |
| *F28D 1/053* | (2006.01) |
| *F28D 21/00* | (2006.01) |
| *F28D 7/00* | (2006.01) |

(52) U.S. Cl.
CPC .... *F25B 2313/02741* (2013.01); *F28D 1/053* (2013.01); *F28D 1/0535* (2013.01); *F28D 1/05308* (2013.01); *F28D 1/05358* (2013.01); *F28D 7/0025* (2013.01); *F28D 2021/0071* (2013.01); *F28F 9/02* (2013.01); *F28F 9/0202* (2013.01); *F28F 9/026* (2013.01); *F28F 9/0246* (2013.01); *F28F 9/0265* (2013.01)

(58) Field of Classification Search
CPC ..... F28F 9/02; F28F 9/0202; F28F 9/0246; F28F 9/026; F28F 9/0265; F28D 1/053; F28D 1/05308; F28D 1/0535; F28D 1/05358; F28D 7/0025; F28D 2021/0071
See application file for complete search history.

(56) References Cited

U.S. PATENT DOCUMENTS

| | | | | |
|---|---|---|---|---|
| 2017/0067697 | A1 | | 3/2017 | Xue et al. |
| 2017/0184351 | A1 | | 6/2017 | Satake et al. |
| 2017/0314792 | A1 | * | 11/2017 | Jindou ..... F25B 39/00 |

FOREIGN PATENT DOCUMENTS

| | | | | | |
|---|---|---|---|---|---|
| EP | 3382316 | A1 | | 10/2018 | |
| JP | 2008-256304 | A | | 10/2008 | |
| JP | 2013-164216 | A | | 8/2013 | |
| JP | 2016-070624 | A | | 5/2016 | |
| JP | 2016-095087 | A | | 5/2016 | |
| JP | 2017-053515 | A | | 3/2017 | |
| JP | 2017053515 | A | * | 3/2017 | ..... F25B 39/028 |
| JP | 2017-155990 | A | | 9/2017 | |
| WO | 2013/160952 | A1 | | 10/2013 | |
| WO | 2013/161799 | A1 | | 10/2013 | |
| WO | 2016/002280 | A1 | | 1/2016 | |

OTHER PUBLICATIONS

International Search Report issued in corresponding International Application No. PCT/JP2018/047529 dated Feb. 5, 2019 (5 pages).
Notice of Reasons for Refusal issued in corresponding Japanese Patent Application No. 2018-015305 dated Jan. 29, 2019 (10 pages).
Written Opinion of the International Searching Authority issued in corresponding International Application No. PCT/JP2018/047529 dated Feb. 5, 2019 (6 pages).
International Preliminary Report on Patentability issued in corresponding International Application No. PCT/JP2018/047529 dated Aug. 13, 2020 (11 pages).
Extended European Search Report issued in the counterpart European Patent Application No. 18903256.8, dated Mar. 1, 2021 (7 pages).

* cited by examiner

HEAT EXCHANGER OR REFRIGERATION APPARATUS INCLUDING HEAT EXCHANGER

TECHNICAL FIELD

The present invention relates to a heat exchanger or a refrigeration apparatus including a heat exchanger.

BACKGROUND

There has been known a heat exchanger including a heat exchanging part in which flat tubes are aligned, a flow divider disposed at a liquid-side end of the heat exchanger, and a header pipe disposed between the heat exchanging part and the flow divider, as disclosed by Patent Literature 1 (International Publication No. WO2013/160952), for example. According to this heat exchanger, the header pipe internally includes spaces that are aligned in a direction of arrangement of the flat tubes and that respectively communicate with the flat tubes. The spaces in the header pipe are connected to the flow divider via narrow tubes. The heat exchanger configured as above includes a plurality of paths (refrigerant flow paths).

In many cases, the heat exchanger configured as above includes the flat tubes aligned vertically in a state where the heat exchanger is installed. In a case where such a heat exchanger is used as a condenser, a head difference resulting from an installation height of the flow divider often causes accumulation of a liquid refrigerant in a lowermost flat tube (path) and/or a flat tube(s) (path(s)) near the lowermost one.

SUMMARY

One or more embodiments of the present invention provide a heat exchanger with which accumulation of the liquid refrigerant is prevented or reduced.

A heat exchanger according to one or more embodiments includes a heat exchanging part, a first flow divider, and a plurality of second flow dividers. The heat exchanging part includes a plurality of flat tubes. The flat tubes are aligned vertically in a state where the heat exchanger is installed (i.e., in an installation state). The first flow divider includes a first pipe, a plurality of second pipes, and a main body. The first pipe is a pipe where a refrigerant enters and exits. The second pipes provide refrigerant flow paths at a location between the heat exchanging part and the first pipe. The main body internally includes a first space. The first space communicates with a first end of the first pipe and with first ends of the second pipes. The first space causes the refrigerant from one of the first pipe and the second pipes to flow into the other. The second flow dividers provide refrigerant flow paths at a location between the heat exchanging part and the first flow divider. The second flow dividers internally include second spaces, respectively. The second spaces communicate with first end of the corresponding flat tube. The second spaces communicate with second end of the corresponding second pipe. The second spaces cause the refrigerant from the corresponding flat tube and the corresponding second pipe to flow into the other. The first end of the first pipe is connected to the main body such that the first pipe extends upward from the first space in the installation state. The first end of the second pipe is connected to the main body such that the second pipe extends downward from the first space in the installation state.

In the heat exchanger according to one or more embodiments, the first end of the first pipe is connected to the main body such that the first pipe extends upward from the first space in the installation state, and the first end of the second pipe is connected to the main body such that the second pipe extends downward from the first space in the installation state. This can lower the height position of the main body of the first flow divider in the installation state. Consequently, in a case where the heat exchanger is installed such that the flat tubes are aligned vertically and is used as a condenser, it is possible to reduce a head difference resulting from the installation height of the flow divider. Accordingly, in a case where the heat exchanger is used as a condenser, it is possible to prevent or reduce accumulation of a liquid refrigerant even in a lowermost flat tube (path) and/or a flat tube(s) (path(s)) near the lowermost one, where the liquid refrigerant is likely to be accumulated.

In a heat exchanger according to one or more embodiments, the main body has a top surface having a first insertion port. The top surface faces upward in the installation state. The first insertion port of the main body is connected to the first end of the first pipe.

In a heat exchanger according to one or more embodiments, the main body has a bottom surface having a plurality of second insertion ports. The bottom surface faces downward in the installation state. Each of the second insertion ports is connected to the first end of the corresponding second pipe.

In a heat exchanger according to one or more embodiments, in the installation state, each of the second pipes has a portion extending downward from the first space, which is followed by a portion curved to extend upward.

In a heat exchanger according to one or more embodiments, in the installation state, the plurality of second spaces are aligned vertically. In the installation state, each of the second pipes has a portion extending downward from the first space, which is followed by a portion curved to extend toward corresponding one of the second spaces.

In a heat exchanger according to one or more embodiments, the second pipes are provided for the second spaces in a one-to-one relation.

In a heat exchanger according to one or more embodiments, the second flow divider has first connecting port and a second connecting port. The first connecting port is connected to first end of corresponding flat tube. The second connecting port is connected to a second end of a corresponding second pipe. Each of the second flow dividers is configured such that a height position of the corresponding second connecting port is equal to or lower than a height position of a lowermost one of the corresponding the first connecting ports in the installation state.

In a heat exchanger according to one or more embodiments, a height position of a portion where the first space and a corresponding one of the second pipes communicate with each other is equal to or lower than a height position of an upper end of a lowermost one of the second spaces in the installation state.

A refrigeration apparatus according to one or more embodiments includes a compressor and a heat exchanger according to one or more embodiments. The compressor is configured to compress a refrigerant.

DETAILED DESCRIPTION

Figure 1:
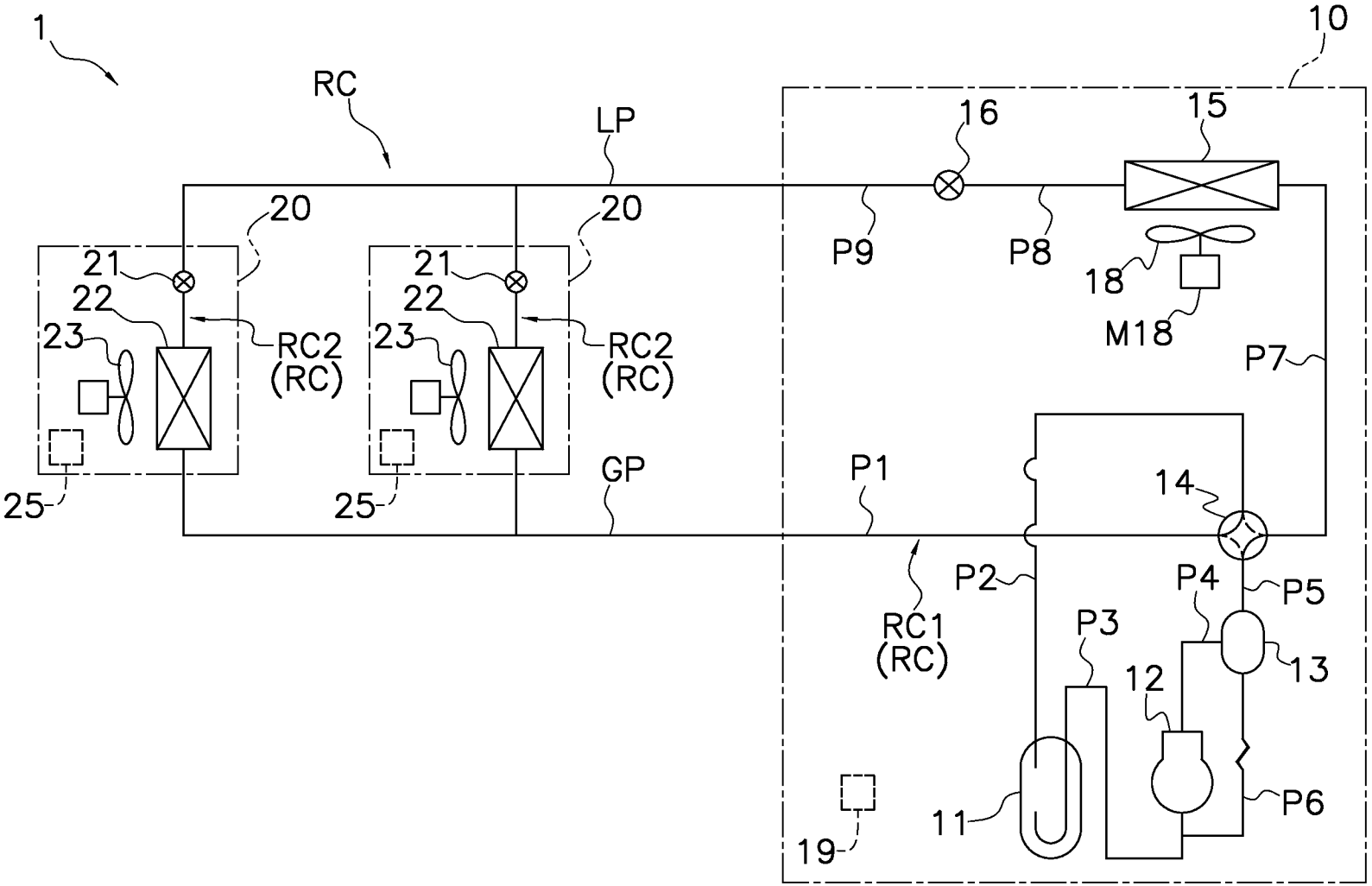
FIG. 1 is a schematic view showing a configuration of an air conditioning system.

The following will describe an outdoor heat exchanger 15 (heat exchanger) and an air conditioning system 1 (refrigeration apparatus) according to one or more embodiments of the present invention. It should be noted that the following embodiments are merely specific examples of the present invention, and do not intend to limit the technical scope of the present invention. The embodiments may be appropriately modified without departing from the gist of the present invention. In the following description, the terms "upper", "lower", "left", "right", "front", "rear", "front face", "rear face", "up-down direction", "left-right direction", "vertical direction", and "horizontal direction" denote directions illustrated in the drawings, specifically, directions in an installation state, unless otherwise specified (provided that the left and the right and/or the front and the rear may be turned appropriately in the following embodiments).

The outdoor heat exchanger 15 according to one or more embodiments of the present invention is applied to an outdoor unit 10, which is a heat source unit of the air conditioning system 1.

(1) Air Conditioning System 1

FIG. 1 is a schematic view showing a configuration of the air conditioning system 1. The air conditioning system 1 is configured to perform air conditioning, such as cooling or heating, on a target space (a space to be subjected to air conditioning, such as a residential space or a store house) by a vapor compression refrigeration cycle. The air conditioning system 1 primarily includes the outdoor unit 10, a plurality of (two in the drawing) indoor units 20, a liquid-side connection pipe LP, and a gas-side connection pipe GP.

In the air conditioning system 1, the outdoor unit 10 and the indoor units 20 are connected to each other via the liquid-side connection pipe LP and the gas-side connection pipe GP to constitute a refrigerant circuit RC. According to the air conditioning system 1, a refrigeration cycle for compressing, cooling or condensing, decompressing, heating or evaporating, and then compressing a refrigerant again takes place in the refrigerant circuit RC.

(1-1) Outdoor Unit 10

The outdoor unit 10 is installed in an outdoor space. The outdoor space refers to a space that is not a target space to be subjected to air conditioning, and examples thereof include an open-air space such as a rooftop space of a building and an underground space. The outdoor unit 10 is connected to the indoor units 20 via the liquid-side connection pipe LP and the gas-side connection pipe GP to constitute a part (an outdoor-side circuit RC1) of the refrigerant circuit RC. The outdoor unit 10 primarily includes a plurality of refrigerant pipes (a first pipe P1 to a ninth pipe P9), an accumulator 11, a compressor 12, an oil separator 13, a four-way switching valve 14, the outdoor heat exchanger 15, an outdoor expansion valve 16, and the like as devices that constitute the outdoor-side circuit RC1. These devices (11 to 16) are connected to one another via refrigerant pipes.

The first pipe P1 connects the gas-side connection pipe GP and a first port of the four-way switching valve 14. The second pipe P2 connects an inlet port of the accumulator 11 and a second port of the four-way switching valve 14. The third pipe P3 connects an outlet port of the accumulator 11 and an intake port of the compressor 12. The fourth pipe P4 connects a discharge port of the compressor 12 and an inlet of the oil separator 13. The fifth pipe P5 connects an outlet of the oil separator 13 and a third port of the four-way switching valve 14. The sixth pipe P6 connects an oil return port of the oil separator 13 and a portion between both ends of the third pipe P3. The seventh pipe P7 connects a fourth port of the four-way switching valve 14 and a gas-side inlet/outlet port of the outdoor heat exchanger 15. The eighth pipe P8 connects a liquid-side inlet/outlet port of the outdoor heat exchanger 15 and a first end of the outdoor expansion valve 16. The ninth pipe P9 connects a second end of the outdoor expansion valve 16 and the liquid-side connection pipe LP. The refrigerant pipes (P1 to P9) may actually be constituted by a single pipe or multiple pipes connected to each other via a joint and/or the like.

The accumulator 11 is a container configured to store a refrigerant therein and to separate a gas refrigerant from a liquid refrigerant, so as to suppress excessive suction of the liquid refrigerant into the compressor 12.

The compressor 12 is a device configured to compress a low-pressure refrigerant to turn the low-pressure refrigerant into a high-pressure refrigerant in the refrigeration cycle. The compressor 12 used in one or more embodiments is a closed compressor in which a compression element of a displacement type, such as a rotary type or a scroll type, is driven to rotate by a compressor motor (not illustrated). The compressor motor has an operating frequency controllable by an inverter. Controlling the operating frequency enables capacity control for the compressor 12. Start, stop, and operating capacity of the compressor 12 are controlled by an outdoor unit control unit 19.

The oil separator 13 is a container configured to separate refrigerating machine oil from the refrigerant in which the refrigerating machine oil is dissolved and which is discharged from the compressor 12 and to return the refrigerating machine oil to the compressor 12.

The four-way switching valve 14 is a flow path switching valve for changing a flow of the refrigerant in the refrigerant circuit RC.

The outdoor heat exchanger 15 is a heat exchanger that functions as a condenser (or a radiator) or an evaporator for the refrigerant. The outdoor heat exchanger 15 will be described in detail later.

The outdoor expansion valve 16 is an electric expansion valve whose opening degree is controllable. The outdoor expansion valve 16 decompresses the incoming refrigerant or adjusts the flow rate of the incoming refrigerant by controlling the opening degree.

Figure 4:
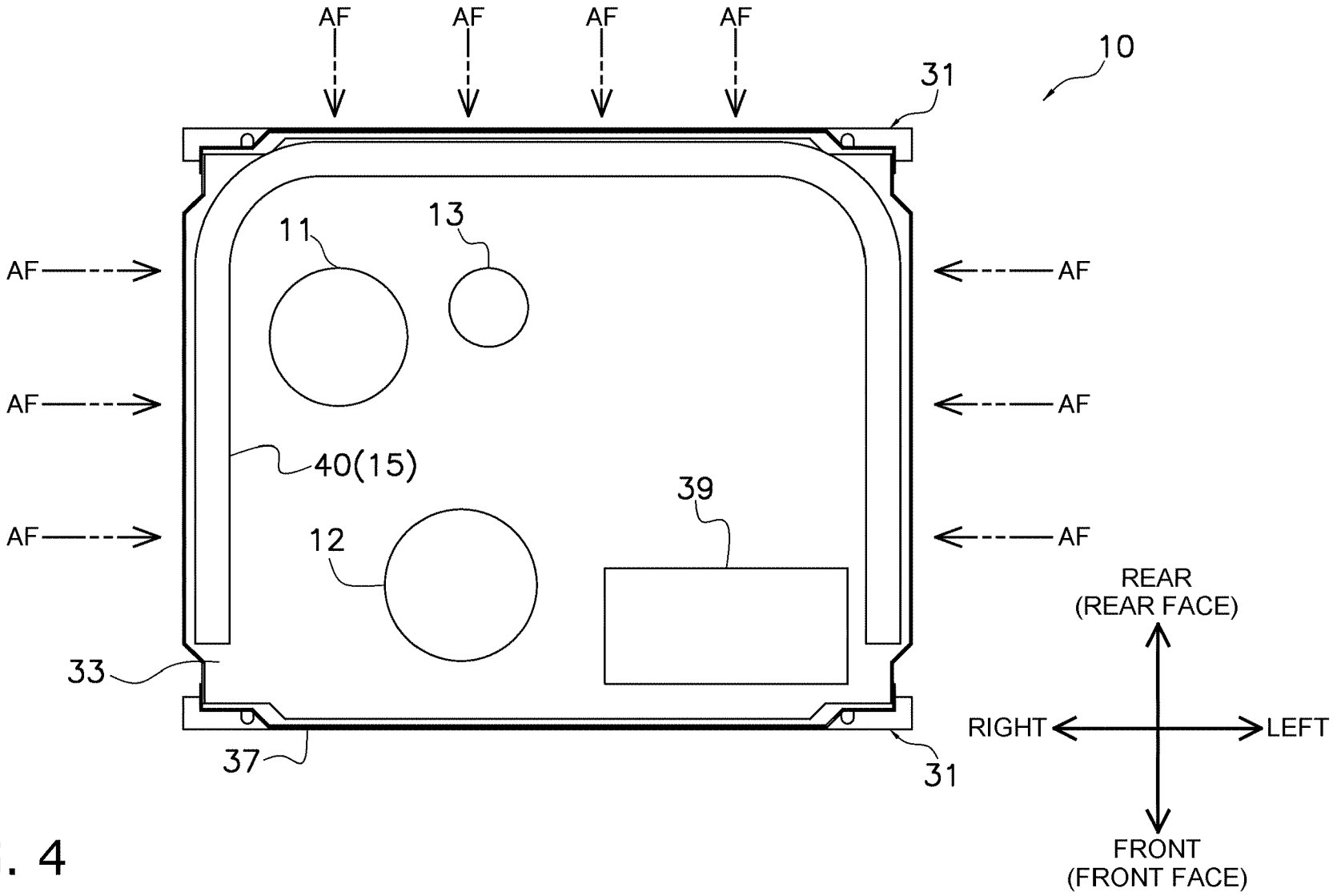
FIG. 4 is a schematic view of a layout of devices on a bottom frame and directions of outdoor air flows.
Figure 5:
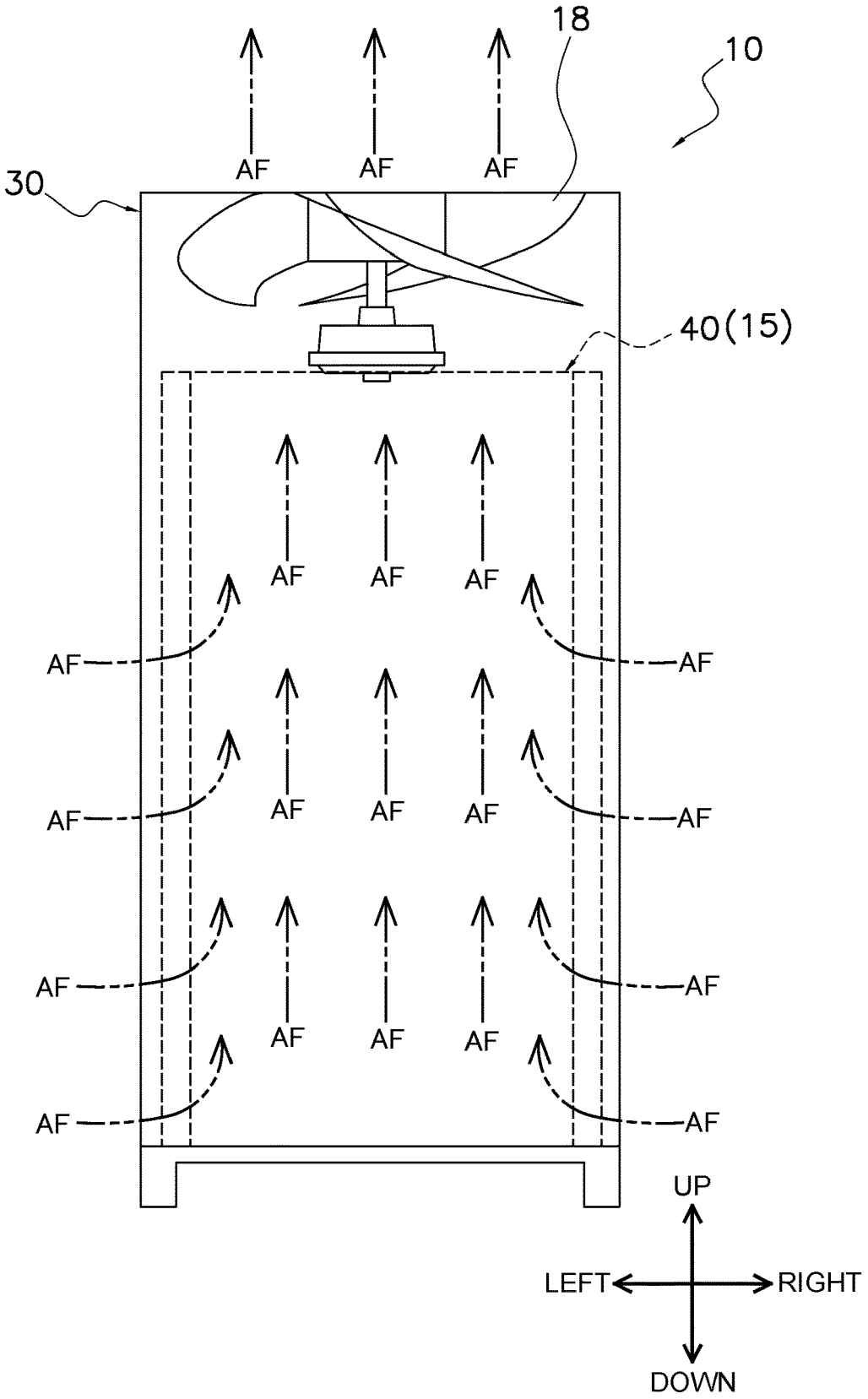
FIG. 5 is a schematic view of outdoor air flows in an outdoor unit casing.

The outdoor unit 10 also includes an outdoor fan 18 configured to generate an outdoor air flow AF (see FIGS. 4 and 5). The outdoor air flow AF (corresponding to an "air flow" in the claims) is a flow of air flowing into the outdoor unit 10 from the outside of the outdoor unit 10 and passing through the outdoor heat exchanger 15. The outdoor air flow AF serves as a cooling source or a heating source for the refrigerant flowing through the outdoor heat exchanger 15. The outdoor air flow AF passing through the outdoor heat exchanger 15 exchanges heat with the refrigerant in the outdoor heat exchanger 15. The outdoor fan 18 includes an outdoor fan motor (not illustrated), and is driven in conjunction with the outdoor fan motor. Start and stop of the outdoor fan 18 are appropriately controlled by the outdoor unit control unit 19.

The outdoor unit 10 also includes a plurality of outdoor-side sensors (not illustrated) each configured to detect a state (mainly, a pressure or a temperature) of the refrigerant in the refrigerant circuit RC. Each of the outdoor-side sensors is a pressure sensor or a temperature sensor such as a thermistor or a thermocouple. The outdoor-side sensors include, for example, a suction pressure sensor configured to detect a suction pressure that is a pressure of the refrigerant at the suction side of the compressor 12, a discharge pressure sensor configured to detect a discharge pressure that is a pressure of the refrigerant at the discharge side of the compressor 12, and a temperature sensor configured to detect a temperature of the refrigerant in the outdoor heat exchanger 15.

The outdoor unit 10 also includes the outdoor unit control unit 19 configured to control operations and states of the devices in the outdoor unit 10. The outdoor unit control unit 19 includes: a microcomputer including a CPU, a memory, and the like; and various electric components. The outdoor unit control unit 19 is electrically connected to the devices (e.g., the devices 12, 14, 16, and 18) and outdoor-side sensors in the outdoor unit 10 to exchange signals with the devices and outdoor-side sensors. The outdoor unit control unit 19 also exchanges control signals with indoor unit control units 25 of the respective indoor units 20 and remote controllers (not illustrated), for example. The outdoor unit control unit 19 is housed in an electric component box 39 (see FIGS. 3 and 4), which will be described later.

The outdoor unit 10 will be described in detail later.

(1-2) Indoor Units 20

Each indoor unit 20 is installed in the interior (e.g., a residential room or a roof-space), and constitutes a part (an indoor-side circuit RC2) of the refrigerant circuit RC. Each indoor unit 20 primarily includes an indoor expansion valve 21, an indoor heat exchanger 22, and the like as devices that constitute the indoor-side circuit RC2.

The indoor expansion valve 21 is an electric expansion valve whose opening degree is controllable. By controlling the opening degree, the indoor expansion valve 21 decompresses the incoming refrigerant or adjusts the flow rate of the incoming refrigerant.

The indoor heat exchanger 22 is a heat exchanger that functions as an evaporator or a condenser (or a radiator) for the refrigerant.

Each indoor unit 20 also includes an indoor fan 23 for sucking air inside a target space, causing the air to pass through the indoor heat exchanger 22 so that heat exchange between the air and the refrigerant takes place, and then supplying the air to the target space again. The indoor fan 23 includes an indoor fan motor serving as a drive source. The indoor fan 23 is driven to provide an indoor air flow. The indoor air flow is a flow of air that enters a respective indoor unit 20 from the target space, passes through the indoor heat exchanger 22, and then is blown out toward the target space. The indoor air flow serves as a heating source or a cooling source for the refrigerant flowing through the indoor heat exchanger 22. The indoor air flow passing through the indoor heat exchanger 22 exchanges heat with the refrigerant in the indoor heat exchanger 22.

Each indoor unit 20 also includes the indoor unit control unit 25 configured to control operations and states of the devices (e.g., the devices 21 and 23) in the indoor unit 20. The indoor unit control unit 25 includes a microcomputer including a CPU, a memory, and the like and various electric components.

(1-3) Liquid-Side Connection Pipe LP, Gas-Side Connection Pipe GP

The liquid-side connection pipe LP and the gas-side connection pipe GP are refrigerant connection pipes via which the outdoor unit 10 and the indoor units 20 are connected to each other. The liquid-side connection pipe LP and the gas-side connection pipe GP are constructed on site. The pipe lengths and pipe diameters of the liquid-side connection pipe LP and the gas-side connection pipe GP are appropriately set in accordance with the design specification and/or installation environment. Actually, the liquid-side connection pipe LP and the gas-side connection pipe GP may be constituted by a single pipe or multiple pipes connected to each other via a joint and/or the like.

(2) Flow of Refrigerant in Refrigerant Circuit RC

Next, a description of the flow of the refrigerant in the refrigerant circuit RC will be given. The air conditioning system 1 mainly performs forward cycle operation and reverse cycle operation. The low pressure in the refrigeration cycle herein refers to a pressure (a suction pressure) of the refrigerant sucked into the compressor 12, whereas the high pressure in the refrigeration cycle herein refers to a pressure (a discharge pressure) of the refrigerant discharged from the compressor 12.

(2-1) Flow of Refrigerant During Forward Cycle Operation

During forward cycle operation (e.g., operation such as cooling operation or cooling cycle defrosting operation), the four-way switching valve 14 is in a forward cycle state (a state indicated by a solid line in the four-way switching valve 14 in FIG. 1). Upon start of the forward cycle operation, in the outdoor-side circuit RC1, the refrigerant is sucked into and compressed by the compressor 12, and then is discharged from the compressor 12. The compressor 12 is subjected to capacity control according to a heating load to be required for an indoor unit 20 under operation. Specifically, an operating frequency of the compressor 12 is controlled such that the suction pressure takes a target value set in accordance with the heating load to be required for the indoor unit 20. The gas refrigerant discharged from the compressor 12 flows into the outdoor heat exchanger 15.

In the outdoor heat exchanger 15, the gas refrigerant having flowed into the outdoor heat exchanger 15 emits heat as a result of heat exchange with an outdoor air flow AF supplied by the outdoor fan 18, so that the gas refrigerant is condensed. The refrigerant having flowed out of the outdoor heat exchanger 15 enters the indoor-side circuit RC2 of the indoor unit 20 under operation through the liquid-side connection pipe LP.

The refrigerant having entered the indoor-side circuit RC2 of the indoor unit 20 under operation flows into the indoor expansion valve 21, and is decompressed to the low pressure in the refrigeration cycle in accordance with the opening degree of the indoor expansion valve 21. The refrigerant then flows into the indoor heat exchanger 22. The refrigerant having flowed into the indoor heat exchanger 22 is evaporated as a result of heat exchange with an indoor air flow supplied by the indoor fan 23, so as to be turned into the gas refrigerant. The gas refrigerant then flows out of the indoor heat exchanger 22. The gas refrigerant having flowed out of the indoor heat exchanger 22 exits from the indoor-side circuit RC2.

The refrigerant having exited the indoor-side circuit RC2 flows into the outdoor-side circuit RC1 via the gas-side connection pipe GP. The refrigerant having flowed into the outdoor-side circuit RC1 enters the accumulator 11. The refrigerant having entered the accumulator 11 is temporarily stored in the accumulator 11, and then is sucked into the compressor 12 again.

(2-2) Flow of Refrigerant During Reverse Cycle Operation

During the reverse cycle operation (e.g., heating operation), the four-way switching valve 14 is in a reverse cycle state (a state indicated by a broken line in the four-way switching valve 14 in FIG. 1). Upon start of the reverse cycle operation, in the outdoor-side circuit RC1, the refrigerant is sucked into and compressed by the compressor 12, and then is discharged from the compressor 12. The compressor 12 is subjected to capacity control according to a heating load to be required for an indoor unit 20 under operation. The gas refrigerant having been discharged from the compressor 12 flows out of the outdoor-side circuit RC1. The gas refrigerant then flows into the indoor-side circuit RC2 of the indoor unit 20 under operation via the gas-side connection pipe GP.

The refrigerant having flowed into the indoor-side circuit RC2 enters the indoor heat exchanger 22, and is condensed as a result of heat exchange with an indoor air flow supplied by the indoor fan 23. The refrigerant having flowed out of the indoor heat exchanger 22 enters the indoor expansion valve 21, and is decompressed or subjected to flow rate adjustment in accordance with the opening degree of the indoor expansion valve 21. The refrigerant then flows out of the indoor-side circuit RC2.

The refrigerant having flowed out of the indoor-side circuit RC2 enters the outdoor-side circuit RC1 via the liquid-side connection pipe LP. The refrigerant having entered the outdoor-side circuit RC1 flows into the outdoor expansion valve 16, and is decompressed to the low pressure in the refrigeration cycle in accordance with the opening degree of the outdoor expansion valve 16. Thereafter, the refrigerant flows into the liquid-side inlet/outlet port of the outdoor heat exchanger 15.

In the outdoor heat exchanger 15, the refrigerant having flowed into the outdoor heat exchanger 15 exchanges heat with an outdoor air flow AF sent by the outdoor fan 18, so that the refrigerant is evaporated. The refrigerant having flowed out of the outdoor heat exchanger 15 through the gas-side inlet/outlet port of the outdoor heat exchanger 15 enters the accumulator 11. The refrigerant having entered the accumulator 11 is temporarily stored in the accumulator 11, and then is sucked into the compressor 12 again.

(3) Details of Outdoor Unit 10

Figure 2:
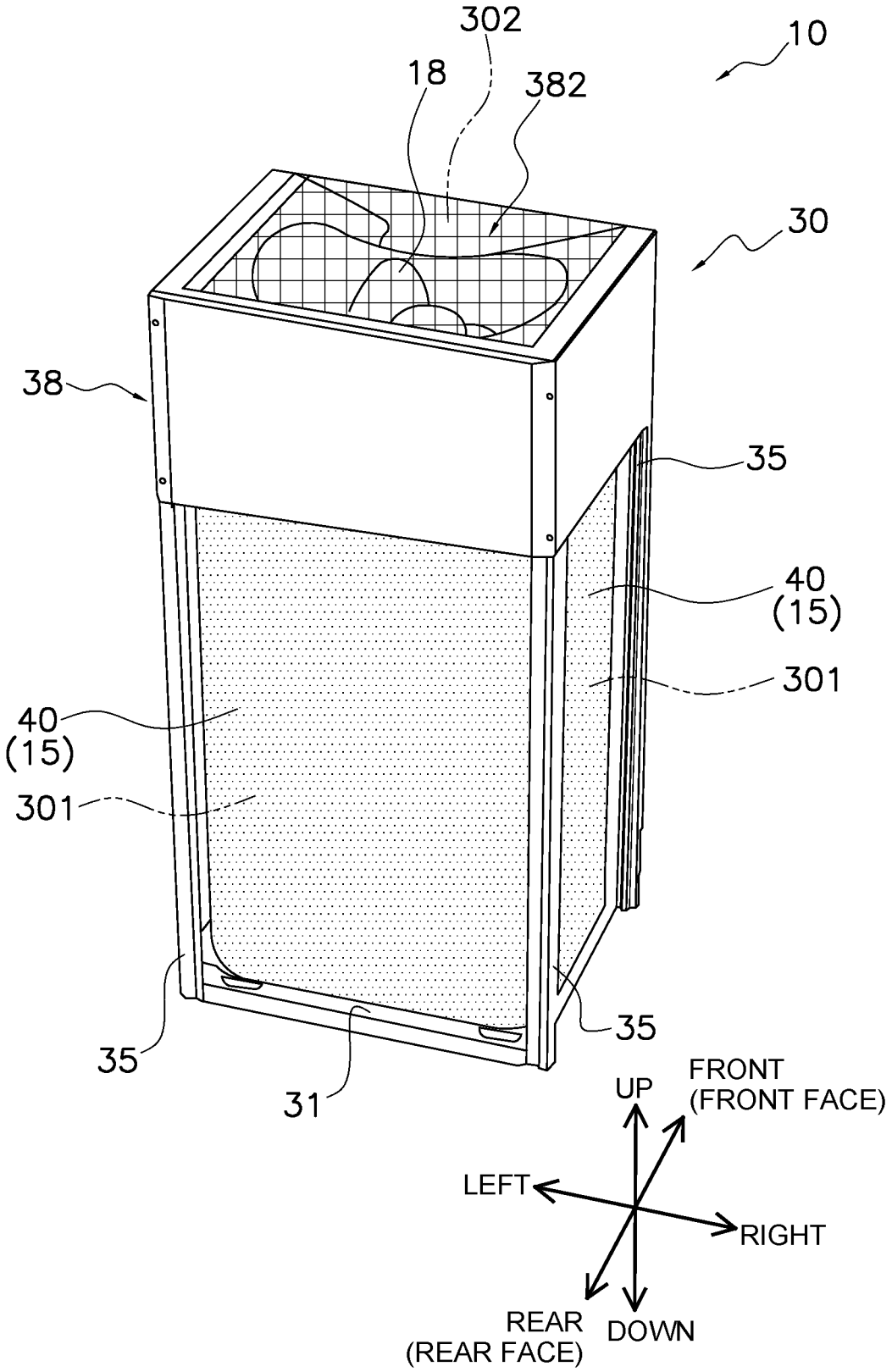
FIG. 2 is a perspective view of an outdoor unit.
Figure 3:
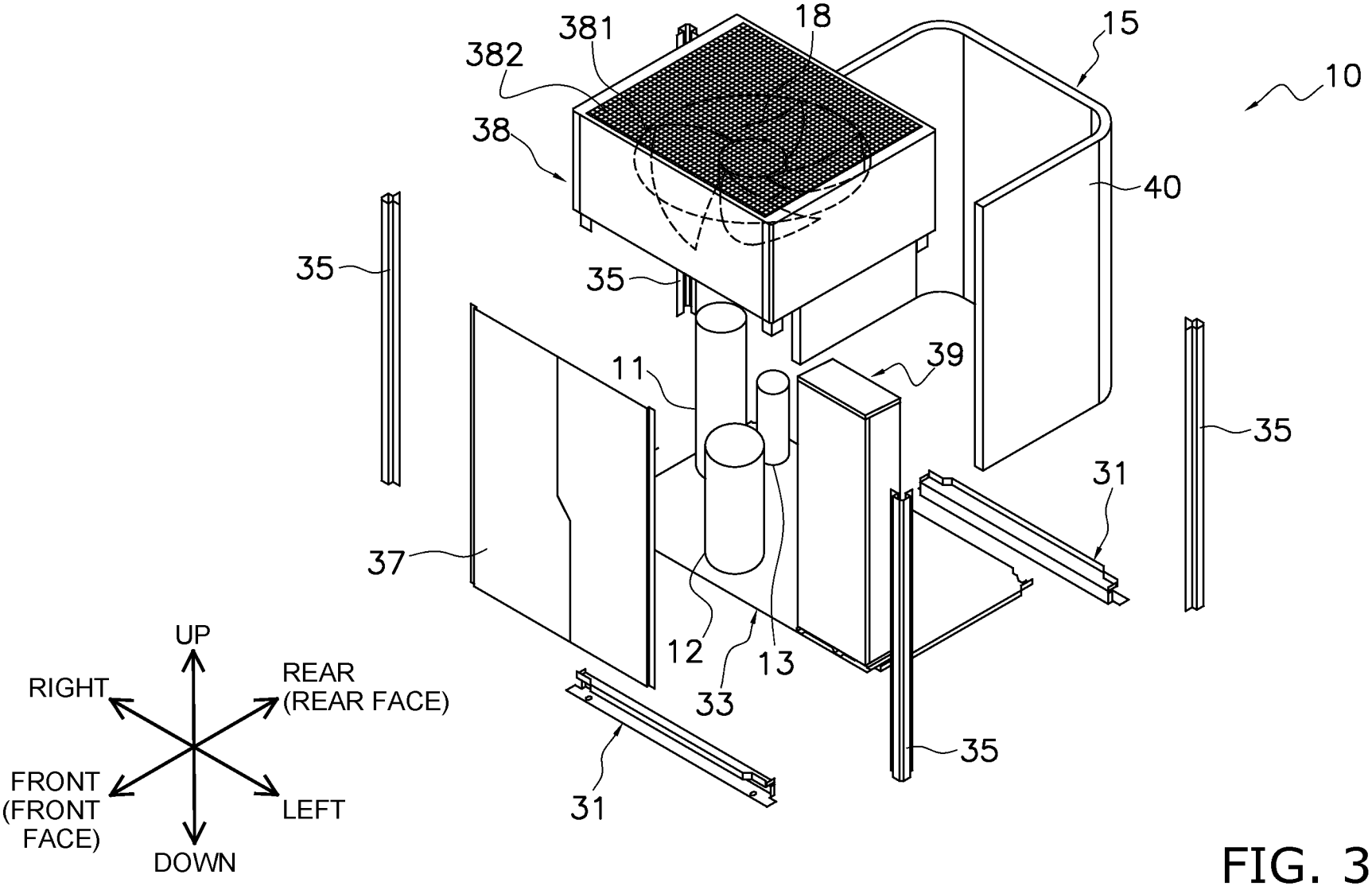
FIG. 3 is a schematic exploded view of the outdoor unit.

FIG. 2 is a perspective view of the outdoor unit 10. FIG. 3 is a schematic exploded view of the outdoor unit 10.

(3-1) Outdoor Unit Casing 30

The outdoor unit 10 includes an outdoor unit casing 30 defining an outer contour and housing therein the devices (e.g., the devices 11 to 16). The outdoor unit casing 30 is made of a plurality of sheet metal members stacked vertically in the form of a substantially rectangular parallelepiped shape. The outdoor unit casing 30 has a left side face, a right side face, and a rear face that are mostly openings. These openings function as intake ports 301 through which outdoor air flows AF are sucked.

The outdoor unit casing 30 primarily includes a pair of installation legs 31, a bottom frame 33, a plurality of (four in the drawing) supports 35, a front face panel 37, and a fan module 38.

The installation legs 31 are sheet metal members extending in the left-right direction and supporting the bottom frame 33 from below. The installation legs 31 are located near front and rear ends of the outdoor unit casing 30, respectively.

The bottom frame 33 is a sheet metal member constituting a bottom face portion of the outdoor unit casing 30. The bottom frame 33 is disposed on the pair of installation legs 31. The bottom frame 33 has substantially a rectangular shape in a plan view.

The supports 35 extend vertically from corner portions of the bottom frame 33, respectively. As illustrated in FIGS. 2 and 3, the supports 35 extend vertically from the four corner portions of the bottom frame 33, respectively.

The front face panel 37 is a sheet metal member constituting a front face portion of the outdoor unit casing 30.

The fan module 38 is mounted to upper ends of the supports 35 or to portions near the upper portions. The fan module 38 constitutes portions of a front face, a rear face, a left side face, and a right side face of the outdoor unit casing 30, the portions being higher than the supports 35. In addition, the fan module 38 constitutes a top surface of the outdoor unit casing 30. The fan module 38 includes the outdoor fan 18 and a bell mouth 381. More specifically, the fan module 38 is an assembly of the outdoor fan 18 and bell mouth 381 housed in a substantial parallelepiped box whose upper and lower faces are opened. In the fan module 38, the outdoor fan 18 is disposed such that its axis of rotation extends vertically. The fan module 38 has an upper face with an opening that functions as a blow-out port 302 through which an outdoor air flow AF is blown out from the outdoor unit casing 30. The blow-out port 302 is provided with a grid-shaped grille 382.

In the example illustrated in FIGS. 2 and 3, the outdoor unit 10 includes one fan module 38. Alternatively, the outdoor unit 10 may include a plurality of fan modules 38. For example, the outdoor unit 10 may include two fan modules 38 arranged side by side in the left-right direction. Such an outdoor unit 10 may include an outdoor unit casing 30 larger in size than the outdoor unit 10 including one fan module 38 and two front face panels 37 arranged on the left and right, respectively. Such an outdoor unit 10 may include a large outdoor heat exchanger 15 whose size is determined in accordance with the size of the outdoor unit casing 30.

(3-2) Devices on Bottom Frame 33

FIG. 4 is a schematic view of a layout of the devices on the bottom frame 33 and directions of outdoor air flows AF. As illustrated in FIG. 4, various devices, including the accumulator 11, the compressor 12, the oil separator 13, and the outdoor heat exchanger 15, are disposed at predetermined positions on the bottom frame 33. In addition, the electric component box 39 housing therein the outdoor unit control unit 19 is disposed on the bottom frame 33.

The outdoor heat exchanger 15 has a heat exchanging part 40 (see FIG. 4) disposed to face the left side face, right side face, and rear face of the outdoor unit casing 30. The heat exchanging part 40 is substantially equal in height to the intake ports 301. The intake ports 301 occupy most parts of the rear face, left side face, and right side face of the outdoor unit casing 30. The heat exchanging part 40 of the outdoor heat exchanger 15 is exposed from the intake ports 301. In other words, the rear face, left side face, and right side face of the outdoor unit casing 30 are substantially formed of the heat exchanging part 40 of the outdoor heat exchanger 15. The outdoor heat exchanger 15 has three parts constituting the heat exchanging part 40. In this regard, the outdoor heat exchanger 15 has curved portions on the left and right sides in a plan view (see B1, B2, and B3 in FIG. 8). In other words, the outdoor heat exchanger 15 has a substantial U-shape having an opening in its front face.

(3-3) Outdoor Air Flows AF in Outdoor Unit Casing 30

FIG. 5 is a schematic view of outdoor air flows AF in the outdoor unit casing 30. As illustrated in FIGS. 4 and 5, outdoor air flows AF flow into the outdoor unit casing 30 through the intake ports 301 in the left side face, right side face, and rear face of the outdoor unit casing 30, and pass through the outdoor heat exchanger 15 (heat exchanging part 40). The outdoor air flows AF then flow primarily upward from below to flow out of the outdoor heat exchanger 15 through the blow-out port 302. Specifically, the outdoor air flows AF flow horizontally into the outdoor unit casing 30 through the intake ports 301, pass through the outdoor heat exchanger 15, turn upward, and flow upward from below toward the blow-out port 302. The outdoor air flows AF flowing into the outdoor unit casing 30 travel at a higher wind speed in a space closer to the outdoor fan 18 than in a lower space farther from the outdoor fan 18. While the outdoor air flows AF are passing through the heat exchanging part 40 of the outdoor heat exchanger 15, outdoor air flows AF in an upper space (particularly, paths above the center) travel at a higher wind speed than outdoor air flows AF in a lower space (particularly, paths below the center).

(4) Details of Configuration of Outdoor Heat Exchanger 15

Figure 6:
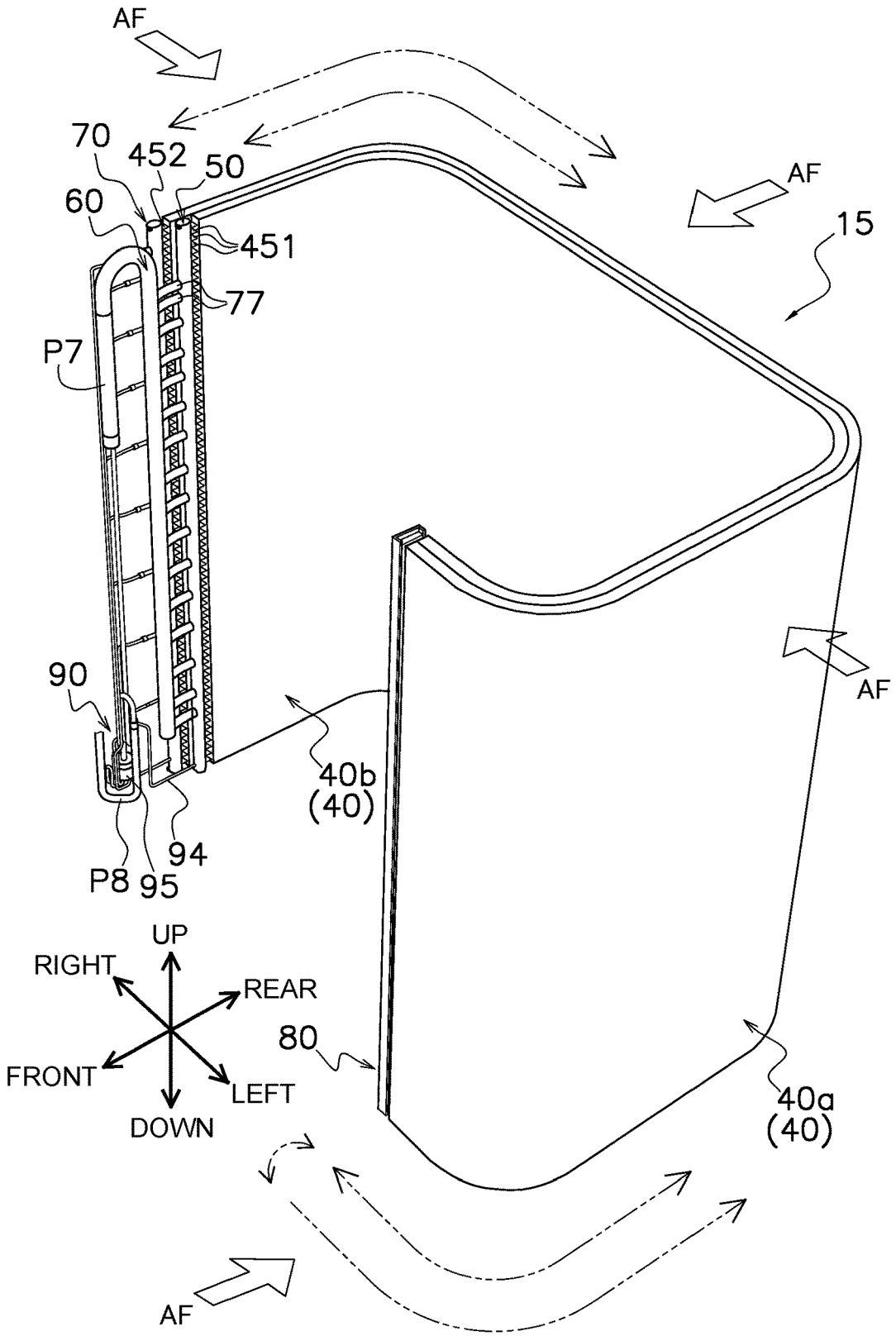
FIG. 6 is a perspective view of an outdoor heat exchanger.
Figure 7:
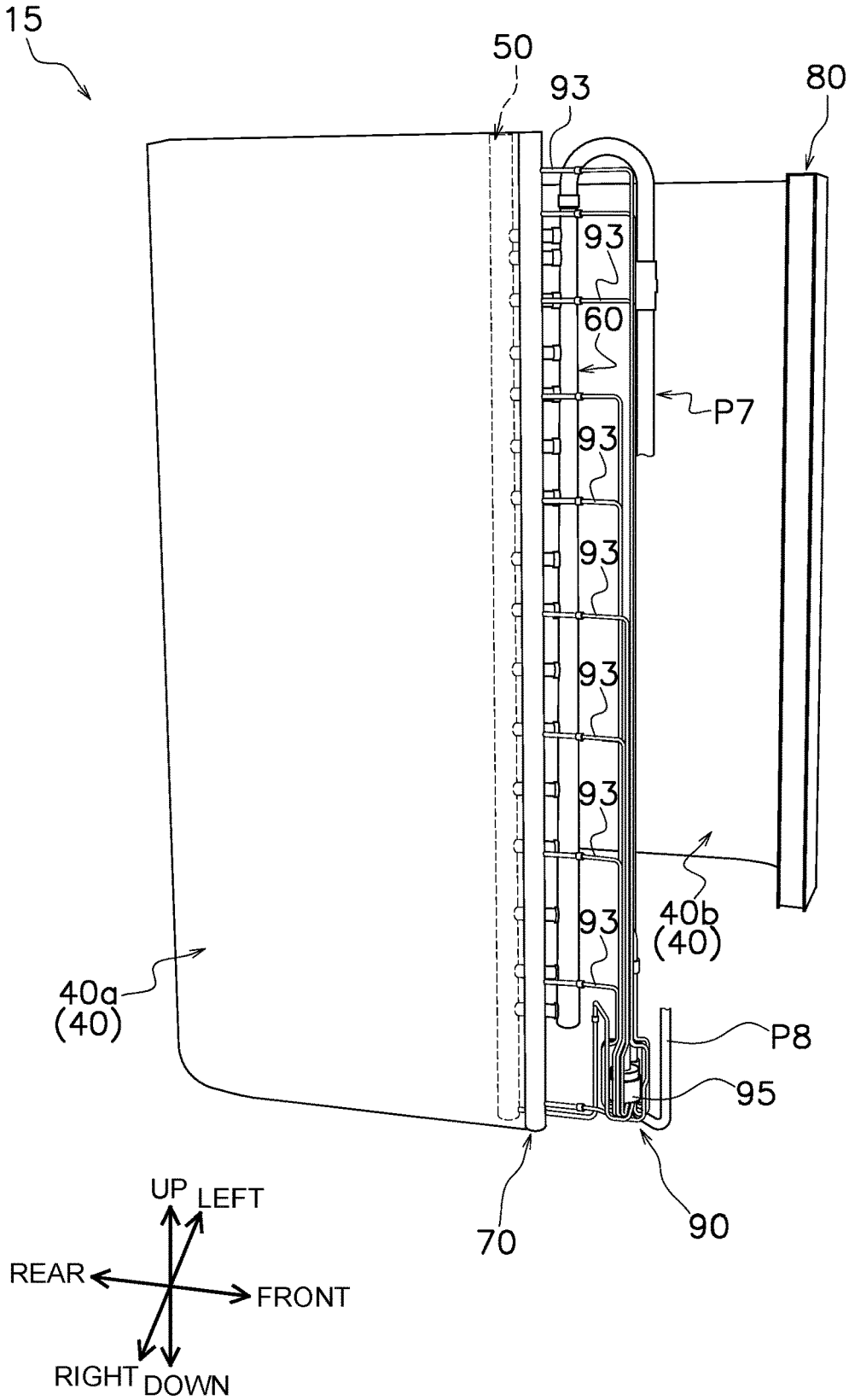
FIG. 7 is a perspective view of the outdoor heat exchanger, viewed in a different direction from FIG. 6.
Figure 8:
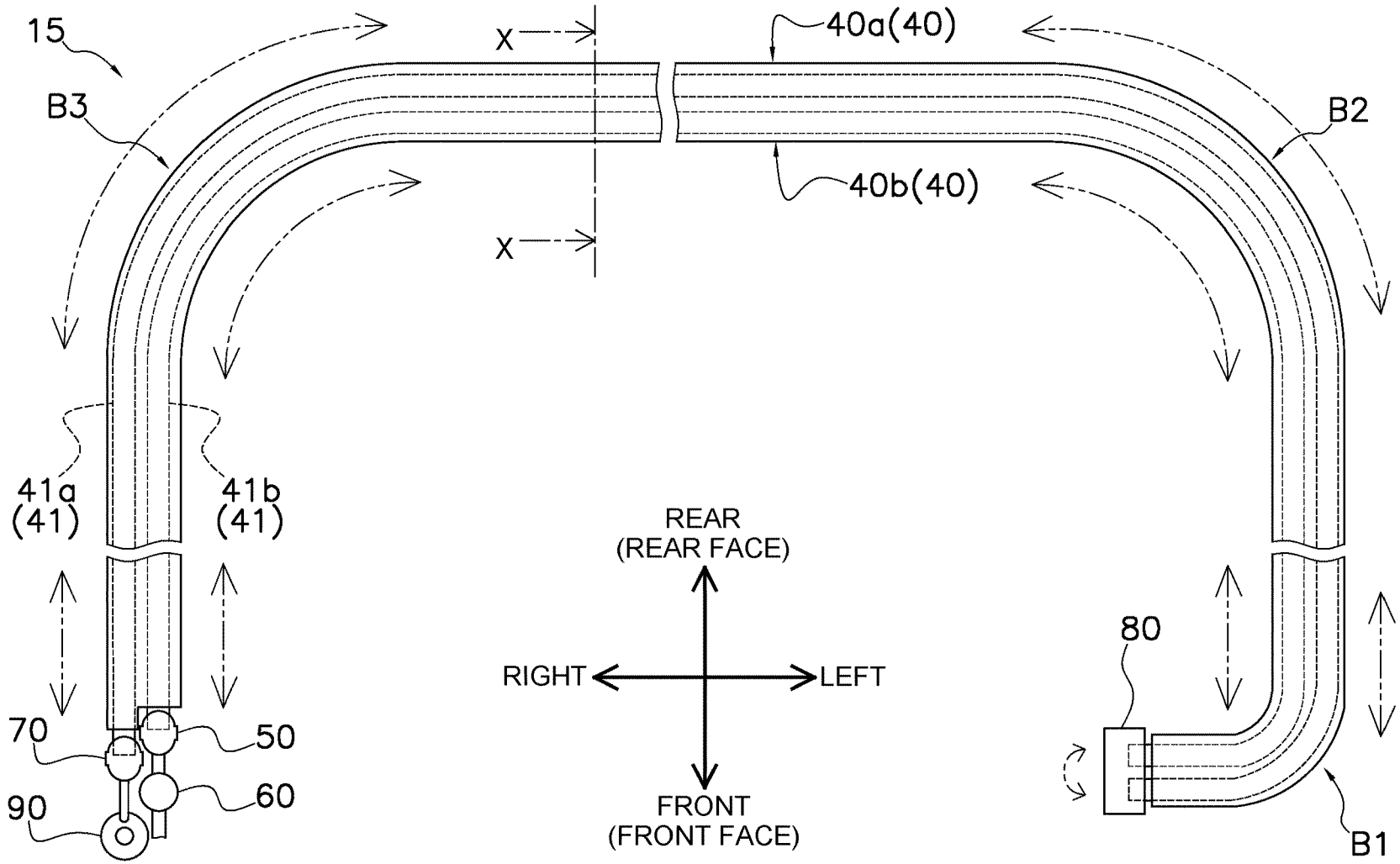
FIG. 8 is a schematic view of the outdoor heat exchanger viewed in a plan view.

FIG. 6 is a perspective view of the outdoor heat exchanger 15. FIG. 7 is a perspective view of the outdoor heat exchanger 15, viewed in a different direction from FIG. 6. FIG. 8 is a schematic view of the outdoor heat exchanger 15 in a plan view.

The outdoor heat exchanger 15 primarily includes the heat exchanging part 40, a first header pipe 50, a gas-side collecting pipe 60, a second header pipe 70, a turnaround header 80, and a flow divider 90. In one or more embodiments, the heat exchanging part 40, the first header pipe 50, the gas-side collecting pipe 60, the second header pipe 70, the turnaround header 80, and the flow divider 90 are all made of aluminum or an aluminum alloy. The outdoor heat exchanger 15 is assembled by bonding via brazing. Specifically, the heat exchanging part 40, the first header pipe 50, the gas-side collecting pipe 60, the second header pipe 70, the turnaround header 80, and the flow divider 90 that are temporarily assembled are brazed with a brazing filler metal in a furnace.

(4-1) Heat Exchanging Part 40

Figure 9:
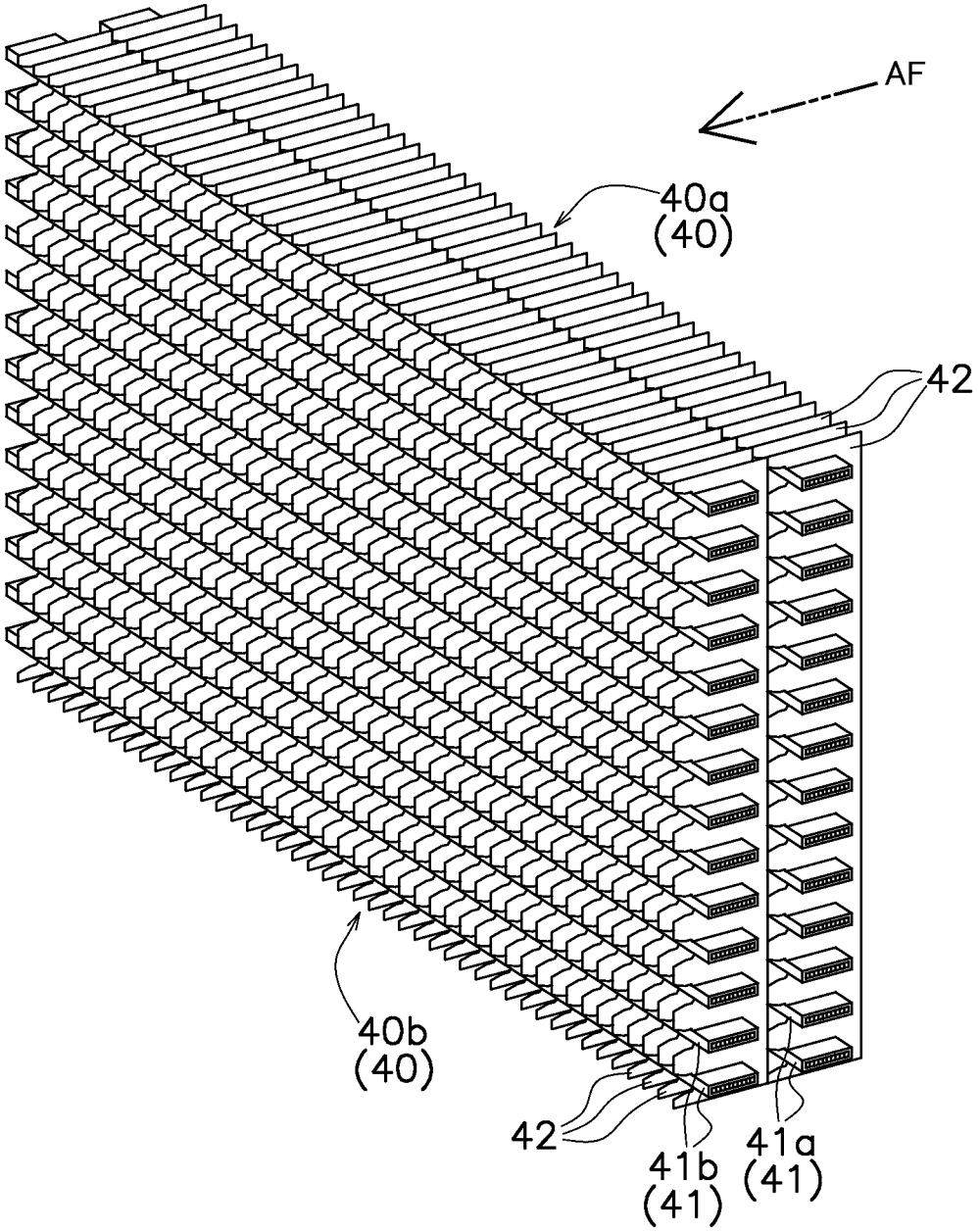
FIG. 9 is a schematic view of a heat exchanging part.
Figure 10:
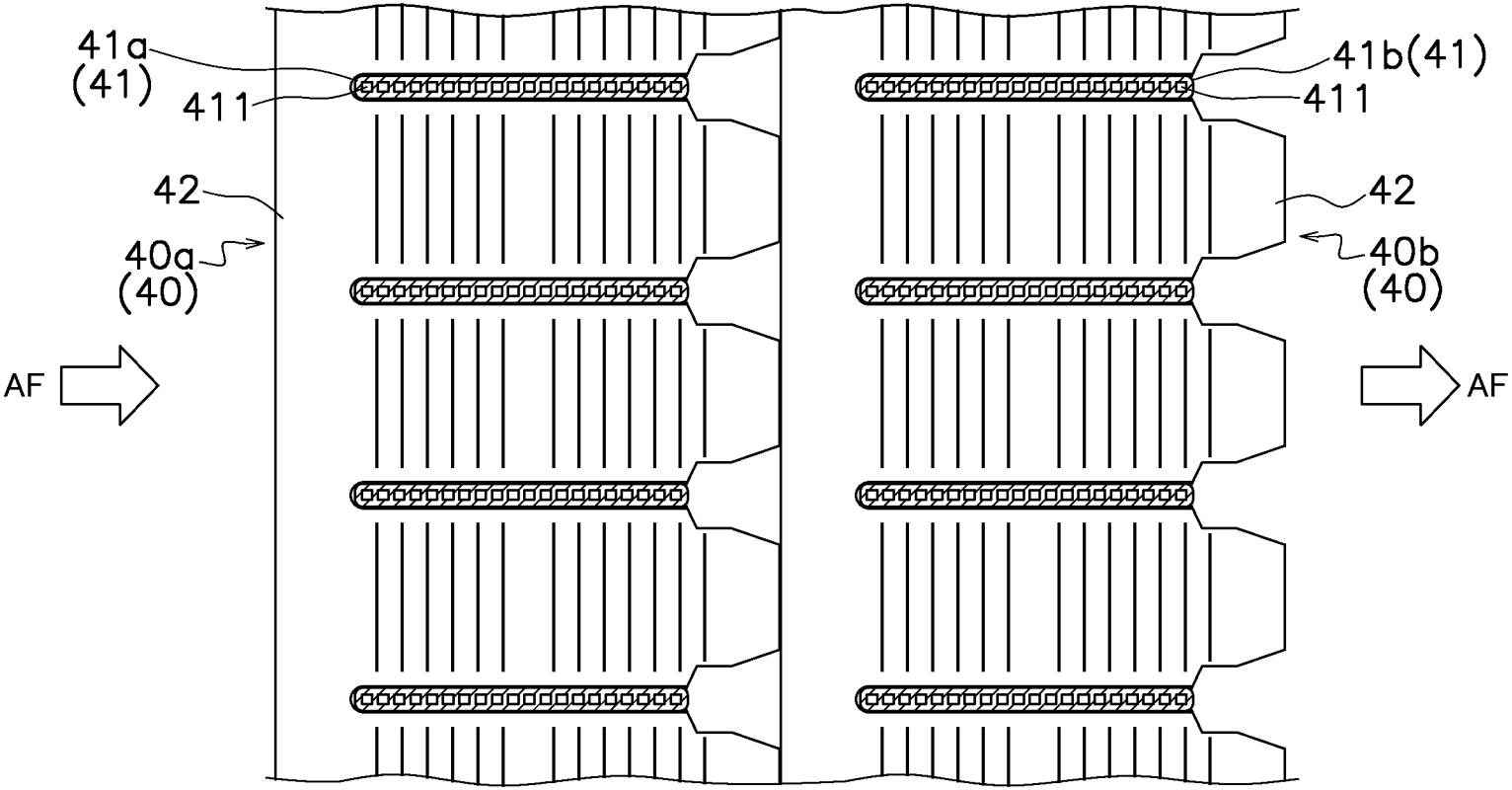
FIG. 10 is a partial enlarged view of a cross section taken along X-X line in FIG. 8.

FIG. 9 is a schematic view of the heat exchanging part 40. FIG. 10 is a partial enlarged view of a cross section taken along X-X line in FIG. 8.

In the heat exchanging part 40, heat exchange takes place between an outdoor air flow AF and a refrigerant in the outdoor heat exchanger 15 (heat transfer tubes 41, which will be described later). Specifically, the heat exchanging part 40 occupies a center portion of the outdoor heat exchanger 15 and intersects with traveling directions of outdoor air flows AF, and accounts for a major part of the outdoor heat exchanger 15. The heat exchanging part 40 primarily has three heat exchanging faces, and has a substantial U-shape or a substantial C-shape in a plan view (see FIG. 8).

In one or more embodiments, the outdoor heat exchanger 15 includes a plurality of (two in the drawing) parts constituting the heat exchanging part 40. Specifically, the outdoor heat exchanger 15 includes, as the heat exchanging part 40, a windward-side heat exchanging part 40*a* and a downwind-side heat exchanging part 40*b*. The windward-side heat exchanging part 40*a* and the downwind-side heat exchanging part 40*b* are arranged adjacent to each other along the flow direction of the outdoor air flow AF. The windward-side heat exchanging part 40*a* is a part of the heat exchanging part 40 located on a windward side (outer side in the drawing). The downwind-side heat exchanging part 40*b* is a part of the heat exchanging part 40 located on a downwind side (inner side in the drawing).

The heat exchanging part 40 primarily includes a plurality of heat transfer tubes 41 (corresponding to "flat tubes" in the claims) through which the refrigerant flows and a plurality of heat transfer fins 42.

Each heat transfer tube 41 is a flattened multi-hole tube internally including a plurality of refrigerant flow paths 411. The heat transfer tube 41 is made of aluminum or an aluminum alloy. In one or more embodiments, in a state where the outdoor heat exchanger is installed (i.e., in an installation state), 97 heat transfer tubes 41 are aligned in a top-bottom direction (vertical direction) in the heat exchanging part 40. The heat transfer tubes 41 extend horizontally along the shape of the heat exchanging part 40 in a plan view. For convenience of explanation, heat transfer tubes 41 included in the windward-side heat exchanging part 40*a* are referred to as windward-side heat transfer tubes 41*a*, and heat transfer tubes 41 included in the downwind-side heat exchanging part 40*b* are referred to as downwind-side heat transfer tubes 41*b*. The windward-side heat transfer tubes 41*a* have first ends connected to the second header pipe 70 and second ends connected to the turnaround header 80. The downwind-side heat transfer tube 41*b* have first ends connected to the first header pipe 50 and second ends connected to the turnaround header 80.

The heat transfer fins 42 are plate-shaped members that provide an increased heat transfer area where heat transfer takes place between the heat transfer tubes 41 and the outdoor air flows. The heat transfer fins 42 are made of aluminum or an aluminum alloy. In the heat exchanging part 40, the heat transfer fins 42 extend in the top-bottom direction so as to intersect with the heat transfer tubes 41. The heat transfer fins 42 have multiple cutouts arranged in the top-bottom direction. Into the cutouts, the heat transfer tubes 41 are inserted.

In FIGS. 6 and 8, the chain double-dashed arrows indicate the directions of the flows of the refrigerant in the heat exchanging parts. The chain double-dashed arrows point in opposite directions, because the flow of the refrigerant during heating operation and the flow of the refrigerant during cooling operation are opposite to each other. During forward cycle operation, the refrigerant enters the windward-side heat exchanging part 40*a* (windward-side heat transfer tubes 41*a*) via the second header pipe 70 and flows therethrough, and then makes a turn in the turnaround header 80. Thereafter, the refrigerant enters the downwind-side heat exchanging part 40*b* (downwind-side heat transfer tubes 41*b*) via the turnaround header 80 and flows therethrough, so as to reach the first header pipe 50. During reverse cycle operation, the refrigerant enters the downwind-side heat exchanging part 40*b* (downwind-side heat transfer tubes 41*b*) via the first header pipe 50 and flow therethrough, and then makes a turn in the turnaround header 80. Thereafter, the refrigerant enters the windward-side heat exchanging part 40*a* (windward-side heat transfer tubes 41*a*) via the turnaround header 80 and flows therethrough, so as to reach the second header pipe 70.

(4-2) First Header Pipe 50, Gas-Side Collecting Pipe 60

Figure 11:
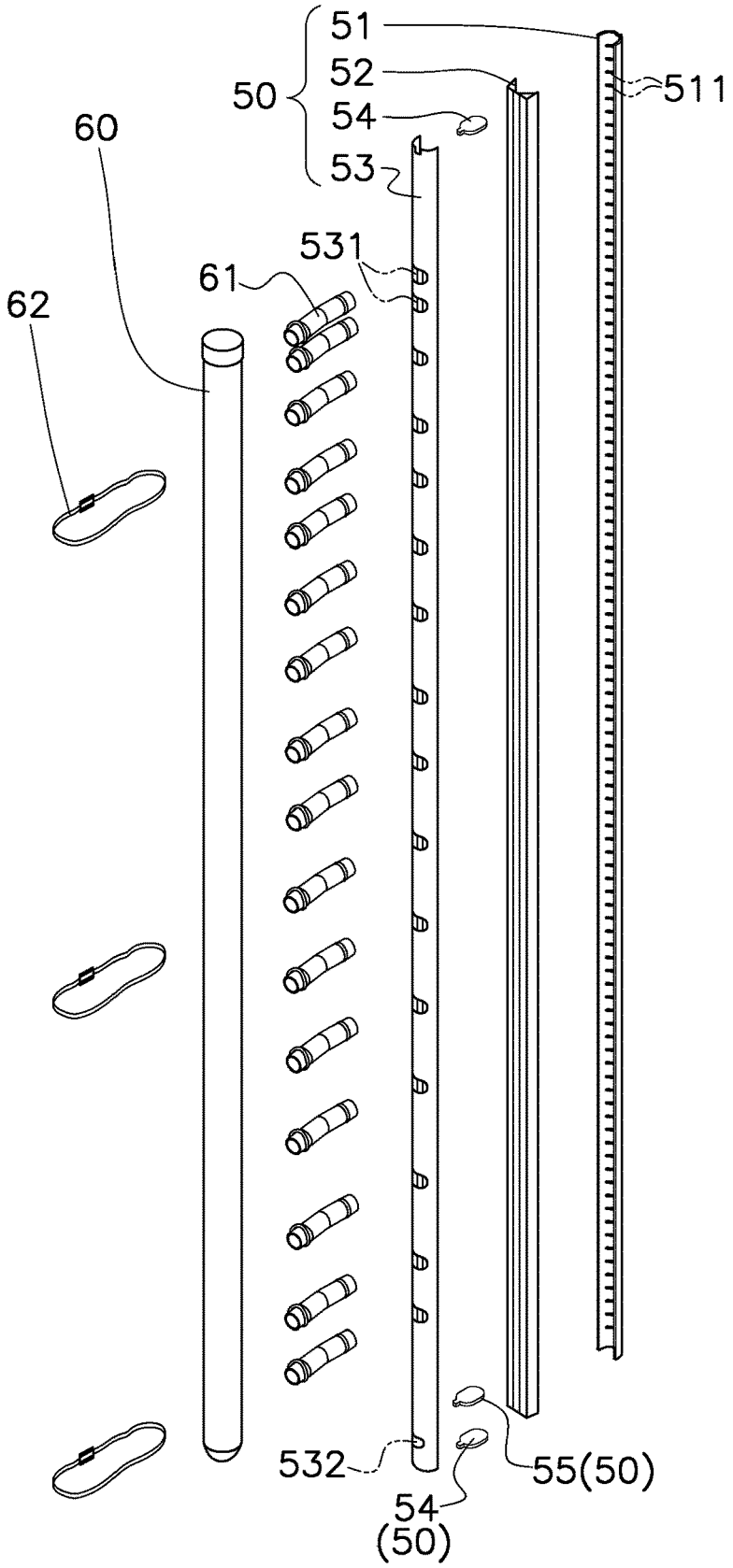
FIG. 11 is an exploded view of a first header pipe and a gas-side collecting pipe.

FIG. 11 is an exploded view of the first header pipe 50 and the gas-side collecting pipe 60. The first header pipe 50 is a long, thin, hollow cylindrical member extending in the top-bottom direction and having closed upper and lower ends. The first header pipe 50 is disposed adjacent to the first end of the downwind-side heat exchanging part 40*b*. The first header pipe 50 includes a downwind heat transfer tube-side member 51, a first header partitioning member 52, a collecting pipe-side member 53, a plurality of first partitioning plates 54, and a second partitioning plate 55.

Figure 32:
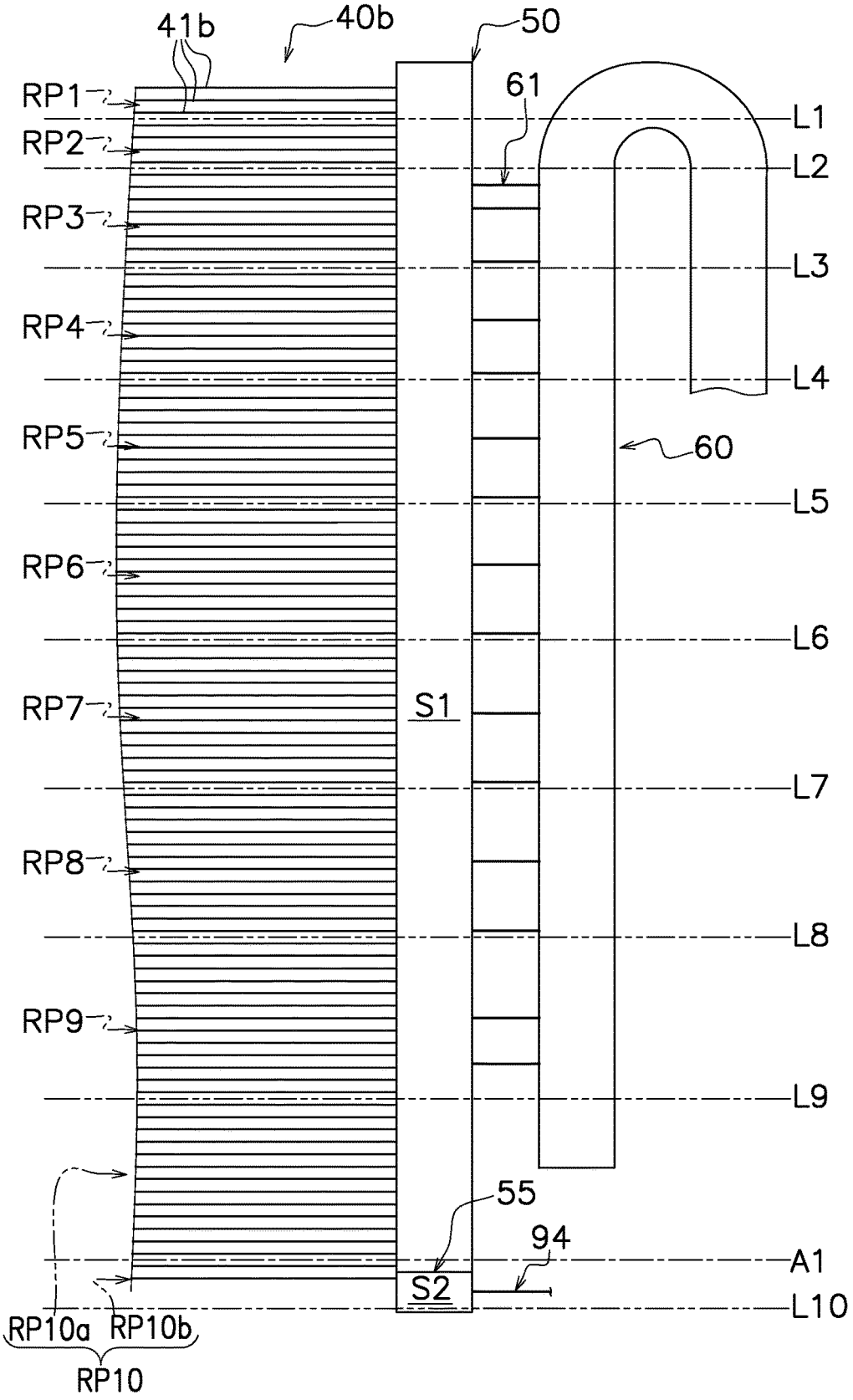
FIG. 32 is a schematic view of the paths of the outdoor heat exchanger viewed from a downwind side.

The downwind heat transfer tube-side member 51, the first header partitioning member 52, and the collecting pipe-side member 53 are integrated together by assembling the downwind heat transfer tube-side member 51, the first header partitioning member 52, and the collecting pipe-side member 53 with the first header partitioning member 52 being sandwiched by the downwind heat transfer tube-side member 51 and the collecting pipe-side member 53 and longitudinal directions of the downwind heat transfer tube-side member 51, the first header partitioning member 52, and the collecting pipe-side member 53 coinciding with each other. The upper and lower ends of the first header pipe 50 are respectively closed by the two first partitioning plates 54. In addition, the second partitioning plate 55 is attached to the first header pipe 50 at a location close to the lower end of the first header pipe 50. Consequently, the internal space of the first header pipe 50 is divided into a first header main space S1 and a first header sub space S2 (see FIG. 32). As illustrated in FIG. 32, in one or more embodiments, the first header main space S1 communicates with first ends of 96 downwind-side heat transfer tubes 41*b*, whereas the first header sub space S2 communicates with a first end of a lowermost one of the downwind-side heat transfer tubes 41*b*.

The downwind heat transfer tube-side member 51, the first header partitioning member 52, the collecting pipe-side member 53, the first partitioning plates 54, and the second partitioning plate 55 are integrated together by bonding them via brazing with a brazing filler metal in a furnace.

The downwind heat transfer tube-side member 51 has an arc-shaped cross section cut in a plane extending vertically in the top-bottom direction. The downwind heat transfer tube-side member 51 has downwind heat transfer tube connecting openings 511 into which the ends of the heat transfer tubes 41 (downwind-side heat transfer tubes 41*b*) are inserted. The number of downwind heat transfer tube connecting openings 511 is equal to the number of stages of the heat transfer tubes 41.

The first header partitioning member 52 has a plurality of openings (not illustrated) through which the refrigerant flows from the downwind heat transfer tube-side member 51 toward the collecting pipe-side member 53.

The collecting pipe-side member 53 has an arc-shaped cross section cut in a plane orthogonal to the top-bottom direction. The collecting pipe-side member 53 has a plurality of openings 531 into which first ends of connection pipes 61 are inserted. Via the connection pipes 61, the first header pipe 50 and the gas-side collecting pipe 60 are connected to each other. The number of openings 531 is equal to the number of connection pipes 61, which are arranged in the top-bottom direction. The openings 531 communicate with the first header main space S1. In addition, the collecting pipe-side member 53 has a second thin tube connecting opening 532 for connection with a second thin tube 94 (described later) of the flow divider 90. The second thin tube connecting opening 532 communicates with the first header sub space S2.

The gas-side collecting pipe 60 is a straight cylindrical tube with a bottom. In the outdoor heat exchanger 15, the gas-side collecting pipe 60 provides the gas-side inlet/outlet port. Specifically, during forward cycle operation (in a case where an inflow/outflow pipe 91 (described later) of the flow divider 90 serves as an outlet pipe for the refrigerant), the gas-side collecting pipe 60 is an inlet pipe for the refrigerant. Meanwhile, during reverse cycle operation (in a case where the inflow/outflow pipe 91 (described later) serves as the inlet pipe for the refrigerant), the gas-side collecting pipe 60 is the outlet pipe for the refrigerant. The gas-side collecting pipe 60 is disposed adjacent to the first header pipe 50. The first header pipe 50 and the gas-side collecting pipe 60 are bundled together by bundling bands 62. In the refrigerant circuit RC, the gas-side collecting pipe 60 is located between the first header pipe 50 and the seventh pipe P7. The gas-side collecting pipe 60 is connected to a first end of the seventh pipe P7. The gas-side collecting pipe 60 has, in its side surface, a plurality of openings (not illustrated) to which second ends of the connection pipes 61 (that extend to the first header pipe 50) are connected.

The outdoor heat exchanger 15 is configured such that the heat transfer tubes 41 (the downwind-side heat transfer tubes 41*b*) and the seventh pipe P7 communicate with each other via the first header pipe 50, the plurality of connection pipes 61, and the gas-side collecting pipe 60.

(4-3) Second Header Pipe 70

Figure 12:
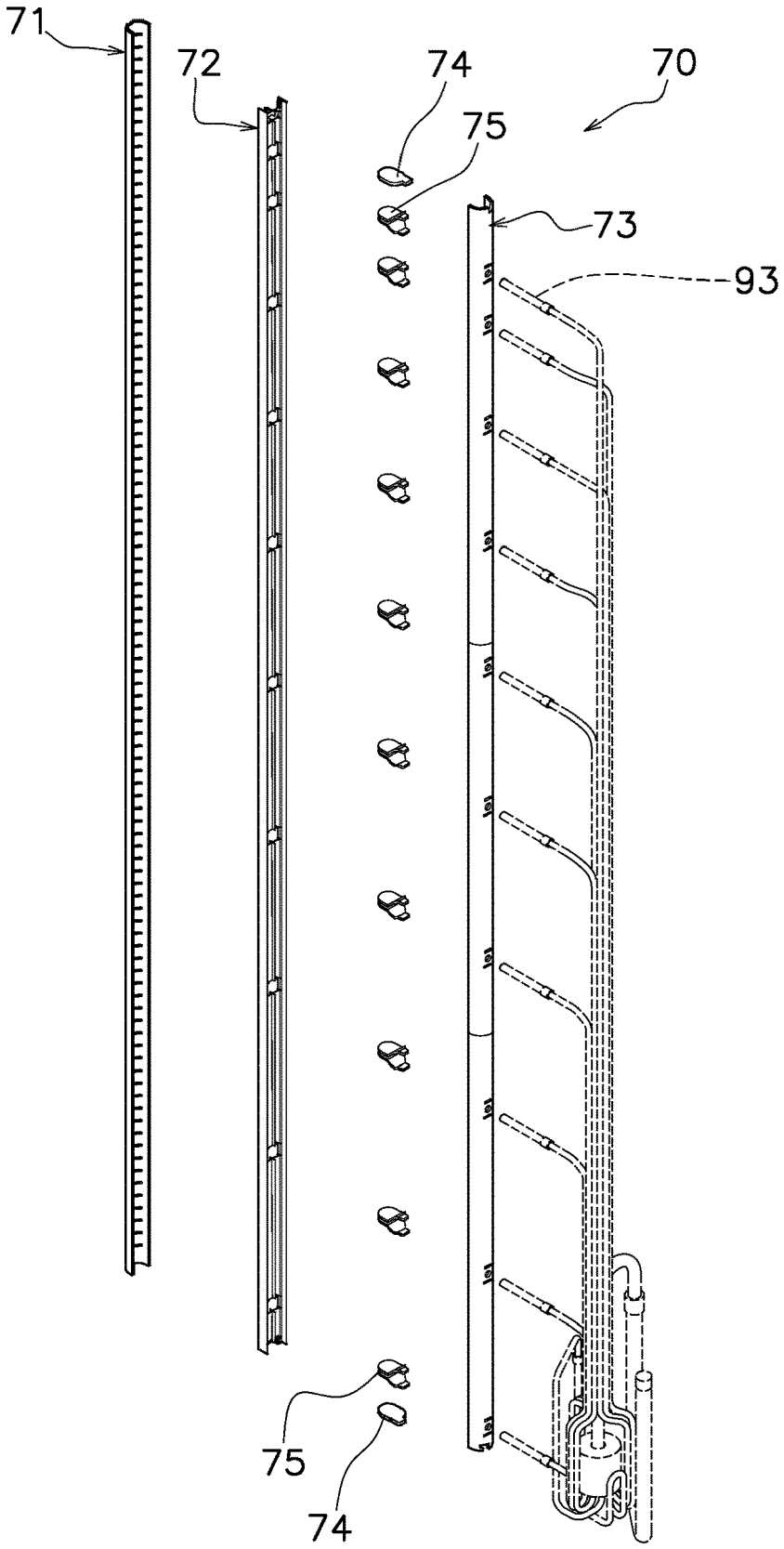
FIG. 12 is an exploded view of a second header pipe.
Figure 13:
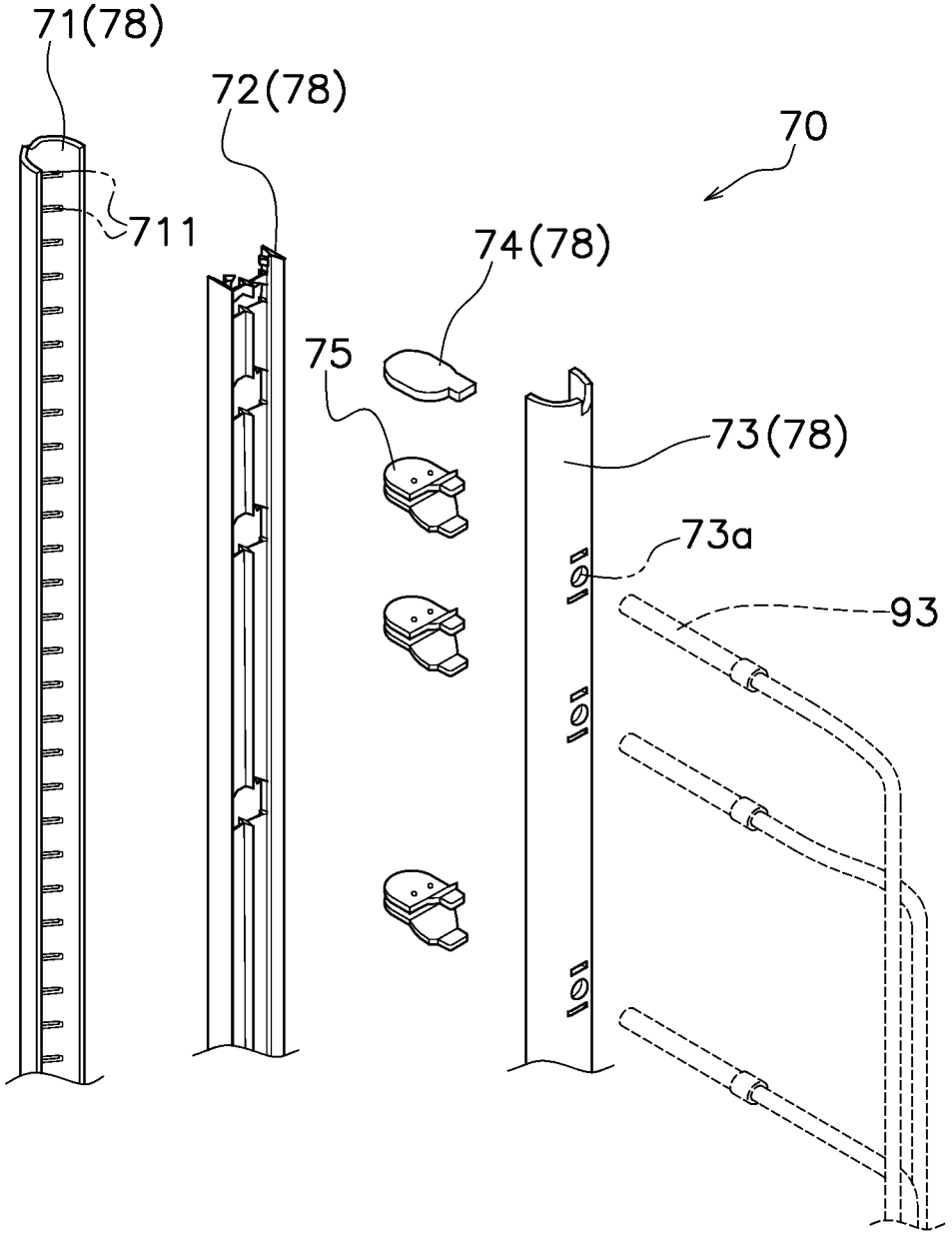
FIG. 13 is an enlarged view showing a part of the second header pipe shown in FIG. 12.
Figure 14:
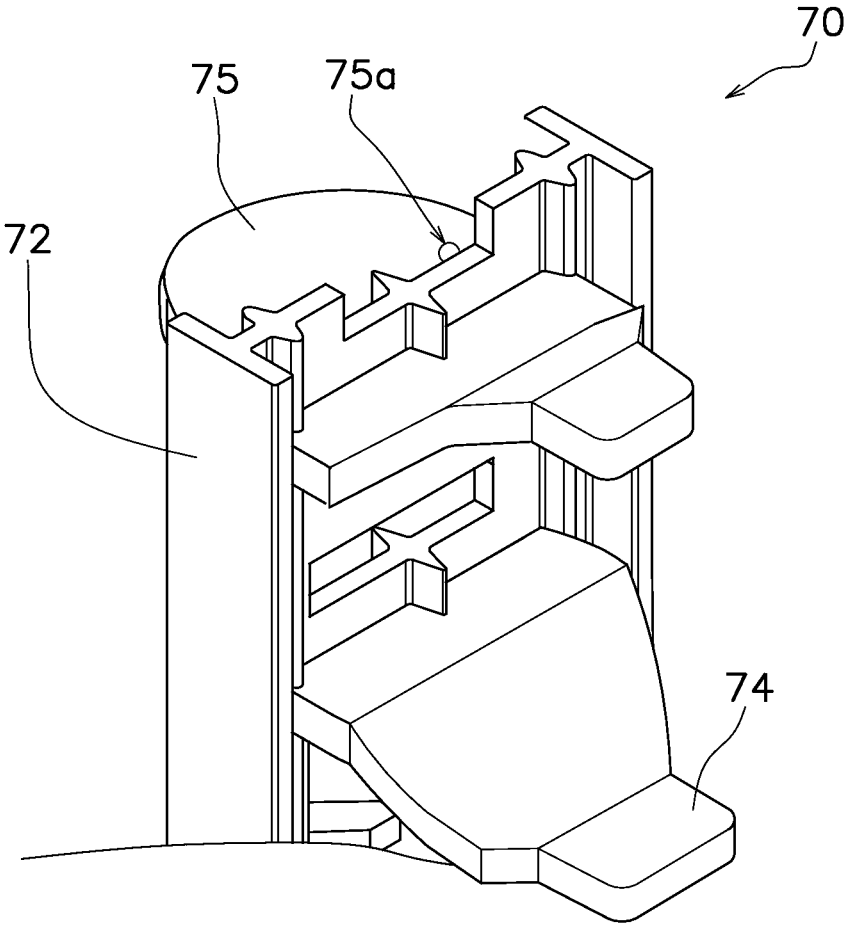
FIG. 14 is an enlarged view showing a part of a second partitioning member to which a partitioning plate and a rectifying plate are attached.
Figure 15:
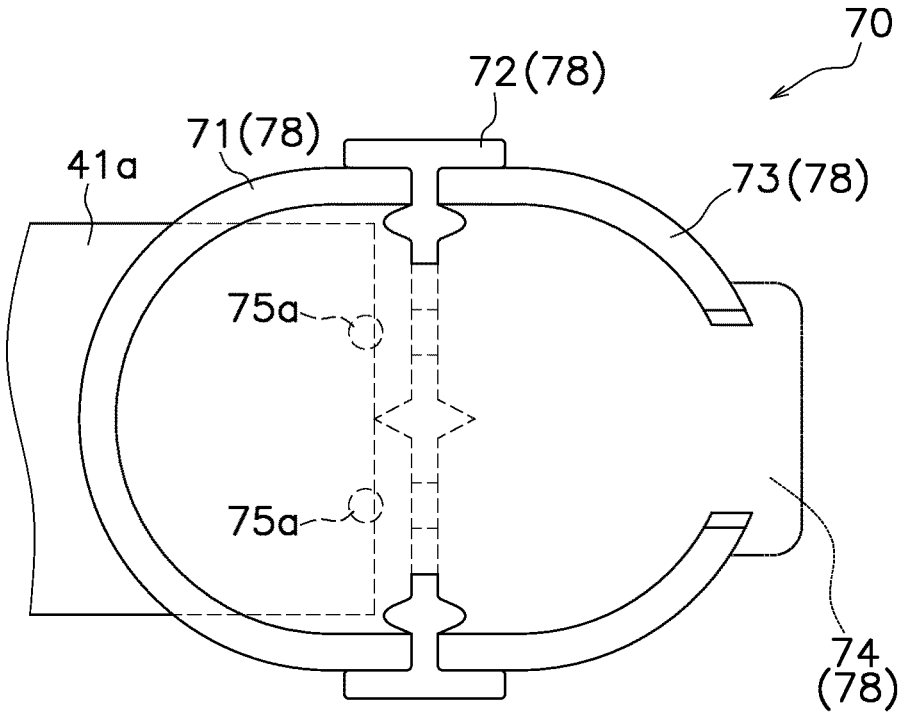
FIG. 15 is a view of the second header pipe viewed from above.
Figure 16:
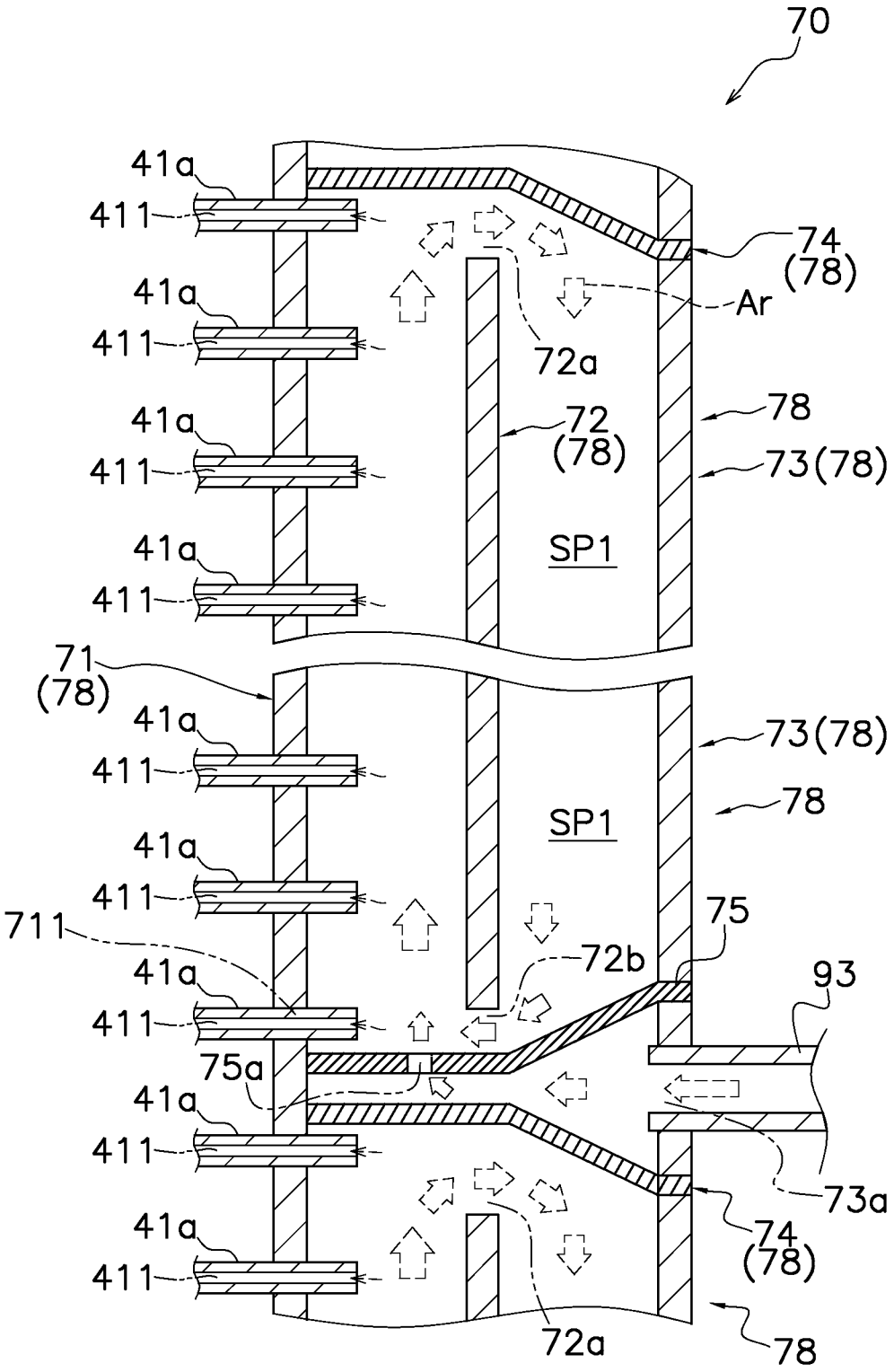
FIG. 16 is a schematic enlarged view of a cross section of a part of the second header pipe.

FIG. 12 is an exploded view of the second header pipe 70. FIG. 13 is a partial enlarged view of the second header pipe 70 shown in FIG. 12. FIG. 14 is a partial enlarged view of a second header partitioning member 72 to which a partitioning plate 74 and a rectifying plate 75 are attached. FIG. 15 is a view of the second header pipe 70 viewed from above. FIG. 16 is a schematic enlarged view of a cross section of a part of the second header pipe 70.

The second header pipe 70 is a long, thin, hollow cylindrical member extending in the top-bottom direction and having closed upper and lower ends. The second header pipe 70 is disposed adjacent to the first end of the windward-side heat exchanging part 40*a*. The second header pipe 70 includes the windward heat transfer tube-side member 71, the second header partitioning member 72, the flow divider-side member 73, a plurality of partitioning plates 74, and a plurality of rectifying plates 75. The windward heat transfer tube-side member 71, the second header partitioning member 72, and the flow divider-side member 73 are integrated together by assembling the windward heat transfer tube-side member 71, the second header partitioning member 72, and the flow divider-side member 73 with the second header partitioning member 72 being sandwiched by the windward heat transfer tube-side member 71 and the flow divider-side member 73 and longitudinal directions of the windward heat transfer tube-side member 71, the second header partitioning member 72, and the flow divider-side member 73 coinciding with each other. The upper and lower ends of the second header pipe 70 are closed by two partitioning plates 74. The windward heat transfer tube-side member 71, the second header partitioning member 72, the flow divider-side member 73, the partitioning plates 74, and the rectifying plates 75 are integrated together by bonding them via brazing with a brazing filler metal in a furnace, for example.

The windward heat transfer tube-side member 71 has an arc-shaped cross section cut in a plane orthogonal to the top-bottom direction. The windward heat transfer tube-side member 71 has a plurality of windward heat transfer tube connecting openings 711 into which ends of the heat transfer tubes 41 (windward-side heat transfer tubes 41*a*) are inserted, respectively. The number of windward heat transfer tube connecting opening 711 is equal to the number of stages of the heat transfer tubes 41. In the flow divider-side member 73, the windward heat transfer tube connecting openings 711 are arranged vertically.

The second header partitioning member 72 is a plate-shaped member extending vertically. The second header partitioning member 72 has openings (see 72*a* and 72*b* in FIG. 16) which are aligned vertically and through which the refrigerant flows from the windward heat transfer tube-side member 71 toward the flow divider-side member 73.

The flow divider-side member 73 has an arc-shaped cross section cut in a plane orthogonal to in the top-bottom direction. In addition, the flow divider-side member 73 has a plurality of first thin tube connecting openings 73*a* (corresponding to "second connecting ports" in the claims) for connection with first ends of their corresponding first thin tubes 93. The number of first thin tube connecting openings 73*a* is equal to the number of first thin tubes 93. In the flow divider-side member 73, the first thin tube connecting openings 73*a* are aligned vertically.

Figure 31:
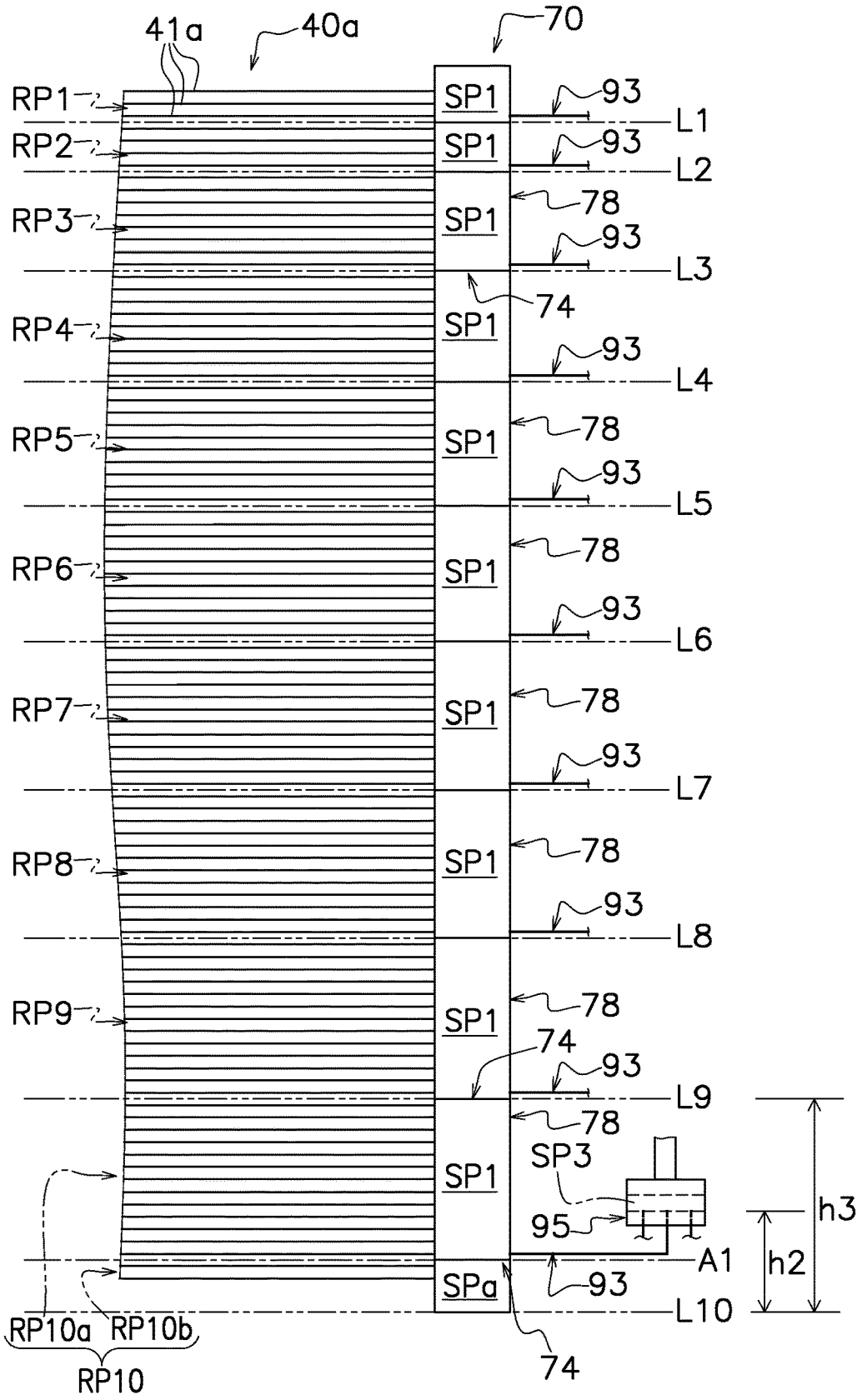
FIG. 31 is a schematic view of paths of the outdoor heat exchanger viewed from a windward side.

The internal space of the second header pipe 70 is partitioned by the plurality of partitioning plates 74, so as to be divided into a plurality of spaces (10 second header internal spaces SP1 and one second header sub space SPa) (see FIG. 31).

As illustrated in FIG. 16, each second header internal space SP1, which is formed between corresponding two of the partitioning plates 74 in the second header pipe 70, communicates with ends of corresponding ones of the plurality of heat transfer tubes 41 (windward-side heat transfer tubes 41*a*). Each second header internal space SP1 communicates with an end of a corresponding one of the first thin tubes 93. In each second header internal space SP1, a corresponding one of the rectifying plates 75 is positioned above and close to the corresponding one of the first thin tubes 93.

The second header sub space SPa is positioned close to the lower end of the second header pipe 70 and below the second header internal spaces SP1 (see FIG. 31). The second header sub space SPa communicates with ends of corresponding ones of the heat transfer tubes 41 (two windward-side heat transfer tubes 41*a* in the drawing).

In each second header internal space SP1, the second header partitioning member 72 has a first communication opening 72*a* at a location close to a lower end of an upper one of the corresponding two of the partitioning plates 74 and a second communication opening 72*b* at a location close to an upper end of the corresponding one of the rectifying plates 75. Each rectifying plate 75 has a third communication opening 75*a*.

Each second header internal space SP1 causes the refrigerant from one of a corresponding one of the heat transfer tubes 41 and a corresponding one of the first thin tubes 93 to flow into the other. Specifically, during reverse cycle operation, the refrigerant enters the second header internal space SP1 through the first thin tube 93, and then flows upward through the third communication opening 75*a*, which is small. The refrigerant having flowed upward is diverged to enter the flow paths 411 of the plurality of heat transfer tubes 41 (41*a*) disposed between the rectifying plate 75 and the upper partitioning plate 74. Part of the refrigerant having flowed upward generates a loop-like flow (see the broken-line arrow Ar in FIG. 16) passing through the first communication opening 72*a* and then through the second communication opening 72*b*. Then, the loop-like flow of the refrigerant is diverged to enter the flow paths 411 of the plurality of heat transfer tubes 41. Meanwhile, during forward cycle operation, the refrigerant enters the second header internal space SP1 from the heat transfer tubes 41, and then enters the first thin tube 93 through the third communication opening 75*a* and the like.

In one or more embodiments, the second header pipe 70 has 10 second header internal spaces SP1. In the second header pipe 70, each second header internal space SP1 is surrounded by a part of the windward heat transfer tube-side member 71, a part of the second header partitioning member 72, a part of the flow divider-side member 73, and a pair of partitioning plates 74. Thus, a part of the windward heat transfer tube-side member 71, the second header partitioning member 72, a part of the flow divider-side member 73, and a pair of partitioning plates 74 defining one second header internal space SP1 can be collectively deemed as a second header internal space creating member 78 (corresponding to a "second flow divider" in the claims; namely, each of the "second flow dividers" is bound by the pair of partitioning plates 74). According to this interpretation, the second header pipe 70 may be deemed as being constituted by collection of the second header internal space creating members 78 creating the second header internal spaces SP1. The plurality of second header internal space creating members 78 can be deemed as being arranged vertically in the installation state (see FIG. 31).

According to this interpretation, the second header internal space creating members 78 are made of aluminum or an aluminum alloy. The second header internal space creating members 78 internally include the second header internal spaces SP1, respectively. The second header internal space creating members 78 provide refrigerant flow paths at a location between the windward-side heat exchanging part 40*a* and the flow divider 90. In addition, the second header internal space creating members 78 each have a first thin tube connecting opening 73*a* for connection with a first end of its corresponding first thin tubes 93. The second header internal space creating members 78 each have windward heat transfer tube connecting openings 711 for connection with first ends of their corresponding heat transfer tubes 41. As illustrated in FIG. 16, each second header internal space SP1 according to one or more embodiments is configured such that a height position of the first thin tube connecting opening 73*a* in the installation state is equal to or lower than a height position of a lowermost one of the windward heat transfer tube connecting openings 711 (openings into which the windward-side heat transfer tubes 41*a* are inserted).

(4-4) Turnaround Header 80

Figure 17:
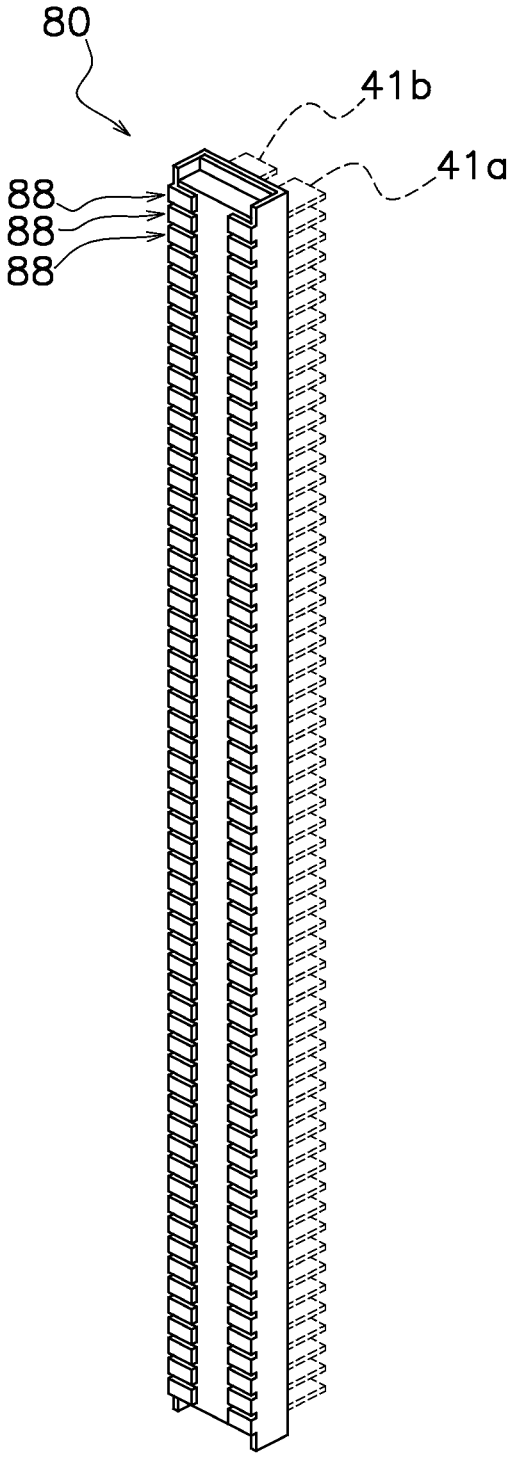
FIG. 17 is a perspective view of a turnaround header.
Figure 18:
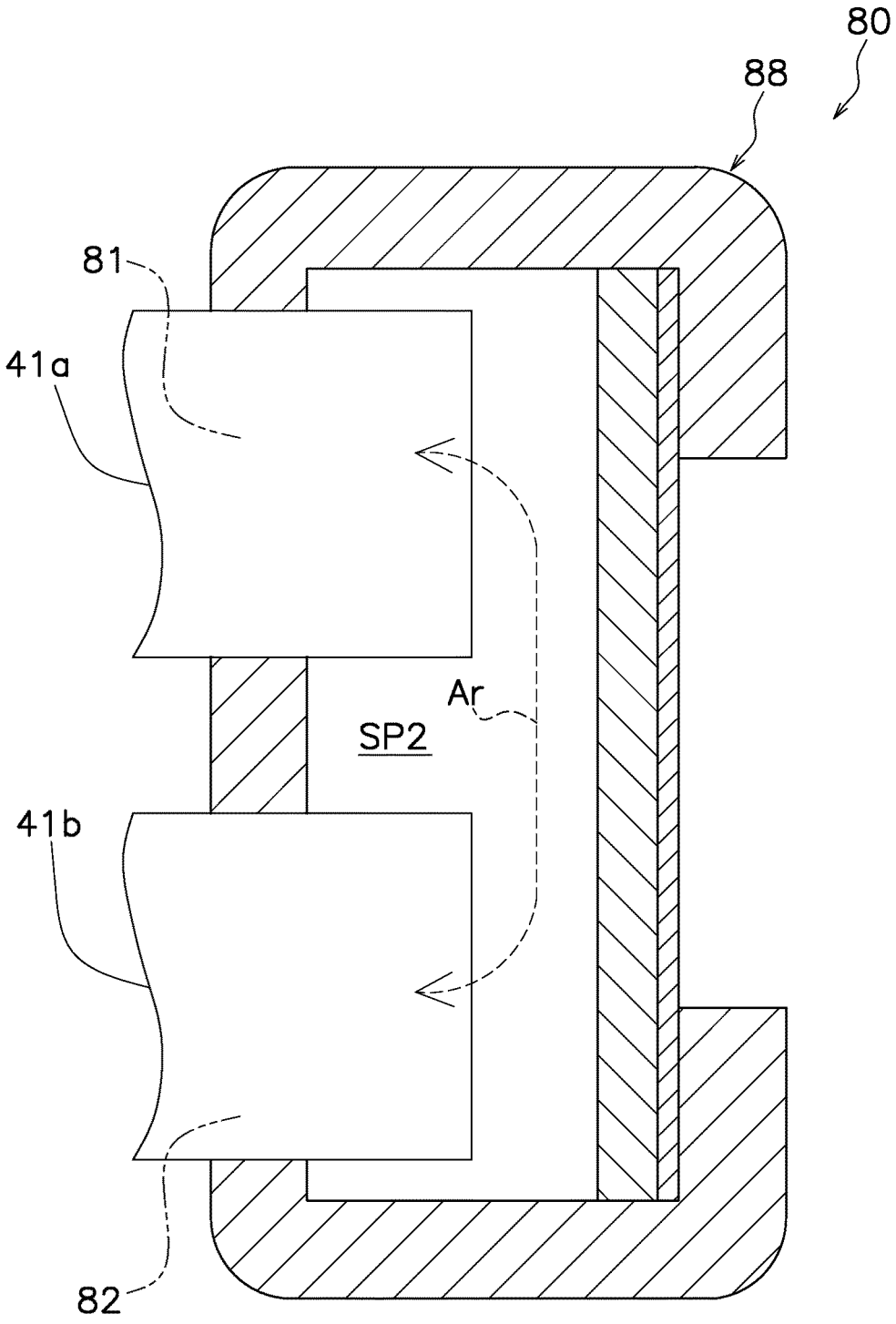
FIG. 18 is a horizontal cross-sectional view of the turnaround header.
Figure 19:
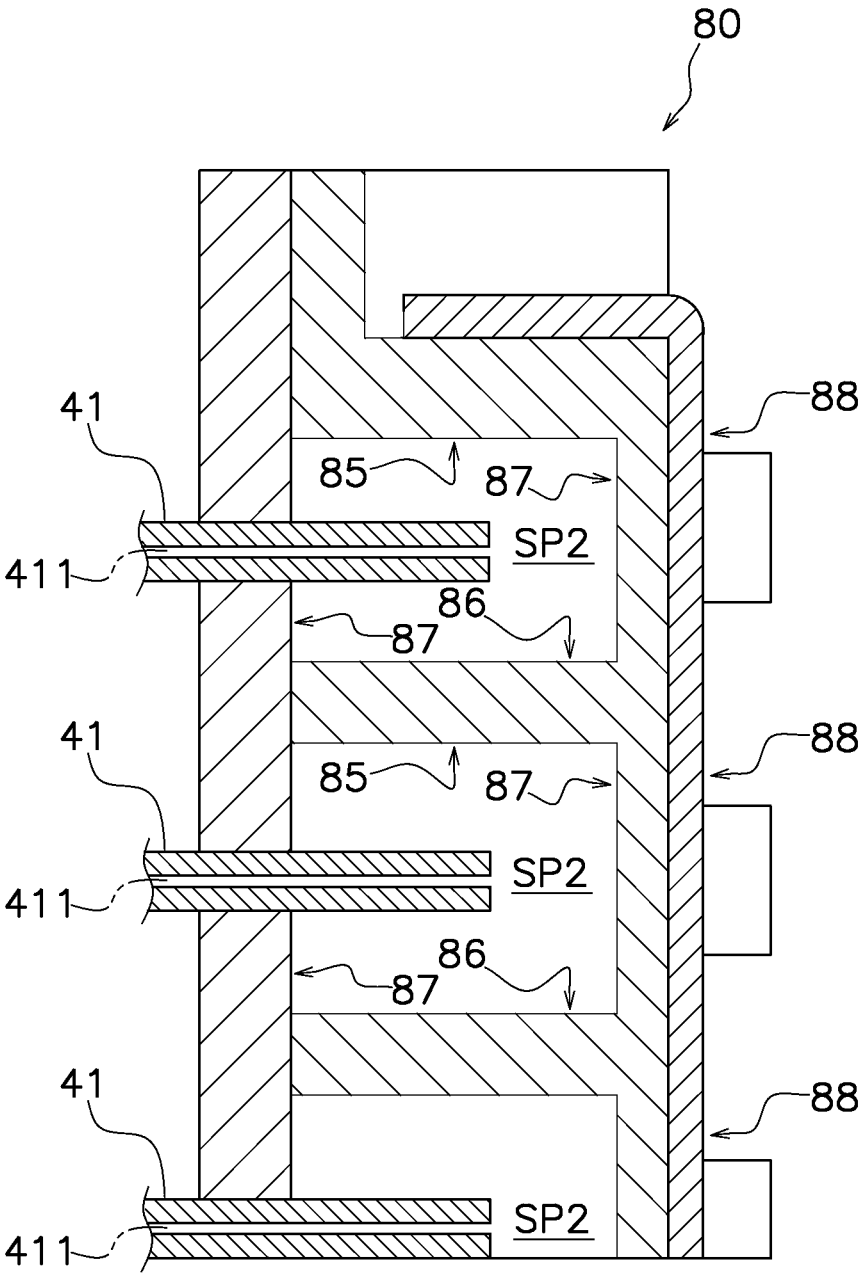
FIG. 19 is an enlarged vertical cross-sectional view of a part of the turnaround header.

FIG. 17 is a perspective view of the turnaround header 80. FIG. 18 is a horizontal cross-sectional view of the turnaround header 80. FIG. 19 is an enlarged vertical cross-sectional view of a part of the turnaround header 80.

The turnaround header 80 is a long, thin, hollow cylindrical member extending in the top-bottom direction and having closed upper and lower ends. The turnaround header 80 is disposed adjacent to the second ends of the windward-side heat exchanging parts 40*a* and the downwind-side heat exchanging parts 40*b*.

The turnaround header 80 has a plurality of windward-side openings 81 (whose number is equal to the number of windward-side heat transfer tubes 41*a*) into which the second ends of the windward-side heat transfer tubes 41*a* are inserted. The turnaround header 80 has a plurality of downwind-side openings 82 (whose number is equal to the number of downwind-side heat transfer tubes 41*b*) into which the second ends of the downwind-side heat transfer tubes 41*b* are inserted. The windward-side openings 81 and the downwind-side openings 82 are adjacent to each other in a direction in which the windward-side heat exchanging parts 40*a* and the downwind-side heat exchanging parts 40*b* are adjacent to each other. In the turnaround header 80, the plurality of windward-side openings 81 and the plurality of downwind-side openings 82 are arranged in the top-bottom direction.

The turnaround header 80 internally includes a plurality of turnaround spaces SP2 each of which causes the refrigerant from one of its corresponding adjacent paired windward-side heat transfer tube 41*a* and downwind-side heat transfer tube 41*b* to flow into the other. In the turnaround space SP2, the refrigerant having passed through one of the windward-side heat transfer tube 41*a* and the downwind-side heat transfer tube 41*b* makes a turn toward the other (see the broken-line arrow Ar in FIG. 18). More specifically, during forward cycle operation (in a case where the gas-side collecting pipe 60 serves as the inlet pipe for the refrigerant), the turnaround space SP2 functions as a space that causes the refrigerant exiting from the end of the downwind-side heat transfer tube 41*b* to flow into the windward-side heat transfer tube 41*a*. More specifically, during reverse cycle operation (in a case where the gas-side collecting pipe 60 serves as the outlet pipe for the refrigerant), the turnaround space SP2 functions as a space that causes the refrigerant exiting from the end of the windward-side heat transfer tube 41*a* to flow into the downwind-side heat transfer tube 41*b*.

Each turnaround space SP2 includes a pair of windward-side opening 81 and downwind-side opening 82. That is, in each turnaround space SP2, the windward-side heat transfer tubes 41*a* and the downwind-side heat transfer tubes 41*b* communicate with each other, respectively. In one or more embodiments, paired windward-side heat transfer tube 41*a* and downwind-side heat transfer tube 41*b* disposed in the same stage communicate with each other in a corresponding one of the turnaround spaces SP2. The number of turnaround spaces SP2 in the turnaround header 80 is equal to the number of pairs of windward-side openings 81 and downwind-side openings 82.

The turnaround spaces SP2 are created by a plurality of top parts 85, a plurality of bottom parts 86, and a plurality of side parts 87 disposed in the turnaround header 80 (see FIG. 19). That is, a top part 85, a bottom part 86, and a side part 87 creating one turnaround space SP2 can be collectively deemed as a turnaround space creating member 88. According to this interpretation, the turnaround header 80 can be deemed as being constituted by collection of the turnaround space creating members 88 creating the turnaround spaces SP2. The plurality of turnaround space creating members 88 can be deemed as being arranged vertically (in the installation state).

According to this interpretation, the turnaround space creating members 88 internally include the turnaround spaces SP2, respectively. In addition, the turnaround space creating members 88 provide refrigerant flow paths between the gas-side inlet/outlet port (the gas-side collecting pipe 60 in the drawing) for the refrigerant of the outdoor heat exchanger 15 and the second header internal spaces SP1 (the second header internal space creating members 78).

(4-5) Flow Divider 90 (Corresponding to "First Flow Divider" in Claims)

Figure 20:
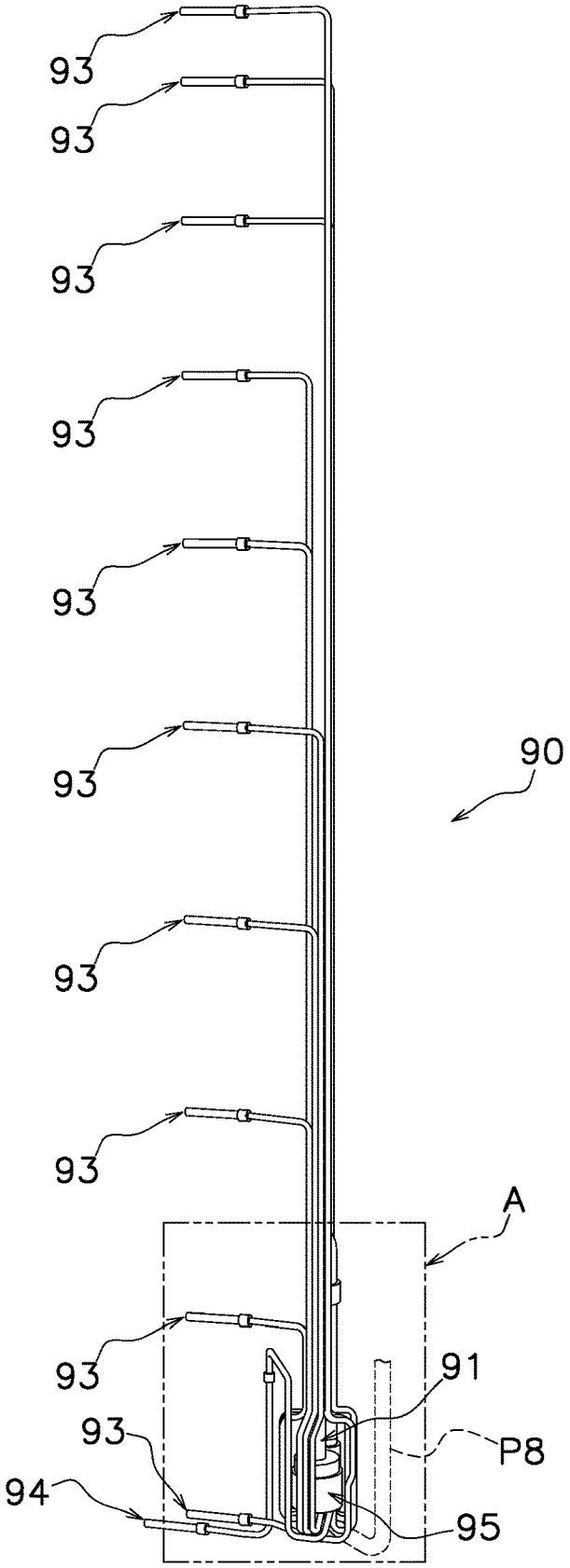
FIG. 20 is a perspective view of a flow divider.
Figure 21:
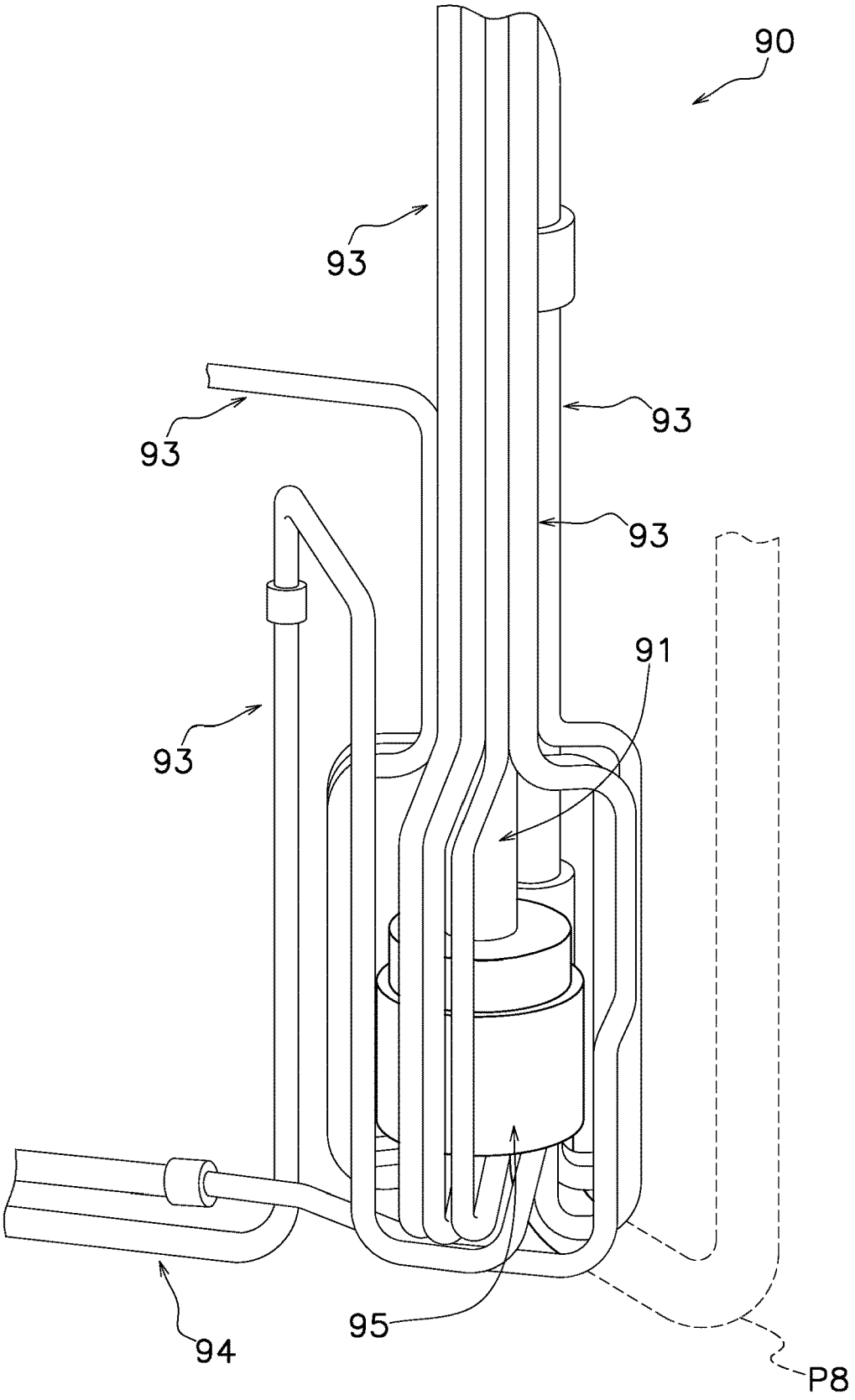
FIG. 21 is an enlarged view of segment A, which is surrounded by a chain double-dashed line in FIG. 20.

FIG. 20 is a perspective view of the flow divider 90. FIG. 21 is an enlarged view of segment A, which is surrounded by the chain double-dashed line in FIG. 20.

In the outdoor heat exchanger 15, the flow divider 90 is disposed at the liquid-side inlet/outlet port (namely, between the second header pipe 70 and the eighth pipe P8). The flow divider 90 causes the refrigerant from one of the second header pipe 70 and the eighth pipe P8 to flow into the other. Specifically, during reverse cycle operation, the flow divider 90 functions as a mechanism that divides the refrigerant from the eighth pipe P8 and sends the divided streams of the refrigerant to the plurality of second header internal spaces SP1. Meanwhile, during forward cycle operation, the flow divider 90 functions as a mechanism that collects the streams of the refrigerant from the second header internal spaces SP1 and sends the collected refrigerant to the eighth pipe P8. In the refrigerant circuit RC, the flow divider 90 is located primarily between the second header pipe 70 and the eighth pipe P8.

The flow divider 90 primarily includes the inflow/outflow pipe 91, a plurality of (10 in the drawing) first thin tubes 93 extending to the second header pipe 70, a second thin tube 94 extending to the first header pipe 50, and a flow divider main body 95. The inflow/outflow pipe 91, the first thin tubes 93, the second thin tube 94, and the flow divider main body 95 are made of aluminum or an aluminum alloy. The flow divider 90 is made by bonding via brazing. Specifically, the inflow/outflow pipe 91, the first thin tubes 93, the second thin tube 94, and the flow divider main body 95 that are temporarily assembled are brazed with a brazing filler metal in a furnace.

Figure 22:
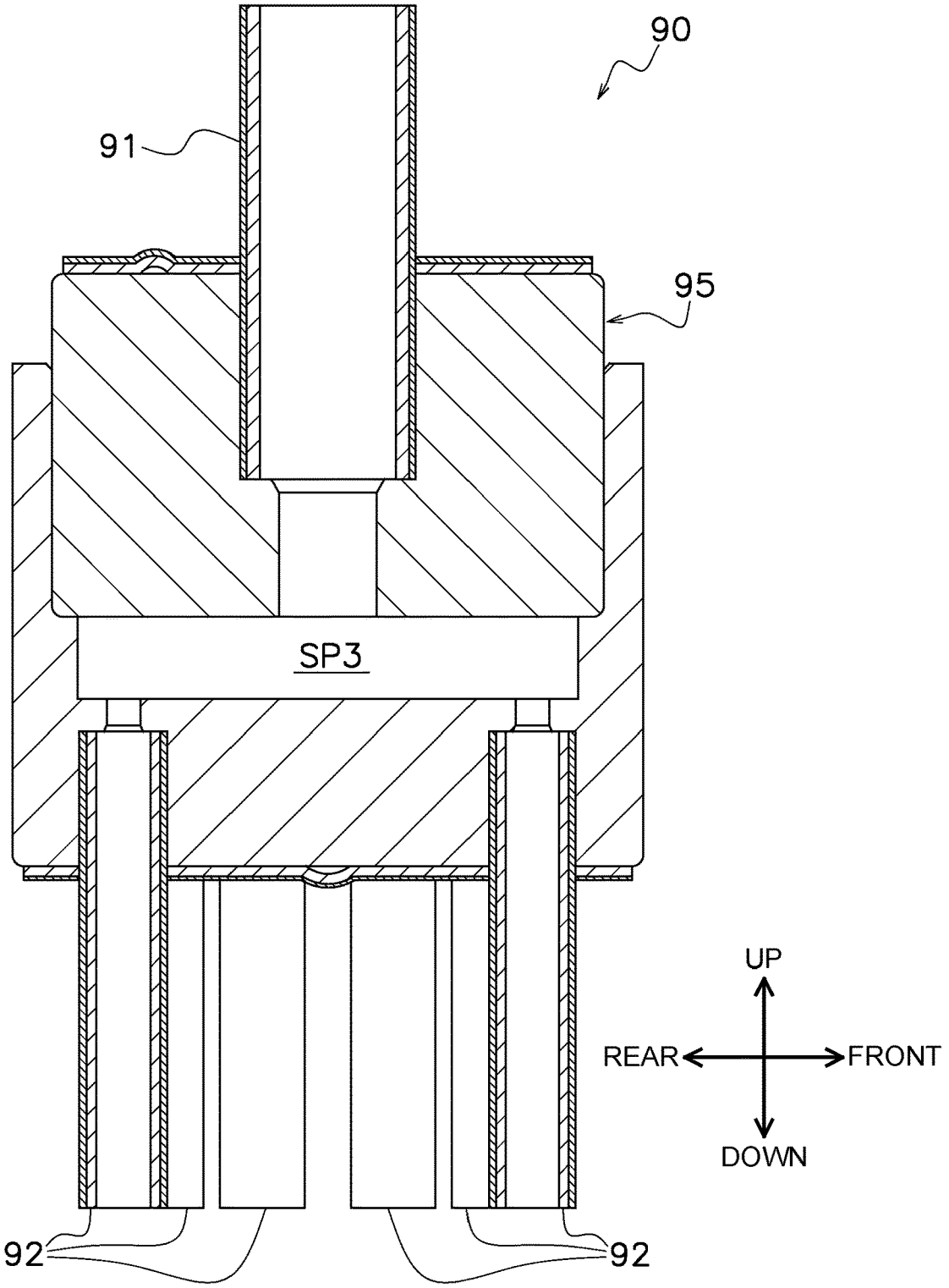
FIG. 22 is an enlarged schematic view of a vertical cross section of a flow divider main body.
Figure 23:
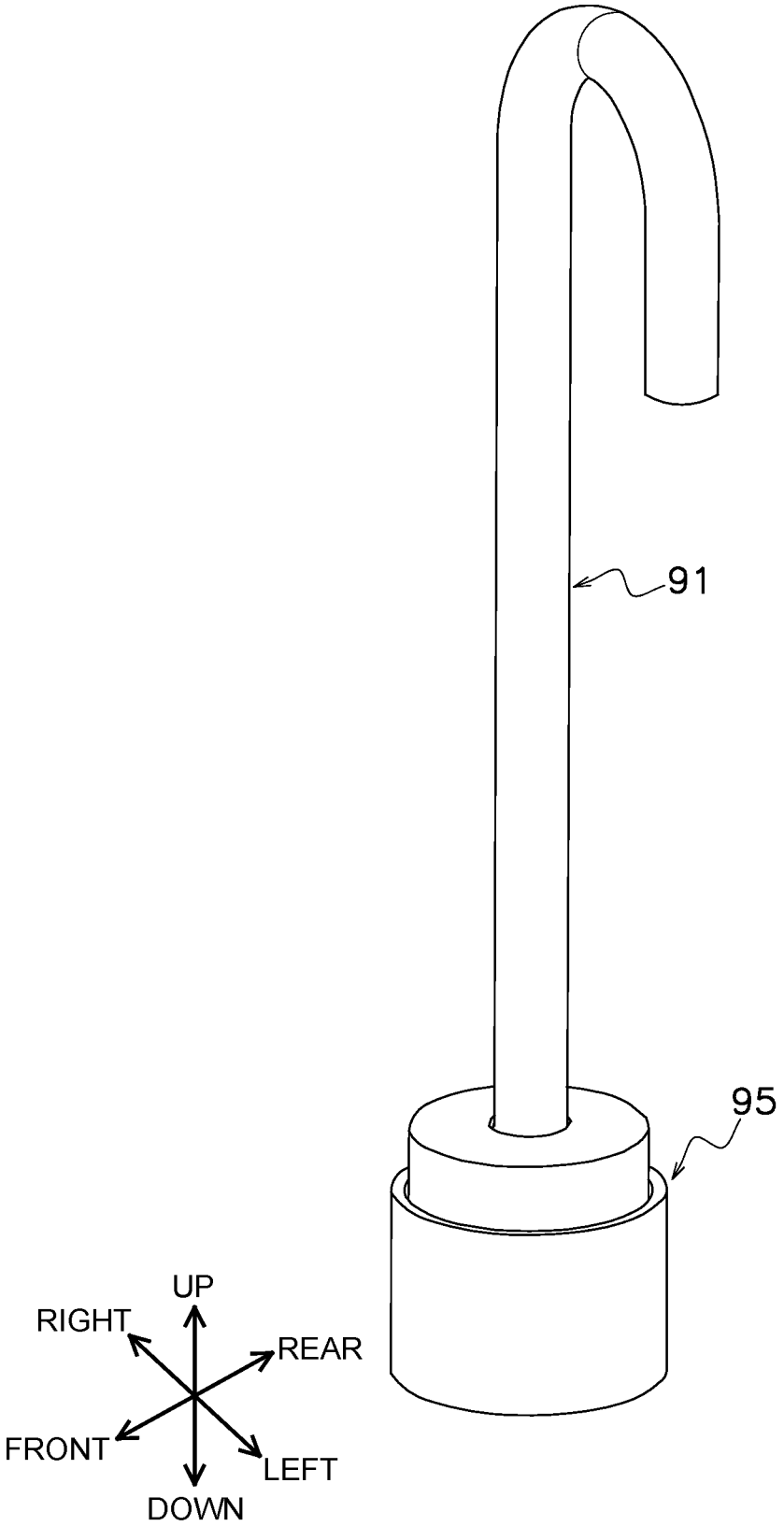
FIG. 23 is a perspective view of the flow divider main body and an inflow/outflow pipe on a liquid side.

FIG. 22 is an enlarged schematic view of a vertical cross section of the flow divider main body 95. FIG. 23 is a perspective view of the flow divider main body 95 and the inflow/outflow pipe 91.

The inflow/outflow pipe 91 (corresponding to a "first pipe" in the claims) is a cylindrical pipe having first and second ends that are opened. The first end of the inflow/outflow pipe 91 is connected to the flow divider main body 95, and the second end of the inflow/outflow pipe 91 is connected to the eighth pipe P8. The inflow/outflow pipe 91 is a pipe where the refrigerant that is to pass through the outdoor heat exchanger 15 enters and exits. The inflow/outflow pipe 91 serves as the liquid-side inlet/outlet port of the outdoor heat exchanger 15. Particularly, the inflow/outflow pipe 91 provides a flow path for causing the refrigerant from one of the flow divider main body 95 and the eighth pipe P8 to flow into the other. In the refrigerant circuit RC, the inflow/outflow pipe 91 is located between the flow divider main body 95 and the eighth pipe P8. The inflow/outflow pipe 91 is curved at a location between the first end and the second end thereof, so as to have a substantial J-shape or a substantial U-shape (see FIG. 23).

Each first thin tube 93 (corresponding to a "second pipe" in the claims) is a cylindrical pipe having first and second ends that are opened. Each first thin tube 93 is smaller in diameter than the inflow/outflow pipe 91. The first thin tubes 93 have first ends connected to the flow divider main body 95. The first thin tubes 93 are respectively provided for the second header internal spaces SP1 (second header internal space creating members 78) in a one-to-one relation. Each of the first thin tubes 93 has a second end connected to a first thin tube connecting opening 73*a* of a corresponding one of the second header internal spaces SP1. The first thin tubes 93 provide flow paths for causing the refrigerant from one of the flow divider main body 95 and the second header internal spaces SP1 to flow into the other. In the refrigerant circuit RC, the first thin tubes 93 are located between the flow divider main body 95 and their corresponding second header internal spaces SP1. That is, the first thin tubes 93 provide refrigerant flow paths at a location closer to the windward-side heat exchanging part 40*a* than is the inflow/outflow pipe 91.

The second thin tube 94 is a cylindrical pipe having first and second ends that are opened. The second thin tube 94 is smaller in diameter than the inflow/outflow pipe 91. The first end of the second thin tube 94 is connected to the flow divider main body 95. The second end of the second thin tube 94 is connected to the second thin tube connecting opening 532 of the first header sub space S2. The second thin tube 94 provides a flow path for causing the refrigerant from one of the flow divider main body 95 and the first header sub space S2 to flow into the other. In the refrigerant circuit RC, the second thin tube 94 is located between the flow divider main body 95 and the first header sub space S2.

Figure 24:
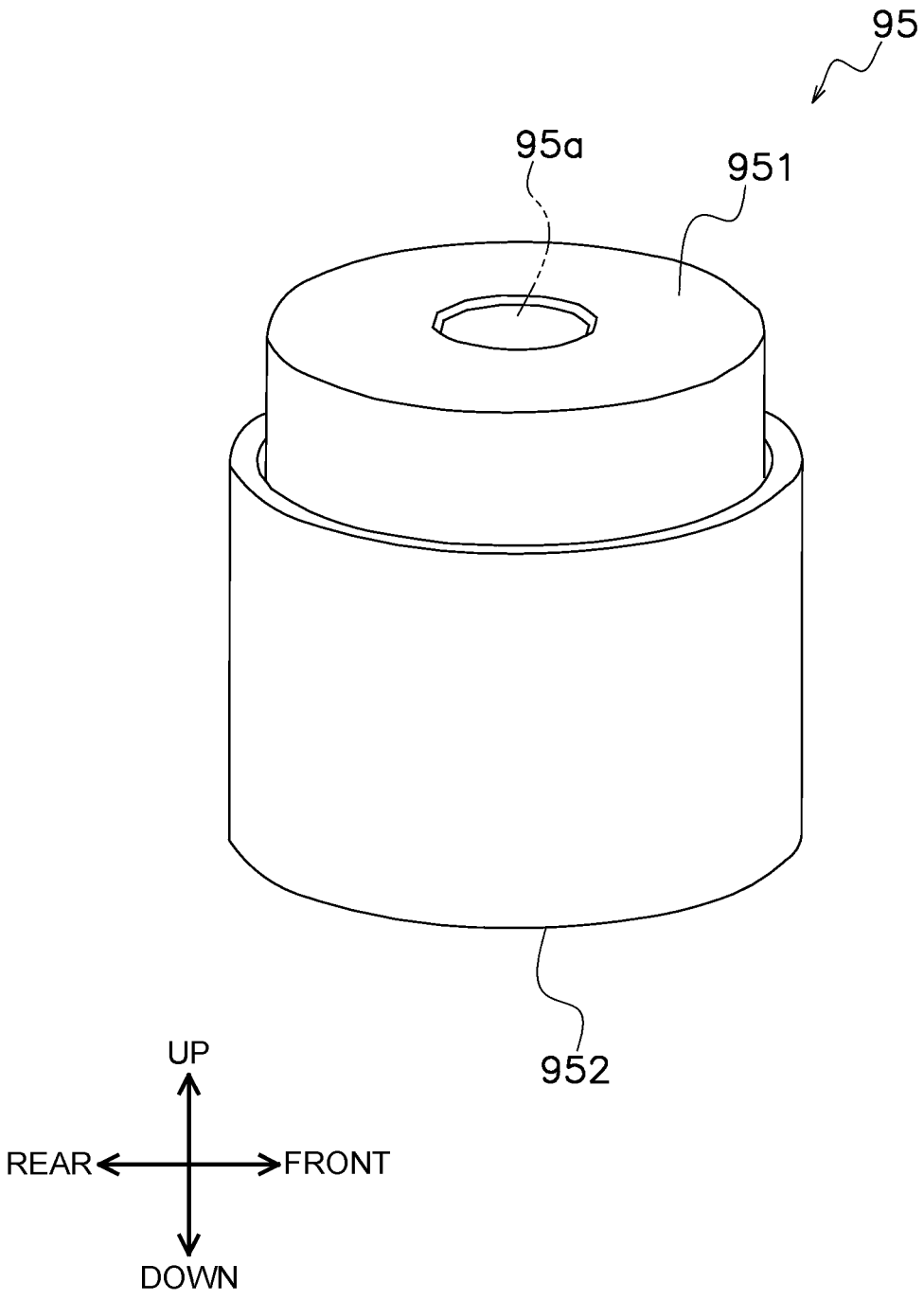
FIG. 24 is a perspective view of the flow divider main body.
Figure 25:
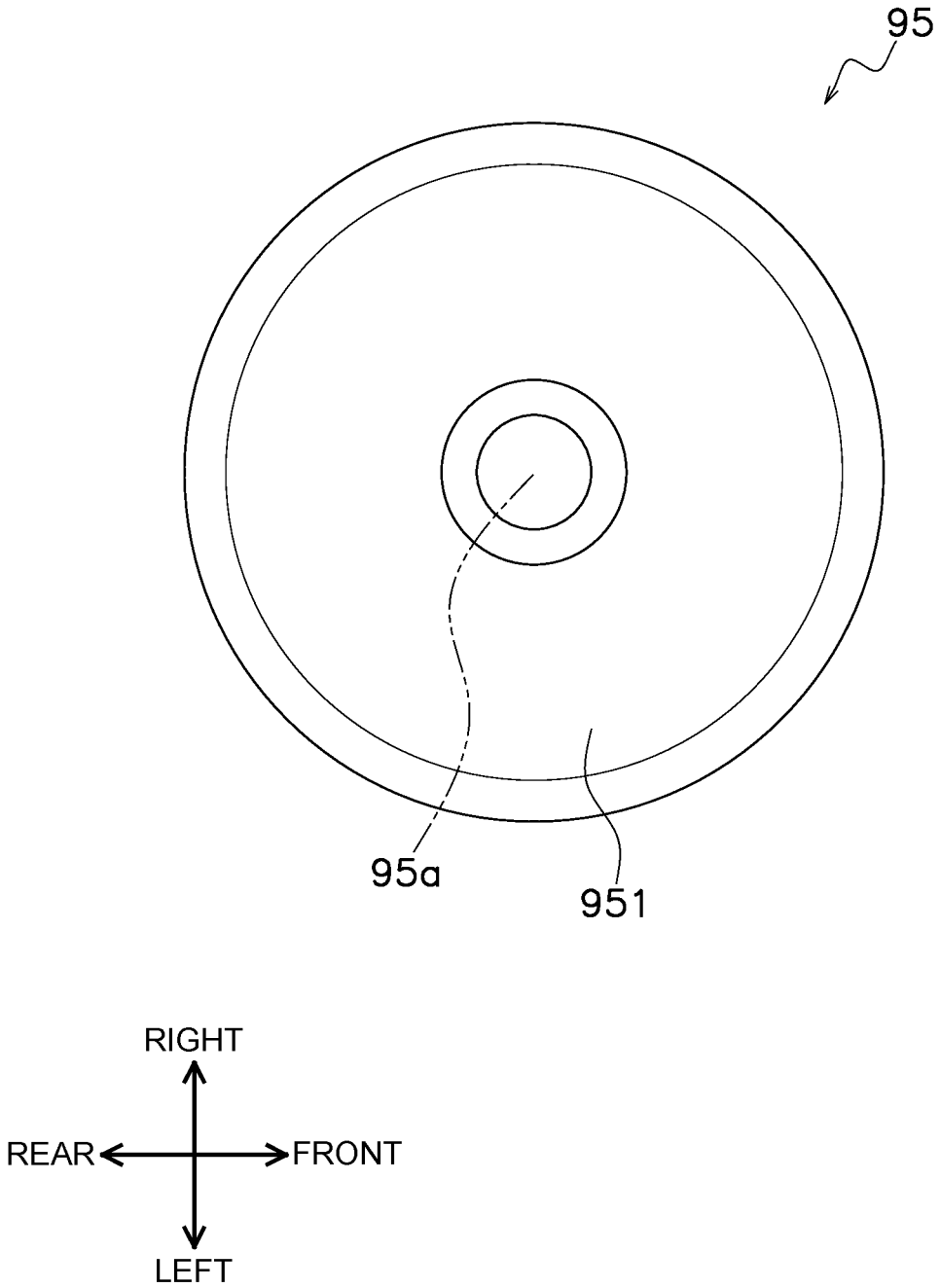
FIG. 25 shows the flow divider main body viewed from a top surface side.
Figure 26:
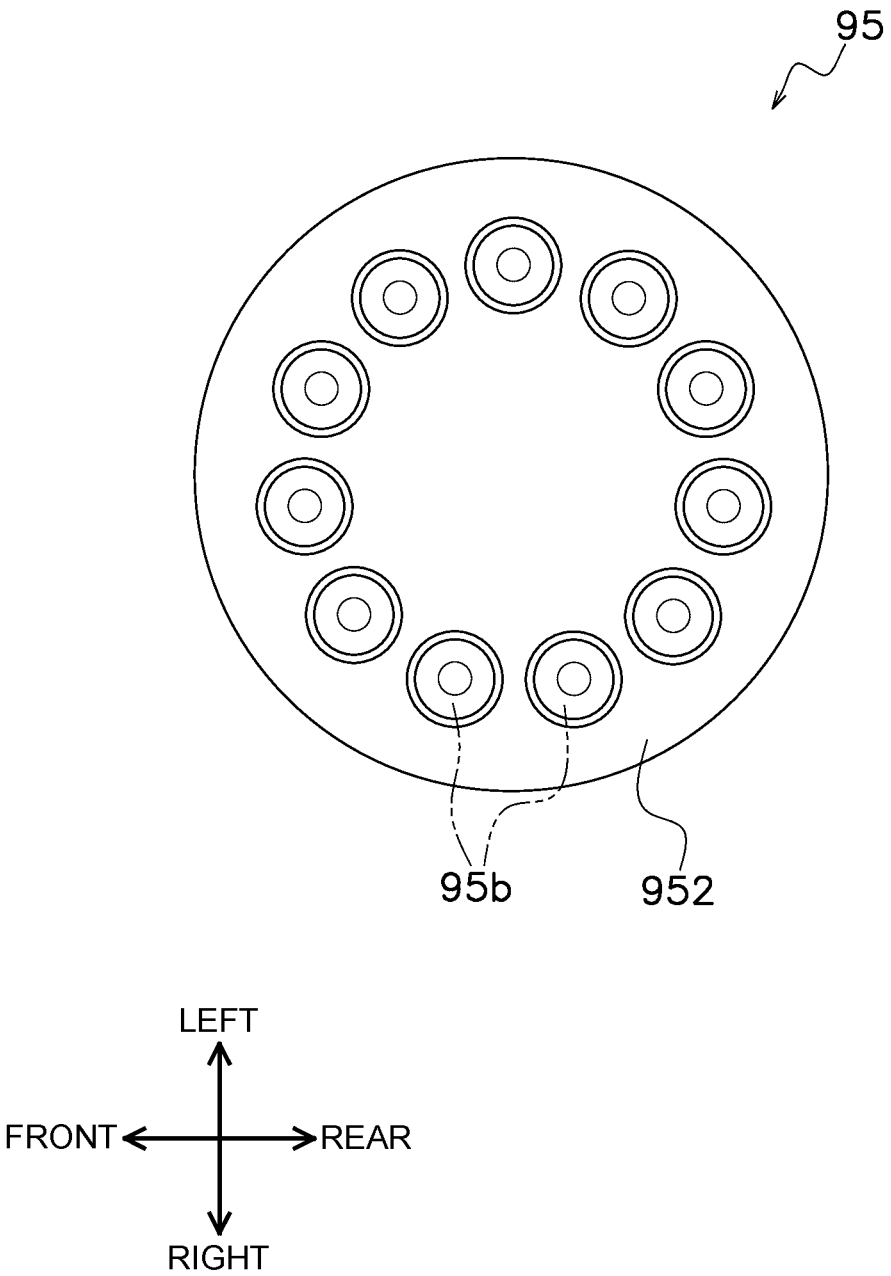
FIG. 26 shows the flow divider main body viewed from a bottom surface side.

FIG. 24 is a perspective view of the flow divider main body 95. FIG. 25 is a view of the flow divider main body 95 viewed from a top surface side. FIG. 26 is a view of the flow divider main body 95 viewed from a bottom surface side.

The flow divider main body 95 (corresponding to a "main body" in the claims) is a substantial cylindrical member internally including a main body internal space SP3. The main body internal space SP3 communicates with the first end of the inflow/outflow pipe 91 and the first end of the first thin tube 93. The main body internal space SP3 functions as a space that causes the refrigerant from the inflow/outflow pipe 91 to flow into the first thin tubes 93 (in a divided manner). The main body internal space SP3 also functions as a space that collects the flows of the refrigerant from the first thin tubes 93 and causes the collected refrigerant to flow into the inflow/outflow pipe 91.

The flow divider main body 95 has a top surface 951 facing upward and a bottom surface 952 facing downward in the installation state. The flow divider main body 95 has, in the top surface 951, a first opening 95*a* (corresponding to a "first insertion port" in the claims) through which the inflow/outflow pipe 91 is to be inserted. In one or more embodiments, the first opening 95*a* is positioned at a center portion of the top surface 951.

The flow divider main body 95 has, in the bottom surface 952, a plurality of (11 in the drawing) second openings 95*b* through which the first thin tubes 93 and/or the second thin tube 94 are to be inserted. The second openings 95*b* (corresponding to "second insertion ports" in the claims) are respectively provided for the first thin tubes 93 and second thin tube 94 in a one-to-one relation. Each of the second openings 95*b* receives a corresponding one of the thin tubes inserted thereto. In one or more embodiments, the second openings 95*b* are provided in the bottom surface 952 and are annularly arranged spaced from each other. The first opening 95*a* and the second openings 95*b* individually communicate with the main body internal space SP3 (see FIG. 22).

Figure 27:
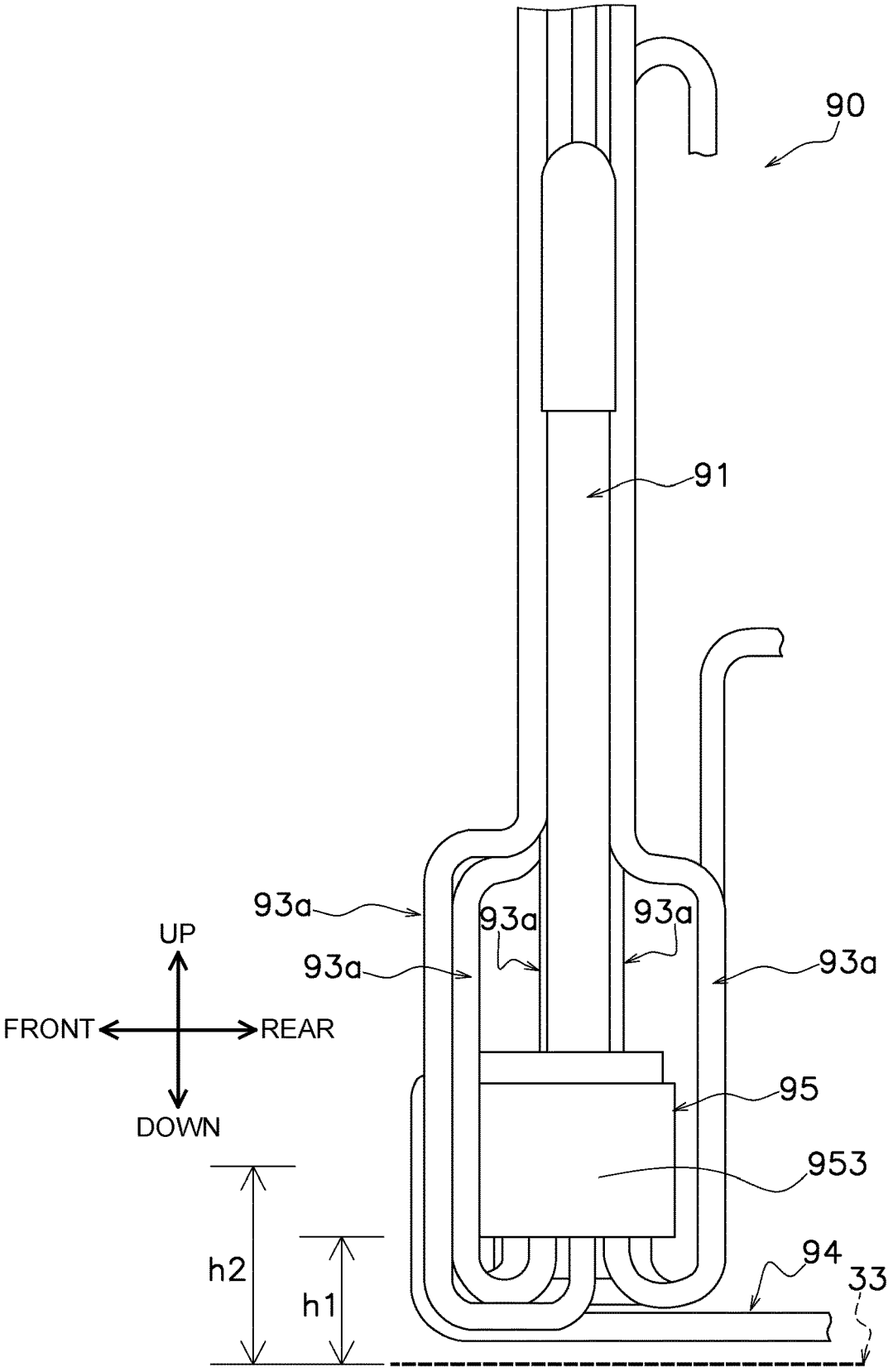
FIG. 27 is an enlarged view showing the surroundings of the flow divider main body, viewed in a horizontal direction.

In the installation state, the flow divider main body 95 is disposed such that a height position of a portion where the main body internal space SP3 and the first thin tube 93 communicate with each other is equal to or lower than a height position of an upper end of a lowermost one of the second header internal spaces SP1 (see FIGS. 27 and 31).

Figure 28:
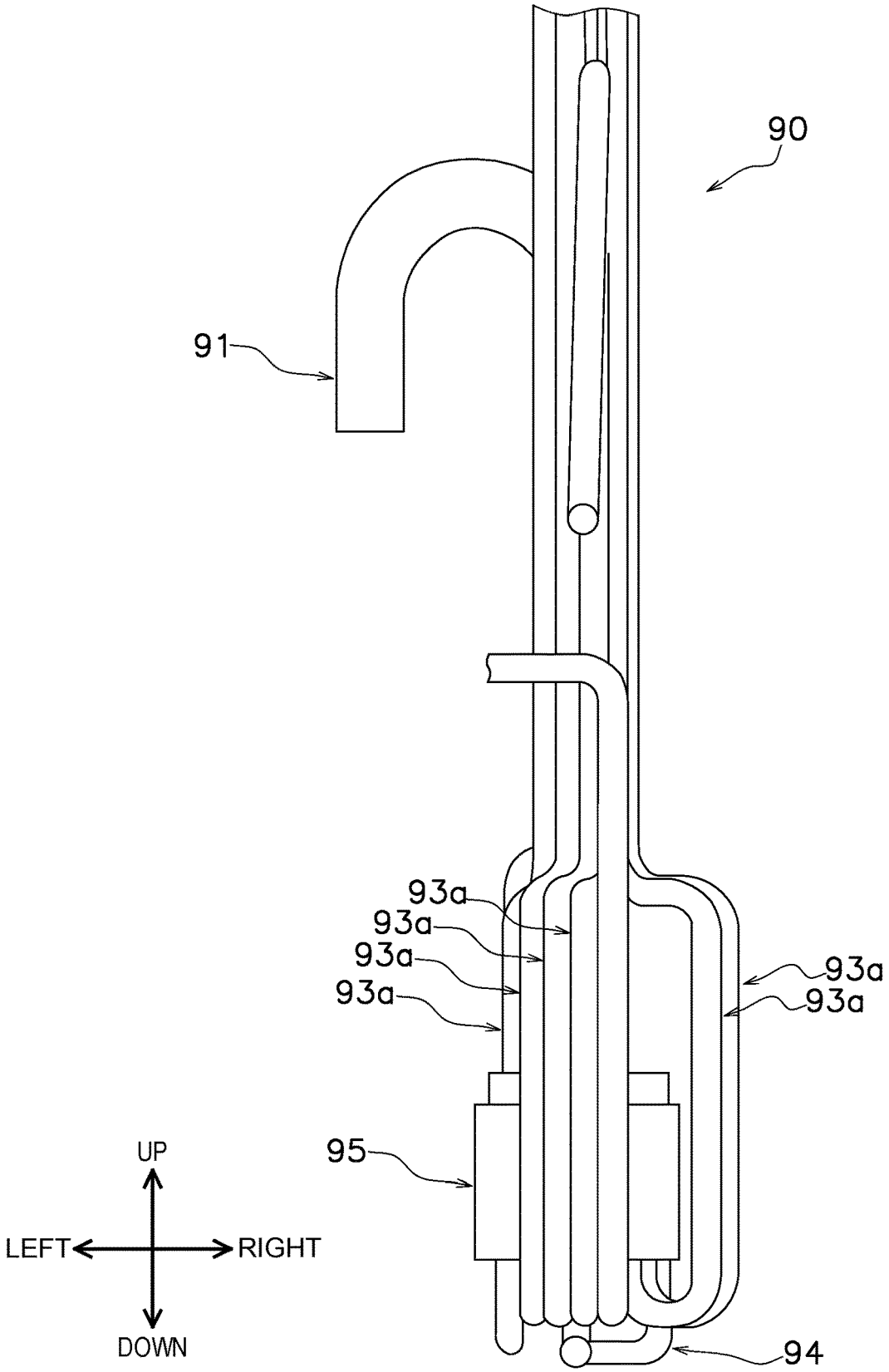
FIG. 28 is an enlarged view showing the state in FIG. 27, viewed in a different direction from FIG. 27.

FIG. 27 is an enlarged view showing the surroundings of the flow divider main body 95, viewed in the horizontal direction. FIG. 28 is an enlarged view showing the state in FIG. 27, viewed in a different direction from FIG. 27.

In the flow divider 90, the inflow/outflow pipe 91 extends upward from the top surface of the flow divider main body 95 (see FIG. 27). In other words, the inflow/outflow pipe 91 is connected to the flow divider main body 95 so as to extend upward from the main body internal space SP3 in the installation state (see FIG. 22).

In the flow divider 90, the first thin tubes 93 extend downward from the bottom surface of the flow divider main body 95 (see FIGS. 27 and 28). In other words, the first thin tubes 93 are connected to the flow divider main body 95 so as to extend downward from the main body internal space SP3 in the installation state. Specifically, the first thin tubes 93 have portions extending downward from the main body internal space SP3, which are followed by portions curved to extend upward toward their corresponding second header internal spaces SP1. More specifically, in one or more embodiments, a half or more of the first thin tubes 93 (nine first thin tubes 93 in the drawing) are upwardly curving tubes 93*a* (see FIGS. 27 and 28). The upwardly curving tubes 93*a* have portions extending downward from the main body internal space SP3, which are followed by portions being curved while protruding downward to change their extending directions upward, which are further followed by portions extending upward while being adjacent to but spaced from the flow divider main body 95. That is, each upwardly curving tube 93*a* has at least two curved portions (a curved portion where the tube extending downward makes a turn to extend upward and a curved portion where the tube extending upward is curved toward the second header internal space SP1).

In addition, most of the upwardly curving tubes 93*a* (eight upwardly curving tubes 93*a* in the drawing) are curved toward the center of the flow divider main body 95 and extend upward while being adjacent to but spaced from the inflow/outflow pipe 91 (see FIGS. 27 and 28). That is, these upwardly curving tubes 93*a* each have an additional curved portion (a curved portion where the tube is curved toward the center of the flow divider main body 95).

In one or more embodiments, the upwardly curving tubes 93*a* are arranged spaced from each other in circumferential directions of the flow divider main body 95 and the inflow/outflow pipe 91 in a plan view in the installation state. In other words, the flow divider 90 can be deemed as being configured as below. That is, the flow divider main body 95 and the inflow/outflow pipe 91, which extends upward from the top surface, are surrounded by the plurality of first thin tubes 93 (upwardly curving tubes 93*a*) being connected to the bottom surface and being curved to extend upward.

Figure 29:
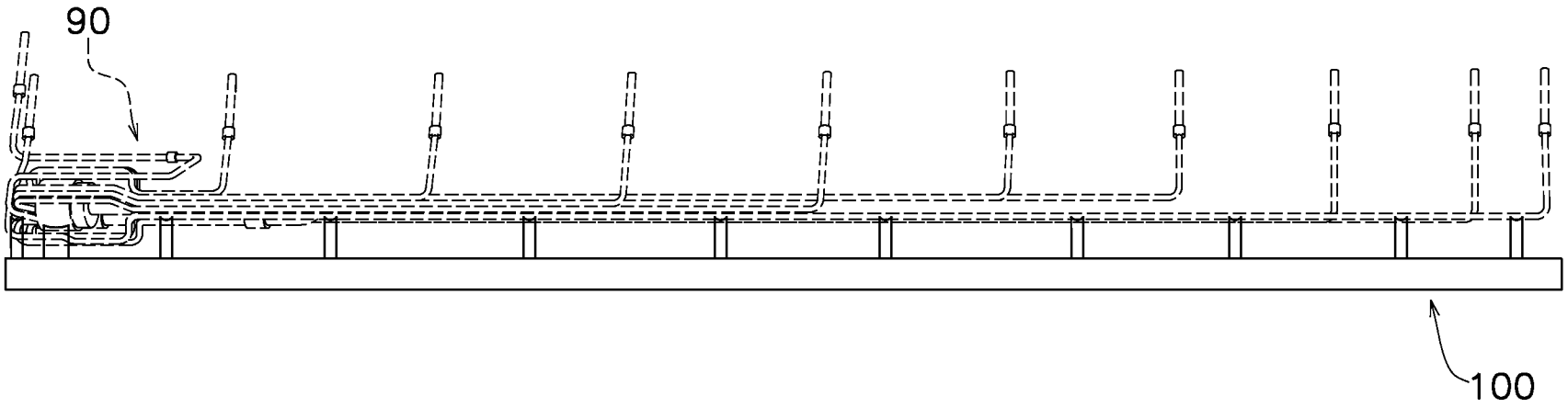
FIG. 29 is a schematic view showing one example of a jig used to transfer the flow divider main body into a furnace.

Note that the flow divider main body 95 has an outer surface portion that is not surrounded by the first thin tubes 93. The outer surface portion functions as an abutting portion 953 that comes into contact with a jig used to transfer the constituent elements of the flow divider 90 into a furnace for assembling of the flow divider 90. That is, the flow divider main body 95 is transferred into the furnace by being supported by a jig 100 (e.g., a jig illustrated in FIG. 29) with the inflow/outflow pipe 91, the plurality of first thin tubes 93, and the second thin tube 94 being inserted into the flow divider main body 95. Thus, the flow divider main body 95 needs to have a receiving surface that is to be supported by the jig 100. For this purpose, the flow divider main body 95 has a portion (i.e., a portion corresponding to the abutting portion 953) that is not adjacent to the first thin tubes 93. That is, the flow divider main body 95 has the abutting portion 953 that is to come into contact with the jig.

In the flow divider 90, during forward cycle operation, the flows of the refrigerant exiting from the second header internal spaces SP1 enter their corresponding first thin tubes 93, and flow into the flow divider main body 95 (main body internal space SP3) through the first thin tubes 93. The refrigerant having entered the main body internal space SP3 flows through the inflow/outflow pipe 91, and then enters the eighth pipe P8.

Meanwhile, during reverse cycle operation, the refrigerant exiting from the eighth pipe P8 passes through the inflow/outflow pipe 91, and enters the flow divider main body 95 (main body internal space SP3). The refrigerant having entered the main body internal space SP3 is divided to flow into the plurality of first thin tubes 93, and enters any of the second header internal space SP1.

(5) Positional Relation of Parts in Outdoor Heat Exchanger 15

Figure 30:
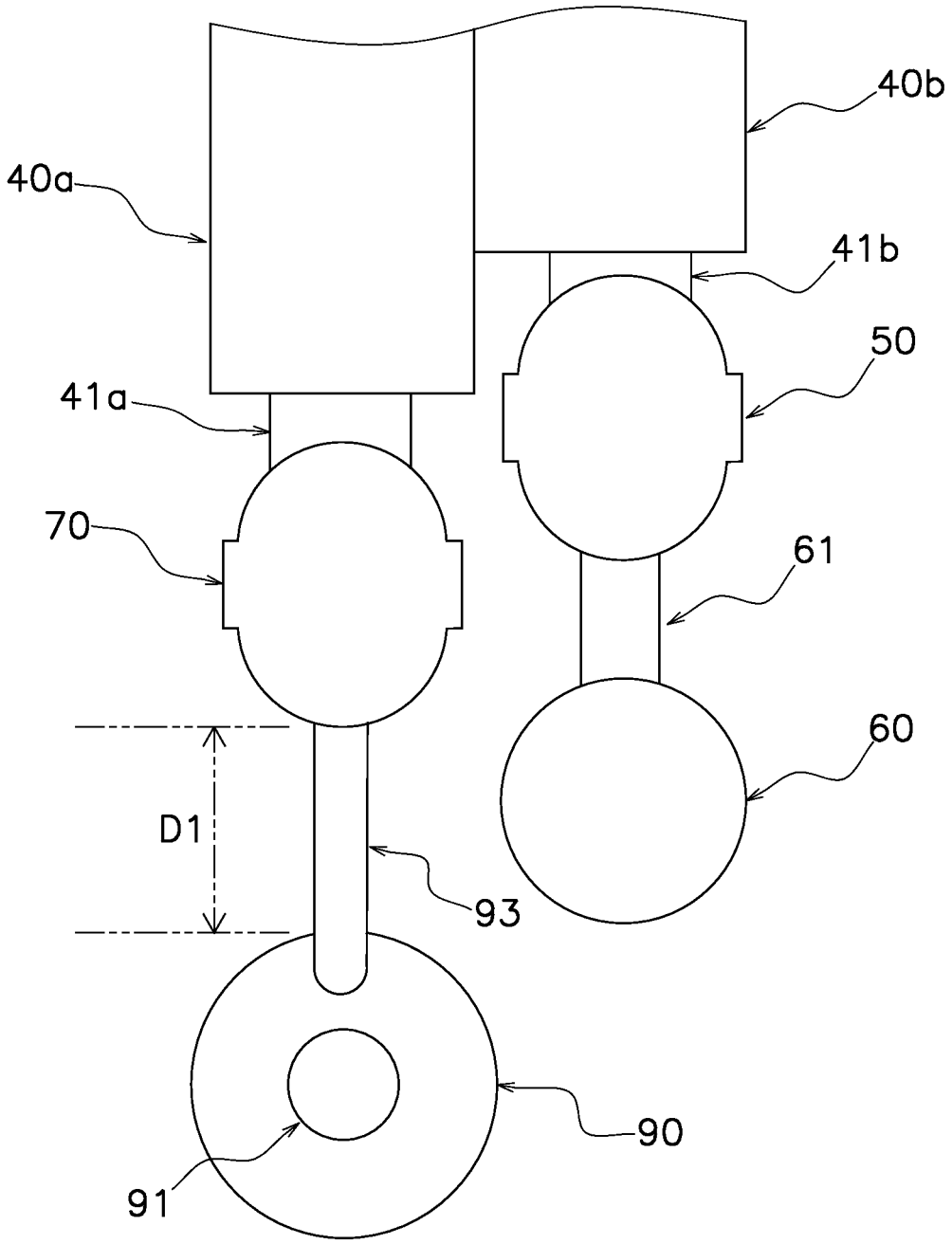
FIG. 30 is a schematic view showing a positional relation between the first header pipe, the gas-side collecting pipe, the second header pipe, and the flow divider in a plan view.

FIG. 30 is a schematic view showing a positional relation between the first header pipe 50, the gas-side collecting pipe 60, the second header pipe 70, and the flow divider 90 in a plan view. In the outdoor heat exchanger 15, the first header pipe 50, the gas-side collecting pipe 60, the second header pipe 70, and the flow divider 90 are arranged closely at a location near an end of the outdoor heat exchanger 15, as shown in FIG. 30. In particular, the second header pipe 70 (second header internal space creating member 78) and the flow divider 90 are arranged close to each other at a location near the first end of the windward-side heat exchanging part 40*a*. A linear distance D1 between the second header pipe 70 (second header internal space creating member 78) and the flow divider 90 in a plan view is set as appropriate according to the design specification and/or installation environment. However, in order to achieve a compact configuration, the linear distance D1 is set equal to or less than 100 mm, in one or more embodiments.

(6) Method for Manufacturing Outdoor Heat Exchanger 15

The outdoor heat exchanger 15 is manufactured by bonding the parts via brazing with a brazing filler metal in the furnace. The outdoor heat exchanger 15 is curved greatly at three portions. That is, the outdoor heat exchanger 15 has curved portions B1, B2, and B3 in a plan view (see FIG. 8). Meanwhile, the brazing is performed in the furnace having a fixed size. Thus, the parts of outdoor heat exchanger 15, including the heat exchanging part 40 that is flat and does not have the curved portions B1, B2, and B3 yet, are put into the furnace, and are subjected to brazing therein. After the brazing is performed in the furnace, the curved portions B1, B2, and B3 are yield by using a predetermined rolling jig and a pressing jig.

(7) Path Configuration of Outdoor Heat Exchanger 15

The outdoor heat exchanger 15 configured as above has a plurality of paths. The "path" herein refers to a refrigerant passage constituted by the first thin tube 93 of the flow divider 90, the second header internal space SP1 (second header internal space creating member 78), one or more corresponding heat transfer tubes 41 (41*a* and 41*b*), and the turnaround space SP2.

FIG. 31 is a schematic view of the paths of the outdoor heat exchanger 15 viewed from the windward side. FIG. 32 is a schematic view of the paths of the outdoor heat exchanger 15 viewed from the downwind side. As shown in FIGS. 31 and 32, the outdoor heat exchanger 15 includes a first path RP1 to a tenth path RP10.

The first path RP1 is an uppermost path in the installation state. In FIGS. 31 and 32, the first path RP1 is located above the chain double-dashed line L1. The first path RP1 includes three windward-side heat transfer tubes 41*a* and three downwind-side heat transfer tubes 41*b*.

The second path RP2 is located at the second position from the top in the installation state. In FIGS. 31 and 32, the second path RP2 is located between the chain double-dashed line L1 and the chain double-dashed line L2. The second path RP2 includes four windward-side heat transfer tubes 41*a* and four downwind-side heat transfer tubes 41*b*.

The third path RP3 is located at the third position from the top in the installation state. In FIGS. 31 and 32, the third path RP3 is located between the chain double-dashed line L2 and the chain double-dashed line L3. The third path RP3 includes eight windward-side heat transfer tubes 41*a* and eight downwind-side heat transfer tubes 41*b*.

The fourth path RP4 is located at the fourth position from the top in the installation state. In FIGS. 31 and 32, the fourth path RP4 is located between the chain double-dashed line L3 and the chain double-dashed line L4. The fourth path RP4 includes nine windward-side heat transfer tubes 41*a* and nine downwind-side heat transfer tubes 41*b*.

The fifth path RP5 is located at the fifth position from the top in the installation state. In FIGS. 31 and 32, the fifth path RP5 is located between the chain double-dashed line L4 and the chain double-dashed line L5. The fifth path RP5 includes 10 windward-side heat transfer tubes 41*a* and 10 downwind-side heat transfer tubes 41*b*.

The sixth path RP6 is located at the sixth position from the top in the installation state. In FIGS. 31 and 32, the sixth path RP6 is located between the chain double-dashed line L5 and the chain double-dashed line L6. The sixth path RP6 includes 11 windward-side heat transfer tubes 41*a* and 11 downwind-side heat transfer tubes 41*b*.

The seventh path RP7 is located at the seventh position from the top in the installation state. In FIGS. 31 and 32, the seventh path RP7 is located between the chain double-dashed line L6 and the chain double-dashed line L7. The seventh path RP7 includes 12 windward-side heat transfer tubes 41*a* and 12 downwind-side heat transfer tubes 41*b*.

The eighth path RP8 is located at the eighth position from the top in the installation state. In FIGS. 31 and 32, the eighth path RP8 is located between the chain double-dashed line L7 and the chain double-dashed line L8. The eighth path RP8 includes 12 windward-side heat transfer tubes 41*a* and 12 downwind-side heat transfer tubes 41*b*.

The ninth path RP9 is located at the ninth position from the top in the installation state. In FIGS. 31 and 32, the ninth path RP9 is located between the chain double-dashed line L8 and the chain double-dashed line L9. The ninth path RP9 includes 13 windward-side heat transfer tubes 41*a* and 13 downwind-side heat transfer tubes 41*b*.

The tenth path RP10 is located at the tenth (lowermost) position from the top in the installation state. In FIGS. 31 and 32, the tenth path RP10 is located between the chain double-dashed line L9 and the chain double-dashed line L10. The tenth path RP10 includes 13 windward-side heat transfer tubes 41*a* and 13 downwind-side heat transfer tubes 41*b*. The tenth path RP10 is branched into an upper tenth path RP10*a* and a lower tenth path RP10*b*.

The upper tenth path RP10*a* is located above the one-dot chain line A1 (FIGS. 31 and 32). The upper tenth path RP10*a* is constituted by the first thin tubes 93, a lowermost one of the second header internal spaces SP1, 11 windward-side heat transfer tubes 41*a*, the turnaround space SP2, and 11 downwind-side heat transfer tubes 41*b*.

The lower tenth path RP10*a* is located below the one-dot chain line A1 (FIGS. 31 and 32). The lower tenth path RP10*b* is constituted by the second thin tube 94, the spaces (S1 and S2) in the first header pipe 50, two downwind-side heat transfer tubes 41*b* at the first and second positions from the bottom, the turnaround space SP2, two windward-side heat transfer tubes 41*a* at the first and second positions from the bottom, and the second header sub space SPa.

The tenth path RP10 configured as above is longer in flow path length than any other path.

According to the paths (RP1 to RP10) configured as above, flow dividing takes place in one of the first header main space S1 and the main body internal space SP3, whereas flow merging takes place in the other of the first header main space S1 and the main body internal space SP3. In other words, the outdoor heat exchanger 15 includes the paths that are in parallel with each other. That is, in principle, a refrigerant having passed through one of the paths (RP1 to RP10) flows out of the outdoor heat exchanger 15 without entering any other paths. In this point, the outdoor heat exchanger 15 differs from a heat exchanger configured such that a refrigerant having passed through one path makes a turn to enter another path.

Here, as described above, while outdoor air flows AF are passing through the heat exchanging part 40 of the outdoor heat exchanger 15, outdoor air flows AF in an upper space (particularly, paths above the center) travel at a higher wind speed than outdoor air flows AF in a lower space (particularly, paths below the center). Thus, an air flow in an upper path travels at a higher wind speed than an air flow in a lower path.

(8) Flow of Refrigerant in Outdoor Heat Exchanger 15

In the outdoor heat exchanger 15, the refrigerant flows in the following manner.

(8-1) During Forward Cycle Operation

During forward cycle operation, the refrigerant flows into the outdoor heat exchanger 15 while exchanging heat with outdoor air flows AF. However, during cooling cycle defrosting operation, the refrigerant flows into the outdoor heat exchanger 15 while exchanging heat with adhered frost.

Specifically, during forward cycle operation, the refrigerant flows into the gas-side collecting pipe 60 from the seventh pipe P7. The refrigerant having entered the gas-side collecting pipe 60 flows into the first header main space S1 of the first header pipe 50 through the plurality of connection pipes 61. The refrigerant having entered the first header main space S1 is divided to flow into the downwind-side heat transfer tubes 41*b* of the respective paths (the first path RP1 to the tenth path RP10), and the divided flows of the refrigerant pass through the downwind-side heat exchanging part 40*b*. The flows of the refrigerant having passed through the downwind-side heat exchanging part 40*b* reach the turnaround header 80 (more specifically, their corresponding turnaround spaces SP2).

Thereafter, the flows of the refrigerant make a turn in the turnaround spaces SP2 to enter their corresponding windward-side heat transfer tubes 41*a*, and pass through the windward-side heat exchanging part 40*a*. The flows of the refrigerant having passed through the windward-side heat exchanging part 40*a* reach the second header pipe 70 (more specifically, their corresponding second header internal spaces SP1).

In principle, the flows of the refrigerant having entered the second header internal spaces SP1 flow into the flow divider 90 (main body internal space SP3) via their corresponding first thin tubes 93. The flows of the refrigerant having entered the main body internal space SP3 via the first thin tubes 93 are merged with each other, and the merged refrigerant passes through the inflow/outflow pipe 91 to enter the eighth pipe P8.

Meanwhile, among the refrigerant having entered the first header main space S1 of the first header pipe 50 from the gas-side collecting pipe 60, a flow of refrigerant having entered a lowermost one of the downwind-side heat transfer tubes 41*b* in the first header main space S1 (i.e., the downwind-side heat transfer tube 41*b* at the second position from the bottom in the downwind-side heat exchanging part 40*b*) flows through the downwind-side heat exchanging part 40*b*. The flow of the refrigerant having passed through the downwind-side heat exchanging part 40*b* makes a turn in the turnaround space SP2 to enter the windward-side heat transfer tube 41*a* at the second position from the bottom, and flows through the windward-side heat exchanging part 40*a*. The flow of the refrigerant having passed through the windward-side heat exchanging part 40*a* makes a turn downward in the second header sub space SPa, and enters the lowermost one of the windward-side heat transfer tubes 41*a* to flow through the windward-side heat exchanging part 40*a* again. Thereafter, the flow of the refrigerant having passed through the windward-side heat exchanging part 40*a* makes a turn in the turnaround space SP2 to enter the lowermost one of the downwind-side heat transfer tubes 41*b*, and flows through the downwind-side heat exchanging part 40*b*. The flow of the refrigerant having passed through the downwind-side heat exchanging part 40*b* then enters the first header sub space S2, and passes through the second thin tube 94 to enter the main body internal space SP3 in the flow divider main body 95.

(8-2) During Reverse Cycle Operation

During reverse cycle operation, the refrigerant flows into the outdoor heat exchanger 15 while exchanging heat with outdoor air flows AF. Specifically, during reverse cycle operation, the refrigerant flows into the inflow/outflow pipe 91 from the eighth pipe P8. The refrigerant having passed through the inflow/outflow pipe 91 reaches the flow divider 90 (main body internal space SP3), and is divided to flow into the plurality of first thin tubes 93 and the second thin tube 94 (namely, flow into the paths).

The flows of the refrigerant having entered the first thin tubes 93 from the main body internal space SP3 reach the second header pipe 70 (more specifically, their corresponding second header internal spaces SP1). The flows of the refrigerant having entered the second header internal space SP1 flow into their corresponding windward-side heat transfer tubes 41*a*, and pass through the windward-side heat exchanging part 40*a*. The flows of the refrigerant having passed through the windward-side heat exchanging part 40*a* reach the turnaround header 80 (more specifically, their corresponding turnaround spaces SP2). Thereafter, the flows of the refrigerant make a turn in the turnaround spaces SP2 to enter their corresponding downwind-side heat transfer tubes 41*b*, and pass through the downwind-side heat exchanging part 40*b*. The flows of the refrigerant having passed through the downwind-side heat exchanging part 40*b* reach the first header pipe 50 (more specifically, the first header main space S1). The flows of refrigerant having entered the first header main space S1 reach the gas-side collecting pipe 60 through the plurality of connection pipes 61, so as to flow out of the outdoor heat exchanger 15.

Meanwhile, the flow of the refrigerant having entered the second thin tube 94 from the main body internal space SP3 (i.e., the refrigerant having entered the lower tenth path RP10*b*) reaches the first header sub space S2 of the first header pipe 50. The flow of the refrigerant having entered the first header sub space S2 flows into the lowermost one of the downwind-side heat transfer tubes 41*b*, and passes through the downwind-side heat exchanging part 40*b*. The flow of the refrigerant having passed through the downwind-side heat exchanging part 40*b* reaches the turnaround header 80 (more specifically, its corresponding turnaround space SP2). Thereafter, the flow of the refrigerant makes a turn in the turnaround space SP2 to enter the lowermost one of the windward-side heat transfer tubes 41*a*, and passes through the windward-side heat exchanging part 40*a*. The flow of the refrigerant having passed through the windward-side heat exchanging part 40*a* makes a turn upward in the second header sub space SPa, and enters the windward-side heat transfer tube 41*a* at the second position from the bottom in the windward-side heat exchanging part 40*a* to flow through the windward-side heat exchanging part 40*a* again. The flow of the refrigerant having passed through the windward-side heat exchanging part 40*a* then makes a turn in the turnaround space SP2 to enter the downwind-side heat transfer tube 41*b* at the second position from the bottom, and flows through the downwind-side heat exchanging part 40*b*. Thereafter, the flow of the refrigerant having passed through the downwind-side heat exchanging part 40*b* enters the first header main space S1, reaches the gas-side collecting pipe 60 through the connection pipe 61, and flows out of the outdoor heat exchanger 15.

(9) Features of Outdoor Heat Exchanger 15

The outdoor heat exchanger 15 configured as above has the following features.

(9-1) Feature of Facilitating Improvement in Performance

In the flow divider main body 95, a height h2 (see FIGS. 27 and 31) of a portion where the main body internal space SP3 and the first thin tubes 93 communicate with each other (i.e., a height of outlet planes of the first thin tubes 93) is a reference head. A head difference exceeding the pressure of a refrigerant passing through the heat transfer tubes 41 hinders the flow of the refrigerant. Particularly in the heat transfer tubes 41 located in a lower portion of the heat exchanging part 40, since the heat transfer tubes 41 is affected by the head, the amount of refrigerant circulating therein tends to be small, whereby the refrigerant is likely to be accumulated therein.

In order to deal with this, the outdoor heat exchanger 15 includes the flat tubes as the heat transfer tubes 41. In addition, the outdoor heat exchanger 15 is configured such that so-called header flow dividing takes place. Specifically, in the outdoor heat exchanger 15, a refrigerant is divided to flow into paths by means of the header (more specifically, the plurality of second header internal spaces SP1 in the second header pipe 70). In addition, the paths (RP1 to RP10) each include a plurality of heat transfer tubes 41. With this configuration, in the second header internal spaces SP1, the refrigerant is divided to flow into the heat transfer tubes 41. In order to divide the refrigerant and cause the divided flows of the refrigerant to flow into the heat transfer tubes 41, particularly, the outdoor heat exchanger 15 is configured such that loop-like flows of the refrigerant are generated in the second header internal spaces S P1.

In the outdoor heat exchanger 15 configured as above, during reverse cycle operation, the head difference may cause drift in the refrigerant in the second header internal space SP1 before the refrigerant enters the heat transfer tubes 41. That is, focusing on heat transfer tubes 41 connected to one second header internal space SP1, a liquid refrigerant flows through a heat transfer tube 41 in a lower stage more smoothly, and a gas refrigerant flows through a heat transfer tube 41 in an upper stage more smoothly. Namely, a pressure loss difference is likely to occur among the plurality of heat transfer tubes 41 arranged in the top-bottom direction in the single path. In this regard, particularly during cooling cycle defrosting operation, the following phenomenon is likely to occur in each path. That is, the refrigerant tends to be accumulated in a lower heat transfer tube(s) 41, which is easily affected by the liquid head, and a hot gas is not supplied thereto, which may often result in frost remained unmelted.

Here, a heat exchanger in which the header flow dividing does not take place includes the same numbers of paths and heat transfer tubes so that they correspond to each other in a one-to-one relation. In a case where such a heat exchanger functions as a condenser, ensuring a pressure difference exceeding a liquid head of a flow divider for a refrigerant flowing through a heat transfer tube in a lowermost path can prevent or reduce accumulation of a refrigerant. Meanwhile, like the outdoor heat exchanger 15, a heat exchanger in which the header flow dividing takes place includes paths having different refrigerant circulation amounts. Thus, in a case where such a heat exchanger functions as a condenser, a pressure difference exceeding the liquid head needs to be ensured for a refrigerant flowing through a heat transfer tube 41 in a lowermost stage, which is most affected by the liquid head and accordingly is likely to have a reduced refrigerant circulation amount.

The outdoor heat exchanger 15 includes the flow divider main body 95 whose height position is lower than those of the conventional configurations in the installation state. In one or more embodiments, the height position of the flow divider main body 95 is reduced, and a height h1 (see FIG. 27) measured from an upper surface of the bottom frame 33 to a bottom surface 952 is 43 mm (i.e., equal to or less than 100 mm). In this regard, the flow divider main body 95 is disposed such that the height position (h2) of the portion where the main body internal space SP3 and the first thin tubes 93 communicate with each other is equal to or lower than the height position (a height h3 in FIG. 31) of the upper end of the lowermost one of the second header internal spaces SP1 (see FIG. 31).

With the outdoor heat exchanger 15 configured as above, it is possible to reduce the head difference resulting from the installation height of the flow divider main body 95 in a case where the outdoor heat exchanger 15 is used as a condenser. Accordingly, a pressure difference exceeding the liquid head is ensured for the liquid refrigerant flowing through the heat transfer tubes 41 disposed in a lower portion of the heat exchanging part 40 (for example, the heat transfer tubes 41 included in the ninth path RP9 and the tenth path RP10). This facilitates improvement in the performance. Particularly during cooling cycle defrosting operation, the above configuration prevents or reduces accumulation of the liquid refrigerant, thereby promoting defrosting. This prevents or reduces frost remained unmelted, thereby giving excellent reliability.

(9-2) Feature of Improving Assembling Easiness

In the outdoor heat exchanger 15, the flow divider main body 95 is installed such that the inflow/outflow pipe 91 extends upward from the main body internal space SP3 and multiple (10 in the drawing, namely, 6 or more) first thin tubes 93 extend downward from the main body internal space SP3. For the flow divider main body 95 installed in this manner, manually bonding the flow divider main body 95 and the first thin tubes 93 to each other via brazing is expected to result in a significant reduction in workability and poor assembling easiness. In order to deal with this, the flow divider main body 95 and the multiple first thin tubes 93 of the outdoor heat exchanger 15 are made of aluminum or an aluminum alloy. Thus, the flow divider 90 can be manufactured by bonding the flow divider main body 95 and the multiple first thin tubes 93 to each other via brazing in the furnace. This facilitates improvement in the assembling easiness.

(9-3) Feature of Improving Compactness

The outdoor heat exchanger 15 has improved compactness. Specifically, in the flow divider 90, the first thin tubes 93 have portions extending downward from the main body internal space SP3, which are followed by portions curved to extend upward toward their corresponding second header internal spaces SP1. More specifically, in one or more embodiments, a half or more of the first thin tubes 93 (nine first thin tubes 93 in the drawing) are upwardly curving tubes 93*a* (see FIGS. 27 and 28). The upwardly curving tubes 93*a* have portions extending downward from the main body internal space SP3, which are followed by portions being curved while protruding downward to change their extending directions upward, which are further followed by portions extending upward while being adjacent to but spaced from the flow divider main body 95. In addition, most of the upwardly curving tubes 93*a* (eight upwardly curving tubes 93*a* in the drawing) are curved toward the center of the flow divider main body 95 and extend upward while being adjacent to but spaced from the inflow/outflow pipe 91 (see FIGS. 27 and 28). That is, a half or more of the first thin tubes 93 are arranged spaced from each other in the circumferential directions of the flow divider main body 95 and inflow/outflow pipe 91 in a plan view in the installation state. In other words, in the flow divider 90, the flow divider main body 95 and the inflow/outflow pipe 91, which extends upward from the top surface, are surrounded by the plurality of first thin tubes 93 (upwardly curving tubes 93*a*) being connected to the bottom surface and being curved to extend upward.

Thanks to the above-described configuration of the flow divider 90, it is possible to reduce a distance between the flow divider main body 95 and the first thin tubes 93, a distance between the inflow/outflow pipe 91 and the first thin tubes 93, and/or distances between the first thin tubes 93. That is, it is possible to arrange the parts close to each other while maintaining clearances therebetween. This improves compactness of the flow divider 90, which is expected to be installed in a small space. This leads to improvement in compactness of the outdoor heat exchanger 15.

(10) Characteristics (10-1)

A known heat exchanger includes a heat exchanging part including a plurality of flat tubes aligned vertically in an installation state, a flow divider disposed at a liquid-side end of the heat exchanger, and a header pipe disposed between the heat exchanging part and the flow divider. According to this heat exchanger, the header pipe internally includes spaces that are aligned in a direction of arrangement of the flat tubes and that respectively communicate with the flat tubes. The spaces in the header and the flow divider are connected to each other via narrow tubes, which provides a plurality of paths (refrigerant flow paths). In a case where such a heat exchanger is used as a condenser, a head difference resulting from an installation height of the flow divider often causes accumulation of a liquid refrigerant in a lowermost flat tube (path) and/or a flat tube(s) (path(s)) near the lowermost one.

In the outdoor heat exchanger 15 according to one or more embodiments, the flow divider 90 includes the inflow/outflow pipe 91 where the refrigerant enters and exits, the plurality of first thin tubes 93 providing refrigerant flow paths at a location closer to the heat exchanging part 40 than is the inflow/outflow pipe 91, and the flow divider main body 95. The flow divider main body 95 communicates with the first end of the inflow/outflow pipe 91 and the first ends of the first thin tubes 93, and internally includes the main body internal space SP3 that causes the refrigerant from one of the inflow/outflow pipe 91 and the first thin tubes 93 to flow into the other. The second header internal space creating members 78 provide refrigerant flow paths at a location between the heat exchanging part 40 and the flow divider 90, and internally include the second header internal spaces SP1 each causing the refrigerant from one of its corresponding heat transfer tube 41 and its corresponding first thin tube 93 to flow into the other. The first end of the inflow/outflow pipe 91 is connected to the flow divider main body 95 such that the inflow/outflow pipe 91 extends upward from the main body internal space SP3 in the installation state. The first ends of the first thin tubes 93 are connected to the flow divider main body 95 such that the first thin tubes 93 extend downward from the main body internal space SP3 in the installation state.

This can lower the height position of the flow divider main body 95 of the flow divider 90 in the installation state. Consequently, in a case where the outdoor heat exchanger is installed such that the heat transfer tubes 41 are aligned vertically and is used as a condenser, it is possible to reduce the head difference resulting from the installation height of the flow divider. Accordingly, in a case where the outdoor heat exchanger is used as a condenser, it is possible to prevent or reduce accumulation of the liquid refrigerant even in a lowermost heat transfer tube 41 (path) and/or a heat transfer tube(s) 41 (path(s)) near the lowermost one, where the liquid refrigerant is likely to be accumulated. This facilitates improvement in the performance. In particular, this prevents or reduces impairment in reliability during forward cycle operation (cooling operation or cooling cycle defrosting operation).

(10-2)

According to the outdoor heat exchanger 15 of the foregoing embodiments, the flow divider main body 95 has the first opening 95*a* in the top surface 951 facing upward in the installation state. The first opening 95*a* is connected with the first end of the inflow/outflow pipe 91. With this configuration, the inflow/outflow pipe 91 can be easily connected to the flow divider main body 95 such that the inflow/outflow pipe 91 extends upward from the main body internal space SP3 in the installation state.

(10-3)

According to the outdoor heat exchanger 15 of the foregoing embodiments, the flow divider main body 95 has the plurality of second openings 95*b* in the bottom surface 952 facing downward in the installation state. The second openings 95*b* are connected with the first ends of the first thin tubes 93, respectively. With this configuration, the first thin tubes 93 can be easily connected to the flow divider main body 95 such that the first thin tubes 93 extend downward from the main body internal space SP3 in the installation state.

(10-4)

According to the outdoor heat exchanger 15 of the foregoing embodiments, in the installation state, the first thin tubes 93 have portions extending downward from the main body internal space SP3, which are followed by portions curved to extend upward. With this configuration, in the installation state, the first thin tubes 93 can be connected to the flow divider main body 95 such that the first thin tubes 93 extend downward from the main body internal space SP3 and extend also to the second header internal spaces SP1, which are located above the portions where the first thin tubes 93 are connected to the flow divider main body 95. In addition, since the distance between the flow divider main body 95 and the first thin tubes 93 is reduced, the flow divider 90 can be made compact.

(10-5)

According to the outdoor heat exchanger 15 of the foregoing embodiments, in the installation state, the second header internal spaces SP1 are aligned vertically, and the first thin tubes 93 have portions extending downward from the main body internal space SP3, which are followed by portions curved to extend to their corresponding second header internal spaces SP1. With this configuration, in the installation state, the first thin tubes 93 can be connected to the flow divider main body 95 such that the first thin tubes 93 extend downward from the main body internal space SP3 and extend also to the second header internal spaces SP1, which are located above the portions where the first thin tubes 93 are connected to the flow divider main body 95. In addition, since the distance between the flow divider main body 95 and the first thin tubes 93 is reduced, the flow divider 90 can be made compact.

(10-6)

According to the outdoor heat exchanger 15 of the foregoing embodiments, the first thin tubes 93 are respectively provided for the second header internal spaces SP1 in a one-to-one relation. Consequently, in spite of the configuration in which the outdoor heat exchanger 15 includes multiple paths, accumulation of the liquid refrigerant in the paths can be prevented or reduced in a case where the outdoor heat exchanger 15 is used as a condenser.

(10-7)

According to the outdoor heat exchanger 15 of the foregoing embodiments, each second header internal space creating member 78 has the windward heat transfer tube connecting openings 711 connected to the first ends of their corresponding heat transfer tubes 41 and the first thin tube connecting opening 73*a* connected to the second end of its corresponding first thin tube 93, and a height position of the first thin tube connecting opening 73*a* is equal to or lower than a height position of a lowermost one of the windward heat transfer tube connecting openings 711 in the installation state. This particularly prevents or reduces accumulation of the liquid refrigerant in the paths in a case where the outdoor heat exchanger 15 is used as a condenser.

(10-8)

According to the outdoor heat exchanger 15 of the foregoing embodiments, the height position (h2 in FIG. 31) of the portion where the main body internal space SP3 and the first thin tubes 93 communicate with each other is equal to or lower than the height position (h3 in FIG. 31) of the upper end of the lowermost one of the second header internal spaces SP1 in the installation state. This particularly prevents or reduces accumulation of the liquid refrigerant in the paths in a case where the outdoor heat exchanger 15 is used as a condenser.

(10-9)

According to the air conditioning system 1 of the foregoing embodiments, the improvement in the performance is facilitated thanks to the features of the outdoor heat exchanger 15.

(11) Modifications

The foregoing embodiments can be appropriately modified as described in the following modifications. It should be noted that these modifications are applicable in conjunction with other modifications insofar as no inconsistency arises.

(11-1) Modification 1

In the foregoing embodiments, the flow divider main body 95 has the bottom surface 952 that faces downward in the installation state and that has the plurality of second openings 95*b* respectively connected with the first ends of the first thin tubes 93. In order to connect the first thin tubes 93 to the flow divider main body 95 such that the first thin tubes 93 extend downward from the main body internal space SP3 in the installation state, the flow divider 90 may have the above-described configuration. However, the configuration of the flow divider 90 is not limited to this. The flow divider 90 may be modified as appropriate, as long as the first thin tubes 93 are connected to the flow divider main body 95 so as to extend downward from the main body internal space SP3 in the installation state. For example, the flow divider main body 95 may alternatively be configured to have a lateral surface that faces laterally in the installation state and that has a part of or all of the plurality of second openings 95*b* formed therein.

(11-2) Modification 2

In the foregoing embodiments, the flow divider main body 95 has the top surface 951 that faces upward in the installation state and that has the first opening 95*a* connected with the first end of the inflow/outflow pipe 91. In order to connect the inflow/outflow pipe 91 to the flow divider main body 95 such that the inflow/outflow pipe 91 extends upward from the main body internal space SP3 in the installation state, the flow divider 90 may have the above-described configuration. However, the configuration of the flow divider 90 is not limited to this. The flow divider 90 may be modified as appropriate, as long as the inflow/outflow pipe 91 is connected to the flow divider main body 95 so as to extend upward from the main body internal space SP3 in the installation state. For example, the flow divider main body 95 may alternatively be configured to have a lateral surface that faces laterally in the installation state and that has the first opening 95*a* formed therein.

(11-3) Modification 3

In the foregoing embodiments, the first thin tubes 93 are respectively provided for the second header internal spaces SP1 in a one-to-one relation, and are connected to their corresponding second header internal spaces SP1. However, the correspondence relation between the first thin tubes 93 and the second header internal spaces SP1 may be modified as appropriate according to the design specification and/or installation environment, as long as no inconsistency arises. For example, the first thin tubes 93 may alternatively be provided for any of the second header internal spaces SP1 in a one-to-many relation, a many-to-one relation, or a many-to-many relation.

In addition, the number of first thin tubes 93 included in the flow divider 90 is not necessarily limited to that in the foregoing embodiments. The number of first thin tubes 93 may be changed as appropriate according to the design specification and/or installation environment. That is, the flow divider 90 may include 11 or more first thin tubes 93 or less than 10 first thin tubes 93.

(11-4) Modification 4

According to the outdoor heat exchanger 15 of the foregoing embodiments, each second header internal space creating member 78 has the windward heat transfer tube connecting openings 711 connected to the first ends of their corresponding heat transfer tubes 41 and the first thin tube connecting opening 73*a* connected to the second end of its corresponding first thin tube 93, and the height position of the first thin tube connecting opening 73*a* is equal to or lower than the height position of the lowermost one of the windward heat transfer tube connecting openings 711 in the installation state. In order to prevent or reduce accumulation of the liquid refrigerant in the paths in a case where the outdoor heat exchanger 15 is used as a condenser, the outdoor heat exchanger 15 may have the above-described configuration. However, in each second header internal space creating member 78, the height position of the first thin tube connecting opening 73*a* does not necessarily have to be equal to or lower than the height position of the lowermost one of the windward heat transfer tube connecting openings 711.

(11-5) Modification 5

According to the outdoor heat exchanger 15 of the foregoing embodiments, the height h2 of the portion where the main body internal space SP3 and the first thin tubes 93 communicate with each other is equal to or lower than the height h3 of the upper end of the lowermost one of the second header internal spaces SP1 in the installation state (see FIG. 31). In order to prevent or reduce accumulation of the liquid refrigerant in the paths in a case where the outdoor heat exchanger 15 is used as a condenser, the outdoor heat exchanger 15 may have the above-described configuration. However, the height h2 of the portion where the main body internal space SP3 and the first thin tubes 93 communicate with each other does not necessarily have to be equal to or lower than the height h3 of the upper end of the lowermost one of the second header internal spaces SP1 in the installation state.

(11-6) Modification 6

In the foregoing embodiments, the single second header pipe 70, which can be deemed as being constituted by collection of the second header internal space creating members 78 (corresponding to "second flow dividers" in the claims) creating the second header internal spaces SP1, is disposed between the heat exchanging part 40 and the flow divider 90.

However, in the outdoor heat exchanger 15, a member creating a space corresponding to the second header internal space SP1 (i.e., a member corresponding to the second header internal space creating member 78) may be provided to another member that is not the second header pipe 70.

For example, instead of or in addition to the second header pipe 70, one or more members (e.g., a header pipe) creating at least one space corresponding to the second header internal space SP1 may be provided between the heat exchanging part 40 and the flow divider 90. In this case, the one or more members correspond to the "second flow dividers" in the claims.

For another example, instead of or in addition to the second header pipe 70, a flow dividing mechanism for dividing the refrigerant and causing the divided flows of the refrigerant to flow into any of or all of the plurality of paths (RP1 to RP10) may be provided between the heat exchanging part 40 and the flow divider 90.

(11-7) Modification 7

In the foregoing embodiments, the outdoor heat exchanger 15 has 10 paths. However, the number of paths provided in the outdoor heat exchanger 15 may be changed as appropriate according to the design specification and/or installation environment. For example, the outdoor heat exchanger 15 may have 11 or more paths or less than 10 paths. In addition, the number of second header internal spaces SP1 in the second header pipe 70 and the number of first thin tubes 93 may also be changed as appropriate according to the number of paths.

(11-8) Modification 8

The configurations of the paths in the foregoing embodiments can be modified as appropriate. For example, the number of heat transfer tubes 41 in each path may be changed individually as appropriate.

(11-9) Modification 9

In the foregoing embodiments, the tenth path RP10 includes the upper tenth path RP10*a* and the lower tenth path RP10*b*. However, the tenth path RP10 does not necessarily have to be configured in this manner. Alternatively, the tenth path RP10 may not include the lower tenth path RP10*b*. In this case, the first header sub space S2, the second header sub space SPa, the second thin tube 94, and/or the like may be omitted.

(11-10) Modification 10

The layout of the parts of the outdoor heat exchanger 15 in the foregoing embodiments may be modified as appropriate. For example, instead of the configuration of the foregoing embodiments in which the first header pipe 50, the gas-side collecting pipe 60, the second header pipe 70, and the flow divider 90 are disposed adjacent to the first end of the heat exchanging part 40 and the turnaround header 80 is disposed adjacent to the second end of the heat exchanging part 40, the first header pipe 50, the gas-side collecting pipe 60, the second header pipe 70, and the flow divider 90 may be disposed adjacent to the second end of the heat exchanging part 40 and the turnaround header 80 may be disposed adjacent to the first end of the heat exchanging part 40. For another example, the positions of the windward-side heat exchanging part 40*a* and the downwind-side heat exchanging part 40*b* may be replaced with each other. That is, the windward-side heat exchanging part 40*a* may be positioned on the downwind side (or the inner side), and the downwind-side heat exchanging part 40*b* may be positioned on the windward side (or the outer side).

(11-11) Modification 11

The gas-side collecting pipe 60 in the foregoing embodiments may be omitted as appropriate. In this case, for example, the first header pipe 50 may be connected to the seventh pipe P7.

(11-12) Modification 12

In the foregoing embodiments, the outdoor heat exchanger 15 includes two parts (the windward-side heat exchanging part 40*a* and the downwind-side heat exchanging part 40*b*) constituting the heat exchanging part 40. However, the configuration of the outdoor heat exchanger 15 is not necessarily limited to this, and may be modified as appropriate. For example, the outdoor heat exchanger 15 may include three or more parts constituting the heat exchanging part 40. In this case, the parts constituting the heat exchanging part 40 may be arranged to lie along the direction of the outdoor air flow AF, or may be arranged in another manner.

For another example, the outdoor heat exchanger 15 may include a single part constituting the heat exchanging part 40. In this case, the turnaround header 80 may be omitted, and the first header pipe 50 may be connected to the ends of the windward-side heat transfer tubes 41*a*. In this example, the space inside the first header pipe 50 may be partitioned for the respective paths.

(11-13) Modification 13

In the foregoing embodiments, the outdoor heat exchanger 15 has a substantial U-shape or a substantial C-shape in a plan view. That is, the outdoor heat exchanger 15 includes the heat exchanging part 40 having three faces primarily intersecting with directions of outdoor air flows AF. However, the configuration of the outdoor heat exchanger 15 is not necessarily limited to this, and may be modified as appropriate.

For example, the outdoor heat exchanger 15 may have a substantial L-shape or a substantial V-shape in a plan view. That is, the outdoor heat exchanger 15 may include the heat exchanging part 40 having two faces intersecting with directions of outdoor air flows AF.

For another example, the outdoor heat exchanger 15 may have a substantial I-shape in a plan view. That is, the outdoor heat exchanger 15 may include the heat exchanging part 40 having a single face intersecting with a direction of an outdoor air flow AF.

For further another example, the outdoor heat exchanger 15 may include the heat exchanging part 40 having four or more faces intersecting with directions of outdoor air flows AF.

(11-14) Modification 14

In the foregoing embodiments, the heat transfer tube 41 has the plurality of flow paths 411. However, the present invention is not limited thereto. Alternatively, a flat tube having a single flow path 411 may be used as the heat transfer tube 41.

(11-15) Modification 15

In the foregoing embodiments, the heat exchanging part 40 includes 97 heat transfer tubes 41. However, the number of heat transfer tubes 41 in the heat exchanging part 40 may be changed as appropriate, and may be 98 or more or less than 97.

(11-16) Modification 16

In the description of the foregoing embodiments, the parts in the outdoor heat exchanger 15 are made of aluminum or an aluminum alloy. However, all of the parts in the outdoor heat exchanger 15 do not necessarily have to be made of aluminum or an aluminum alloy. For example, some of the parts may be made of another type of metal (e.g., a material such as a steel) or another type of material (e.g., a resin).

(11-17) Modification 17

In the foregoing embodiments, the outdoor heat exchanger 15 is configured such that, in the installation state, the linear distance D1 between the flow divider 90 and the second header internal space creating member 78 in a plan view is equal to or less than 100 mm. In order to improve the compactness, a small value may be set for D1. However, the present invention is not necessarily limited to this. Alternatively, the linear distance D1 between the flow divider 90 and the second header internal space creating member 78 in a plan view can be changed as appropriate.

(11-18) Modification 18

In the outdoor heat exchanger 15 according to the foregoing embodiments, the second openings 95*b* are annularly arranged spaced from each other. For the heat exchanger including the flow divider 90 in which the multiple first thin tubes 93 extend downward from the flow divider main body 95, the second openings 95*b* may be arranged in the above-described manner, for the purpose of arranging the multiple first thin tubes 93 closely while maintaining clearances between adjacent ones of the first thin tubes 93. However, the layout of the second opening 95*b* is not necessarily limited to this, and may be modified as appropriate.

(11-19) Modification 19

In the outdoor heat exchanger 15 according to the foregoing embodiments, a half or more of the first thin tubes 93 are the upwardly curving tube 93*a* having portions extending downward from the main body internal space SP3, which are followed by portions curved to extend upward while being adjacent to the flow divider main body 95 in the installation state. The number of upwardly curving tubes 93*a* is not limited to that described in the foregoing embodiments, and may be changed as appropriate. That is, the number of upwardly curving tube 93*a* in the flow divider 90 may be 9 or more or less than 8.

(11-20) Modification 20

In the outdoor heat exchanger 15 according to the foregoing embodiments, in the installation state, the upwardly curving tubes 93*a* have portions extending upward while being adjacent to the flow divider main body 95, which are followed by portions being curved to extend toward the inflow/outflow pipe 91, which are further followed by portions being curved to extend upward while being adjacent to the inflow/outflow pipe 91. The configuration of the upwardly curving tubes 93*a* is not limited to that described in the foregoing embodiments, and may be modified as appropriate according to the design specification and/or installation environment.

(11-21) Modification 21

In the outdoor heat exchanger 15 according to the foregoing embodiments, the upwardly curving tubes 93*a* are arranged spaced from each other in the circumferential direction of the inflow/outflow pipe 91 in a plan view in the installation state. In order to make the flow divider 90 compact, the upwardly curving tubes 93*a* may be arranged in the above-described manner. However, the layout of the upwardly curving tubes 93*a* is not limited to that described in the foregoing embodiments, and may be modified as appropriate according to the design specification and/or installation environment.

(11-22) Modification 22

Other aspects (positions, shapes, sizes, and the like) of the parts of the outdoor heat exchanger 15 according to the foregoing embodiments are not limited to those described in the foregoing embodiments, and may be modified as appropriate according to the design specification and the like, as long as no inconsistency with the description in (10-1) arises.

(11-23) Modification 23

The configuration of the refrigerant circuit RC according to the foregoing embodiments can be modified as appropriate according to the design specification and/or installation environment. For example, instead of a part of the devices in the refrigerant circuit RC or in addition to the devices in the refrigerant circuit RC, a device not shown in FIG. 1 may be provided. For another example, a part of the devices (e.g., the accumulator 11) in the refrigerant circuit RC may be omitted, as long as no hindrance occurs.

(11-24) Modification 24

In the foregoing embodiments, the outdoor heat exchanger 15 is applied to the outdoor unit 10 to which air flows enter laterally and from which air flows exit upwardly. However, the outdoor heat exchanger 15 may be applied to another type of unit. For example, the outdoor heat exchanger 15 may be applied to a trunk-type outdoor unit 10 to which air flows enter laterally and from which air flows exit forward. For another example, the outdoor heat exchanger 15 may be used as an indoor heat exchanger 22 of an indoor unit 20.

(11-25) Modification 25

In the description of the foregoing embodiments, the outdoor heat exchanger 15 is applied to the air conditioning system 1. However, the outdoor heat exchanger 15 is applicable also to other refrigeration apparatuses (e.g., a hot water supply apparatus and a heat pump chiller).

The present invention is applicable to a heat exchanger or an air conditioning indoor unit including a heat exchanger.

Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

REFERENCE SIGNS LIST

1 Air conditioning system (refrigeration apparatus)
10 Outdoor unit
12 Compressor
15 Outdoor heat exchanger (heat exchanger)
18 Outdoor fan
20 Indoor unit
30 Outdoor unit casing
40 Heat exchanging part
40*a* Windward-side heat exchanging part
40*b* Downwind-side heat exchanging part
41 Heat transfer tube (flat tube)
41*a* Windward-side heat transfer tube
41*b* Downwind-side heat transfer tube
42 Heat transfer fin
50 First header pipe
51 Downwind heat transfer tube-side member
52 First header partitioning member
53 Collecting pipe-side member
54 First partitioning plate
55 Second partitioning plate
60 Gas-side collecting pipe
61 Connection pipe
62 Bundling band
70 Second header pipe
71 Windward heat transfer tube-side member
72 Second header partitioning member
72*a* First communication opening
72*b* Second communication opening
73 Flow divider-side member
73*a* First thin tube connecting opening (second connecting port)
74 Partitioning plate
75 Rectifying plate
75*a* Third communication opening
78 Second header internal space creating member (second flow divider)
80 Turnaround header
81 Windward-side opening
82 Downwind-side opening
88 Turnaround space creating member
90 Flow divider (first flow divider)
91 Inflow/outflow pipe (first pipe)
93 First thin tube (second pipe)
93*a* Upwardly curving tube
94 Second thin tube
95 Flow divider main body (main body)
95*a* First opening (first insertion port)
95*b* Second opening (second insertion port)
100 Jig
411 Flow path
511 Downwind heat transfer tube connecting opening
711 Windward heat transfer tube connecting opening (first connecting port)
951 Top surface
952 Bottom surface
953 Abutting portion
AF Outdoor air flow
P1 to P9 First pipe to ninth pipe
RC Refrigerant circuit
RP1 to RP10 First path to tenth path
RP10*a* Upper tenth path
RP10*b* Lower tenth path
S1 First header main space
S2 First header sub space
SPa Second header sub space
SP1 Second header internal space (second space)
SP2 Turnaround space
SP3 Main body internal space (first space)

PATENT LITERATURE

<Patent Literature 1> International Publication No. WO2013/160952

The invention claimed is:

1. A heat exchanger comprising:

a heat exchanging part comprising flat tubes that are vertically aligned when the heat exchanger is installed;

a first flow divider comprising:

a first pipe through which a refrigerant enters or exits from the first flow divider;

second pipes that provide refrigerant flow paths between the heat exchanging part and the first pipe; and a main body that internally has a first space that:

communicates with the first pipe and each of the second pipes, and causes the refrigerant to flow from the first pipe into the second pipes or from the second pipes into the first pipe; and second flow dividers that each internally include a second space that provide refrigerant flow paths between the heat exchanging part and the first flow divider, wherein each of the second spaces:

communicates with each of corresponding ones of the flat tubes and a corresponding one of the second pipes, and causes the refrigerant to flow from the corresponding ones of the flat tubes into the corresponding one of the second pipes or from the corresponding one of the second pipes into the corresponding ones of the flat tubes, wherein the first pipe is connected to the main body such that the first pipe extends upward from the first space when the heat exchanger is installed, each of the second pipes is connected to the main body such that each of the second pipes extends downward from the first space when the heat exchanger is installed, each of the second flow dividers comprises:

first connecting ports each connected to each of the corresponding ones of the flat tubes; and a second connecting port connected to the corresponding one of the second pipes, and in each of the second flow dividers, none of the first connecting ports are disposed lower than the second connecting port when the heat exchanger is installed.

2. The heat exchanger according to claim 1, wherein the main body comprises a top surface that faces upward when the heat exchanger is installed and that comprises a first insertion port, and the first pipe is connected to the main body at the first insertion port.

3. The heat exchanger according to claim 1, wherein the main body comprises a bottom surface that faces downward when the heat exchanger is installed and that comprises second insertion ports, and each of the second pipes is connected to the main body at each of the second insertion ports.

4. The heat exchanger according to claim 1, wherein, when the heat exchanger is installed, each of the second pipes comprises a portion that extends downward from the first space and that is followed by a portion curved to extend upward.

5. The heat exchanger according to claim 1, wherein when the heat exchanger is installed, the second spaces are aligned vertically, and each of the second pipes comprises a portion that extends downward from the first space and that is followed by a portion curved to extend toward a corresponding one of the second spaces.

6. The heat exchanger according to claim 1, wherein the second pipes are respectively disposed for the second spaces in a one-to-one relation.

7. A refrigeration apparatus comprising:

a compressor that compresses a refrigerant; and the heat exchanger according to claim 1.

8. A heat exchanger comprising:

a heat exchanging part comprising flat tubes that are vertically aligned when the heat exchanger is installed;

a first flow divider comprising:

a first pipe through which a refrigerant enters or exits from the first flow divider;

second pipes that provide refrigerant flow paths between the heat exchanging part and the first pipe; and a main body that internally has a first space that:

communicates with the first pipe and each of the second pipes, and causes the refrigerant to flow from the first pipe into the second pipes or from the second pipes into the first pipe; and second flow dividers that each internally include a second space that provide refrigerant flow paths between the heat exchanging part and the first flow divider, wherein each of the second spaces:

communicates with each of corresponding ones of the flat tubes and a corresponding one of the second pipes, and causes the refrigerant to flow from the corresponding ones of the flat tubes into the corresponding one of the second pipes or from the corresponding one of the second pipes into the corresponding ones of the flat tubes, wherein the first pipe is connected to the main body such that the first pipe extends upward from the first space when the heat exchanger is installed, each of the second pipes is connected to the main body such that each of the second pipes extends downward from the first space when the heat exchanger is installed, and a portion where the first space communicates with each of the second pipes is not disposed higher than an upper end of a lowermost one of the second spaces when the heat exchanger is installed.

* * * * *